US007841282B2

(12) United States Patent
Kimberlin et al.

(10) Patent No.: US 7,841,282 B2
(45) Date of Patent: Nov. 30, 2010

(54) APPARATUS, SYSTEM, AND METHOD FOR OPERATING AND CONTROLLING COMBUSTOR FOR GROUND OR PARTICULATE BIOMASS

(76) Inventors: John Kimberlin, 3338 Ute Ave., Waukee, IA (US) 50263; Matthew B. Keeling, 3729 W. 56th St. North, Newton, IA (US) 50208

( * ) Notice: Subject to any disclaimer, the term of this patent is extended or adjusted under 35 U.S.C. 154(b) by 504 days.

(21) Appl. No.: 11/533,843

(22) Filed: Sep. 21, 2006

(65) Prior Publication Data

US 2008/0072806 A1 Mar. 27, 2008

(51) Int. Cl.
*F23K 3/00* (2006.01)
*F23N 5/00* (2006.01)

(52) U.S. Cl. ..... 110/101 C; 110/186; 110/267; 110/317

(58) Field of Classification Search ..... 110/108, 110/216, 190, 346, 345
See application file for complete search history.

(56) References Cited

U.S. PATENT DOCUMENTS 4,206,743 A * 6/1980 Niemela ..... 110/297
4,287,838 A * 9/1981 Frosch et al. ..... 110/234
4,517,903 A * 5/1985 Richmond et al. ..... 110/233
4,638,747 A * 1/1987 Brock et al. ..... 110/264
4,782,765 A * 11/1988 Miller et al. ..... 110/186
5,105,797 A * 4/1992 Gulutzen et al. ..... 126/61
5,284,103 A * 2/1994 Hand et al. ..... 110/255
5,359,945 A * 11/1994 Buckner et al. ..... 110/233
5,497,710 A * 3/1996 Camacho ..... 110/250
5,658,361 A * 8/1997 Arencibia, Jr. ..... 110/345
5,678,494 A * 10/1997 Ulrich ..... 110/224
5,839,375 A 11/1998 Kimberlin
5,873,356 A * 2/1999 Vossler et al. ..... 110/203
5,893,358 A * 4/1999 Whitfield ..... 110/233
6,244,196 B1 6/2001 Kimberlin
6,405,662 B1 * 6/2002 Williams et al. ..... 110/341
6,464,492 B1 * 10/2002 Guarco et al. ..... 110/345
6,615,748 B2 * 9/2003 Sunter et al. ..... 110/233
6,928,936 B1 * 8/2005 Mukherjee et al. ..... 110/293
7,047,893 B2 * 5/2006 Loving ..... 110/342
2004/0200394 A1 * 10/2004 Krumrei ..... 110/347

* cited by examiner

*Primary Examiner*—Kenneth B Rinehart
*Assistant Examiner*—David J Laux
(74) *Attorney, Agent, or Firm*—McKee, Voorhees & Sease, P.L.C.

(57) ABSTRACT

An apparatus, method, and system for combusting bridging fuel which includes biomass material. The apparatus includes an enclosure having a relatively thin wall defining a firebox. A temperature sensor is positioned on the exterior of the wall of the firebox. A controller is operatively connected to the temperature sensor and the fuel feed conveyor. If the temperature sensor exceeds a set point, the controller automatically operates the fuel feed conveyor to refill the firebox with fuel, which reinsulates the wall of the firebox so that fuel surrounds the combustion. A method according to the invention causes a refilling of fuel into a firebox upon sensing a condition indicative of a collapse of the bridging fuel in the firebox during combustion, losing its insulating effect at that location. The refilling is adapted to reinsulate the firebox with the fuel.

42 Claims, 42 Drawing Sheets

MATERIAL: 6" X 6" X 1/2" SQ STEEL TUBE
(1) REQ'D

"AA"

VIEW "BB"

| THERMOCOUPLE # | FUNCTION | TYPE |
|---|---|---|
| T1 | SUPPLY AIR TEMP EXCHANGER | J |
| T2 | TOP SKIN TEMPERATURE 1 | J |
| T3 | TOP SKIN TEMPERATURE 2 | J |
| T4 | TOP SKIN TEMPERATURE 3 | J |
| T5 | TOP SKIN TEMPERATURE 4 | J |
| T6 | TOP SKIN TEMPERATURE 5 | J |
| T7 | TOP SKIN TEMPERATURE 6 | J |
| T8 | TOP SKIN TEMPERATURE 7 | J |
| T9 | TOP SKIN TEMPERATURE 8 | J |
| T10 | TRANSFER TUBE (FILL AUGER) | J |
| T11 | STACK LOW | J |
| T12 | STACK HIGH | J |
| T13 | EXHAUST | J |
| T14 | EXCHANGE TEMPERATURE 1 | K |
| T15 | EXCHANGE TEMPERATURE 2 | K |
| T16 | EXCHANGE TEMPERATURE 3 | K |
| T17 | EXCHANGE TEMPERATURE 4 | K |
| T18 | EXCHANGE TEMPERATURE 5 | K |
| T19 | EXCHANGE TEMPERATURE 6 | K |
| T20 | EXCHANGE TEMPERATURE 7 | K |
| T21 | EXCHANGE TEMPERATURE 8 | K |
| T22 | EXCHANGE TEMPERATURE 9 | K |
| T23 | EXCHANGE TEMPERATURE 10 | K |
| T24 | EXCHANGE TEMPERATURE 11 | K |
| T25 | EXCHANGE TEMPERATURE 12 | K |
| T26 | EXCHANGE TEMPERATURE 13 | K |
| T27 | EXCHANGE TEMPERATURE 14 | K |
| T28 | EXCHANGE TEMPERATURE 15 | K |
| T29 | EXCHANGE TEMPERATURE 16 | K |

*Fig. 11F*

| WDG | VOLTS | CONNECT | LINE |
|---|---|---|---|
| PRI | 440 | H5-H6 | H1-H10 |
| | 416 | H4-H6 | H1-H9 |
| | 400 | H3-H6 | H1-H8 |
| | 380 | H2-H6 | H1-H7 |
| SEC | 220 | X2-X3 | X1-X4 |
| | 110/220 | X2-X3 | X1-X3-X4 |
| | 110 | X1-X3, X2-X4 | X1-X4 |

(FIREBOX EMPTY)

(PARTIALLY FILLED)

(FIREBOX FULL - REVERSE FEED AUGER TO SEAL)

(INITIAL IGNITION)

(EARLY STAGE OF CONTINUOUS OPERATION)

(GROWING FIREBALL)

(FULLY DEVELOPED FIREBALL)

(COLLAPSE OF FUEL IN ZONE 2)

(AUTO FILL SEQUENCE)

(FIRE BOX RE-INSULATED - REVERSE AUGER TO SEAL)

APPARATUS, SYSTEM, AND METHOD FOR OPERATING AND CONTROLLING COMBUSTOR FOR GROUND OR PARTICULATE BIOMASS

I. BACKGROUND OF THE INVENTION

A. Field of the Invention

The present invention relates to an apparatus, system, and method for generating heat energy from combustion, and in particular, from the combustion of biomass materials that have bridging characteristics.

B. Problems in the Art

U.S. Pat. Nos. 5,839,375 and 6,244,196, of which one of the present inventors is an inventor, disclose combustors for bridging biomass fuels. These patents are incorporated by reference herein in their entireties. The combustors utilize the natural bridging characteristics of that type of fuel. Combustion is instigated from inside a mass of the fuel in the middle of the firebox. The surrounding fuel tends to maintain its position as combustion proceeds inside to outside because of its bridging characteristics. The characteristics of the fuel cause the fuel to resist flowing. This includes a resistance to flowing or easily separating, fracturing, or collapsing once initially filled into a container. This includes a resistance to collapse or cave in by gravity, even though a middle portion is missing or consumed. The fuel also acts as an insulator. It substantially envelopes the combustion zone. This holds heat in for higher combustion temperatures and more complete burning. It also keeps the exterior of the combustor relatively cool. As can be appreciated, these combustors can generate temperatures of many hundreds of degrees Fahrenheit ("F"). If such level of heat were conducted or convected to the relatively thin metal skin or wall of such combustors, it would represent a safety hazard to people, animals, and anything combustible.

Not only can these machines be used to incinerate, and thus dispose of, a variety of materials, the heat energy of the combustion is available for a variety of beneficial uses. For example, combustion air is ejected into the interior combustion zone surrounded by the fuel. A heat exchanger, also in that combustion zone, can extract a substantial amount of the heat energy and make it available for use.

The advantages of the combustors of U.S. Pat. Nos. 5,839,375 and 6,244,196 are many. These combustors are non-complex, can be scaled up or down in size, and can be used to effectively combust a variety of materials which otherwise might simply be thrown away or represent a cost to dispose of. And, energy can be extracted for beneficial use. Appropriately operated, emissions can also be minimized, or at least pass most, if not all, emissions regulations.

Additionally, a significant advantage is that the combustor does not require a refractory or other built-in heat insulation, which are expensive and require significant maintenance. They also may make it economically impractical for small to medium size combustors.

However, the inventors have found that there is room for improvement regarding these types of combustors. For example, they tend to be batch mode; not continuous mode combustors. They are filled with the biomass fuel. Combustion burns the material from inside to outside. Once enough material has been consumed, gravity caves in the material from the top. Combustion either extinguishes or loses its efficiency. The machine must be shut down, refilled with a new batch of fuel, and reignited. This requires significant manual labor. It also involves considerable "down time" for the combustor. It is inefficient and costly, for most situations, to have operating personal try to continuously monitor the status of the combustor and, in particular, try to identify when cave in has or will occur.

U.S. Pat. Nos. 5,839,375 and 6,244,196 do disclose features that reduce some manual labor with respect to operation of the combustor disclosed therein. For example, an optional fill auger along the top of the combustion or fire box allows fuel to be moved mechanically, instead of manually, into the combustor when a new batch is needed. See either U.S. Pat. No. 5,839,375 or 6,244,196, FIG. 2 and/or column 7, line 17 and column 5, line 25. However, this requires an inlet into the firebox. This can reduce efficiency of operation because it provides a path out of the combustor in addition to the exhaust path. Also, there is no effective way to know when fuel refilling is required. Therefore, the fill auger in those patents is primarily a mechanical way to fill in another batch of fuel once the predecessor batch has collapsed or been consumed.

Some prior attempts to operate the above-described types of combustors utilize hydraulics for such things as the fill auger or the fans that supply combustion air or heat exchanger air or fluid. However, it has been found that use of hydraulics have inherent issues when applied to such combustors. This has especially been found to be the case when the combustors are used for a variety of different fuel types, particle sizes, moisture levels, and other fuel or operational characteristics. For example, hydraulic fluid can behave differently depending on weather and/or ambient temperature differences or changes. This, in turn, can cause significant variations in operation of hydraulic motors. This makes it difficult to maintain consistent operation with combustors of the type described above, if hydraulics are utilized. Furthermore, many times pressure is not consistent in the fire box. This can lead to inconsistent heat output and pollution. Many hydraulic fluids are petroleum-based. Any leak or spill can represent an environmental and safety issue.

When the fuel collapses in these machines, safety issues also arise. The fire ball is exposed to the sidewall of the fire box and can heat it to dangerous temperatures. Also, the refractory action of the surrounding fuel is diminished or lost, which affects the efficiency of the combustor. Also, this results in lost heat.

Other issues have arisen with the above types of combustors. Typical access doors to allow interior maintenance of such combustors risk exposing the workers to the fire ball. Rocks or other non-combustible debris in the fuel may cause binding clogging of input or output to the combustor. Stack fires have occurred. Inconsistency or loss of pressure inside the firebox can cause smoking, either out of the stack or even through the input into the firebox.

Also there are issues regarding the ability of these particular types of combustors to handle a variety of fuel particle sizes, fuel types, moisture levels, and other fuel characteristics.

There is, therefore, a real need in the art for improvements in at least some aspects of the combustors such as disclosed at U.S. Pat. Nos. 5,839,375 and 6,244,196.

II. BRIEF SUMMARY OF THE INVENTION

A. Objects, Features, Advantages or Aspects of the Invention

It is therefore a principle object, feature, advantage, or aspect of the present invention to provide an apparatus, system, or method for operating and controlling a combustor for bridging biomass which improves over or solves certain problems and deficiencies in the art.

Other objects, features, advantages or aspects of the present invention include an apparatus, system, or method as above described which:

a. is capable of automatic or semi-automatic continuous operation.

b. is capable of an automatic, repeatable refill process.

c. is capable of an automated ash and remnant removal process.

d. automatically maintains pressurization of the firebox for better and more consistent combustion.

e. is capable of monitoring operation of combustion and associated functions to facilitate combustion.

f. is applicable to a variety of fuels and fuel characteristics.

g. is relatively noncomplex with minimum moving parts.

h. can be advantageously utilized within existing environmental regulations.

i. has safety features and failsafes.

j. allows capture and use of heat energy from combustion, as well as continuous operation, on demand.

k. can monitor and detect cave-in or collapse of the layer of insulating fuel around interior walls of the firebox during combustion.

In one aspect of the present invention, a metal-wall enclosure defines a firebox which is adapted to receive and enclose a mass of material for fuel, where the material includes biomass and has bridging characteristics. A combustion air supply outlet is positioned inside the firebox for delivering combustion air inside the fuel. A heat exchanger is also positioned in the firebox inside the fuel. A fill mechanism is adapted to move fuel into the firebox on demand. A cleanout device can remove ash and remnant from the firebox on demand. A control system monitors temperature of the wall of the firebox. Upon exceeding a threshold, the control system assumes the fuel has collapsed and instigates an automatic fill sequence, utilizing the fill mechanism to bring in more fuel to plug the collapsed area of the fuel and re-insulate the wall of the firebox to continue efficient combustion.

In another aspect of the present invention, the control system automatically operates to keep the firebox sealed and pressurized for combustion. The combustor has an exhaust outlet, but if the fill mechanism is used to load fuel into the firebox for combustion by bringing it through a fill opening to the firebox, the fill mechanism reverses or otherwise operates to plug the opening into the firebox with fuel to create an effective seal in that opening to allow consistent pressurization of the firebox, as opposed to losing heat through the fill opening.

In another aspect of the present invention, the refilling process reinsulates the firebox to keep the outside wall of the firebox at a reasonable temperature and keep heat inside the firebox. This eliminates the need for a refractory or other structure in or on the interior of the firebox.

These and other objects, features, advantages or aspects of the present invention will become more apparent with reference to the accompanying specification and claims.

III. BRIEF DESCRIPTION OF THE DRAWINGS

Figure 4A:
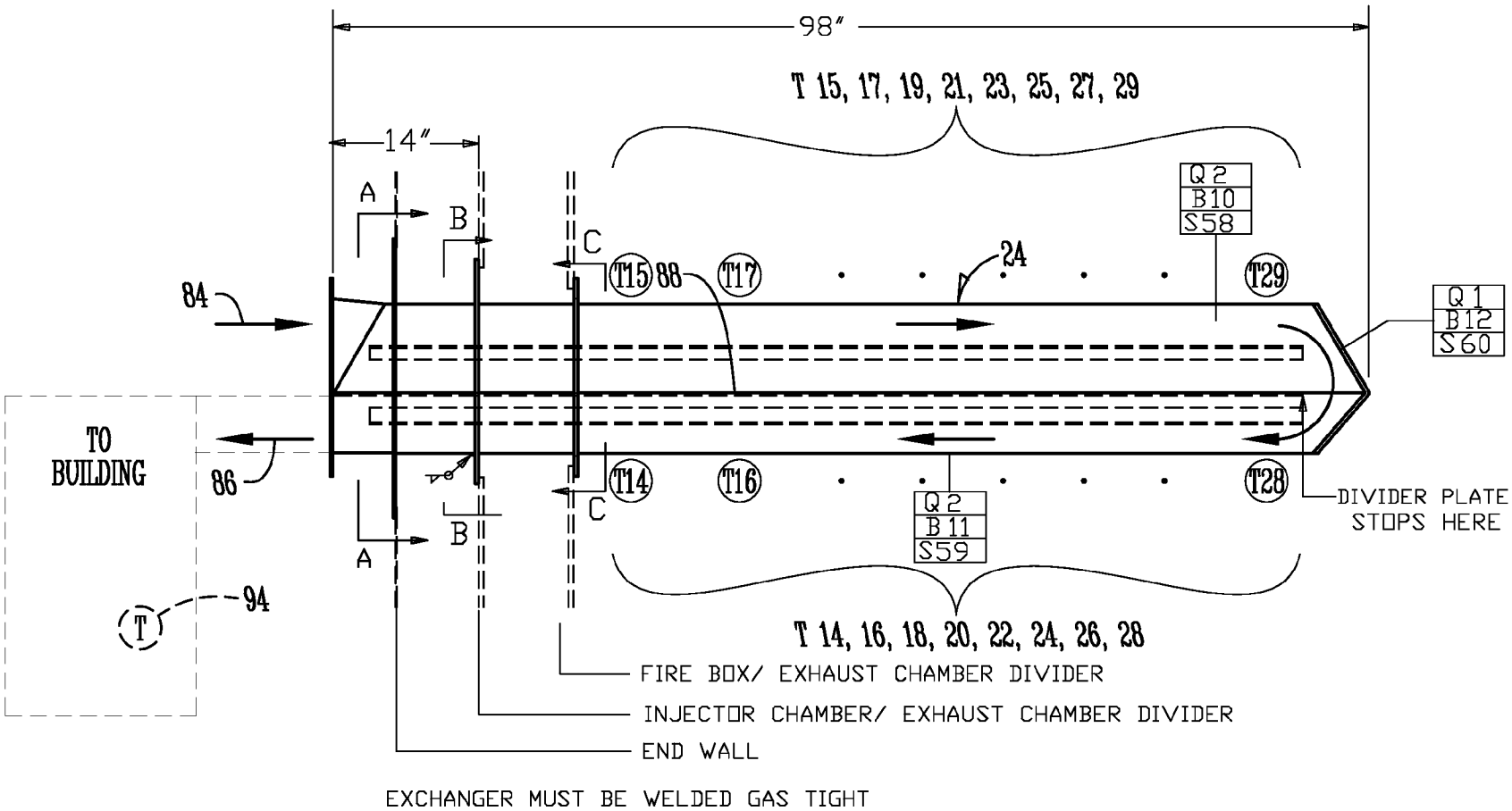
FIG. 4A is an enlarged isolated side elevation of the heat exchanger of FIG. 2A.
Figure 4B:
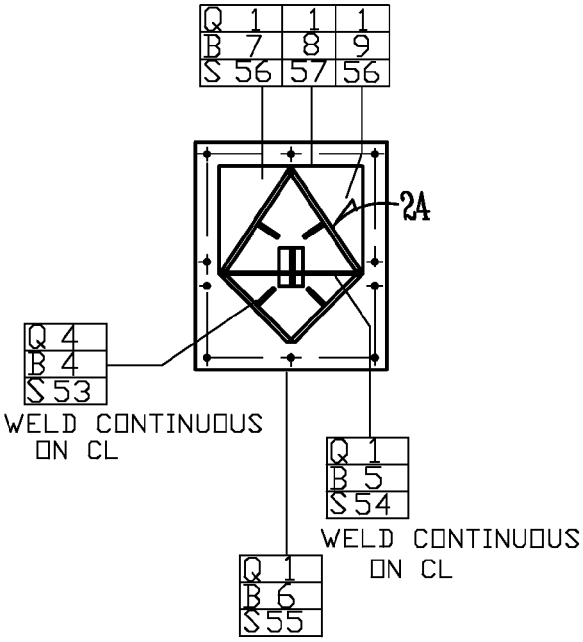
Figure 4C:
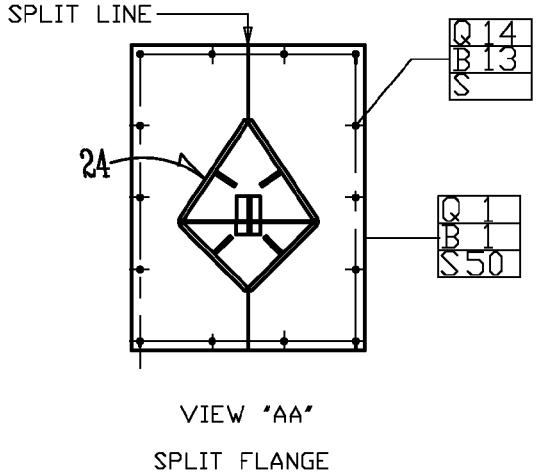
Figure 4D:
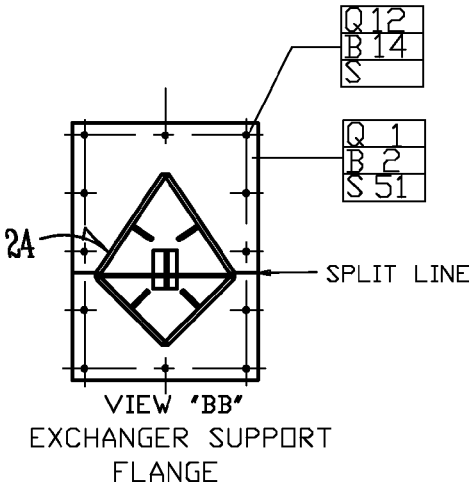
Figure 4E:
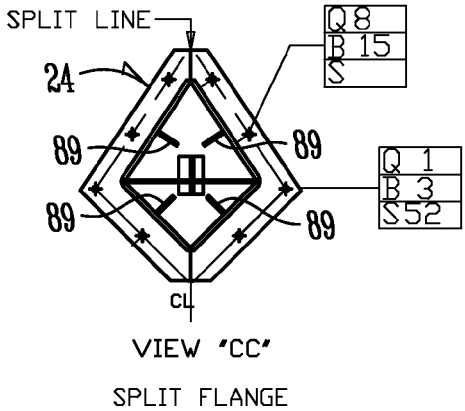

FIGS. 4B-E are left end elevation, section AA, section BB and section CC views, respectively, of FIG. 4A.

Figure 2A:
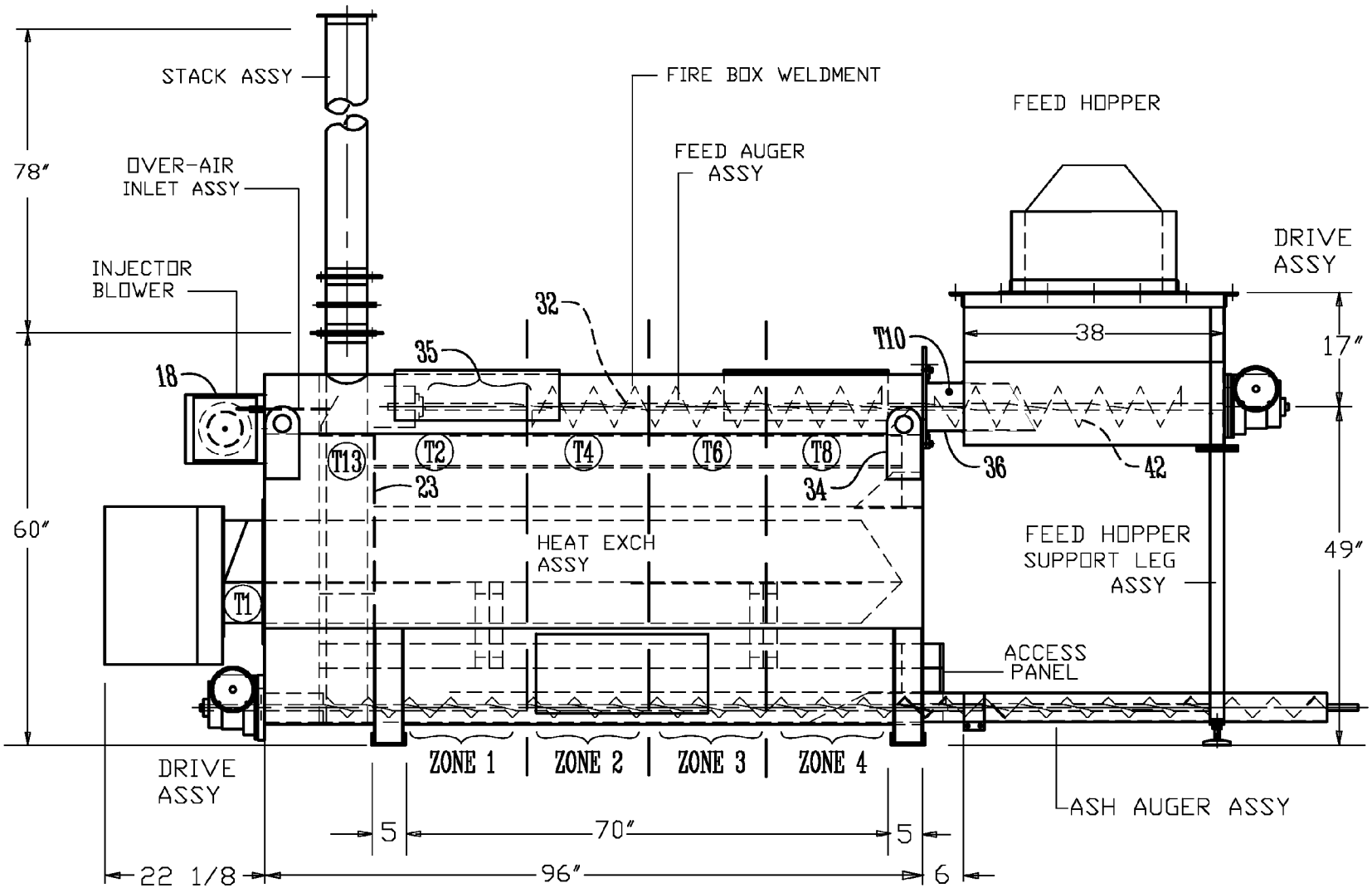
FIG. 2A is essentially an enlarged version of FIG. 1A.
Figure 5B:
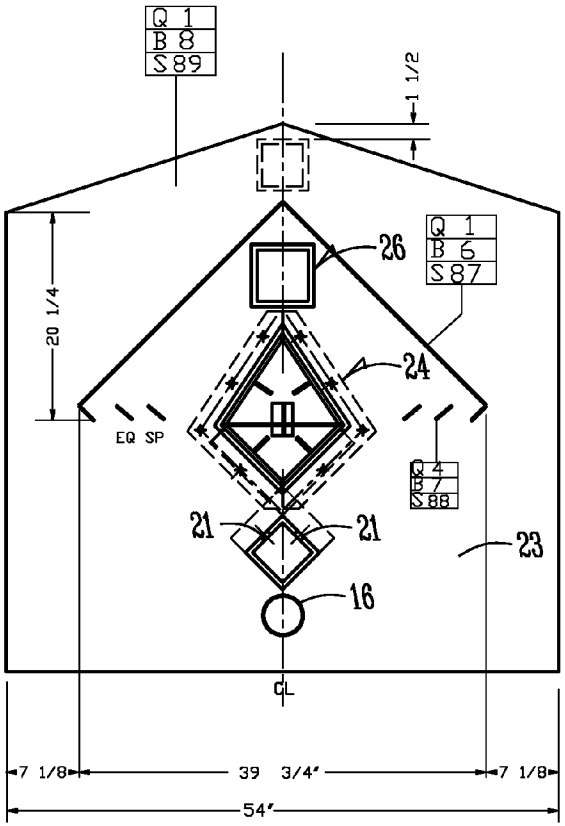
Figure 5A:
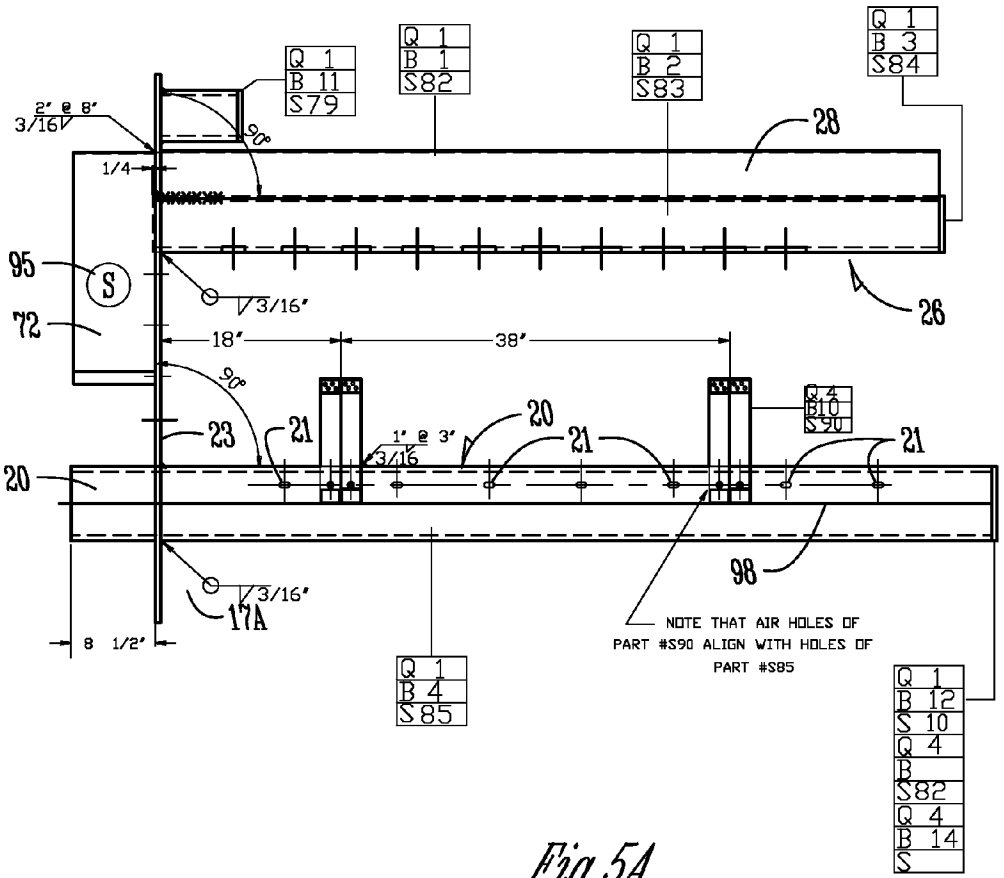

FIG. 5A is an enlarged isolated side elevation of the combustion air inlet tube and exhaust tube of FIG. 2A.

FIG. 5B is a left end elevation of FIG. 5A.

Figure 6B:
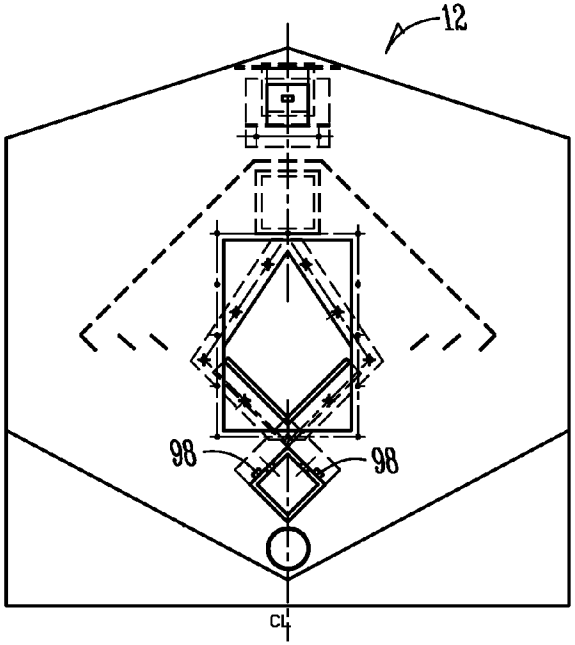
Figure 6A:
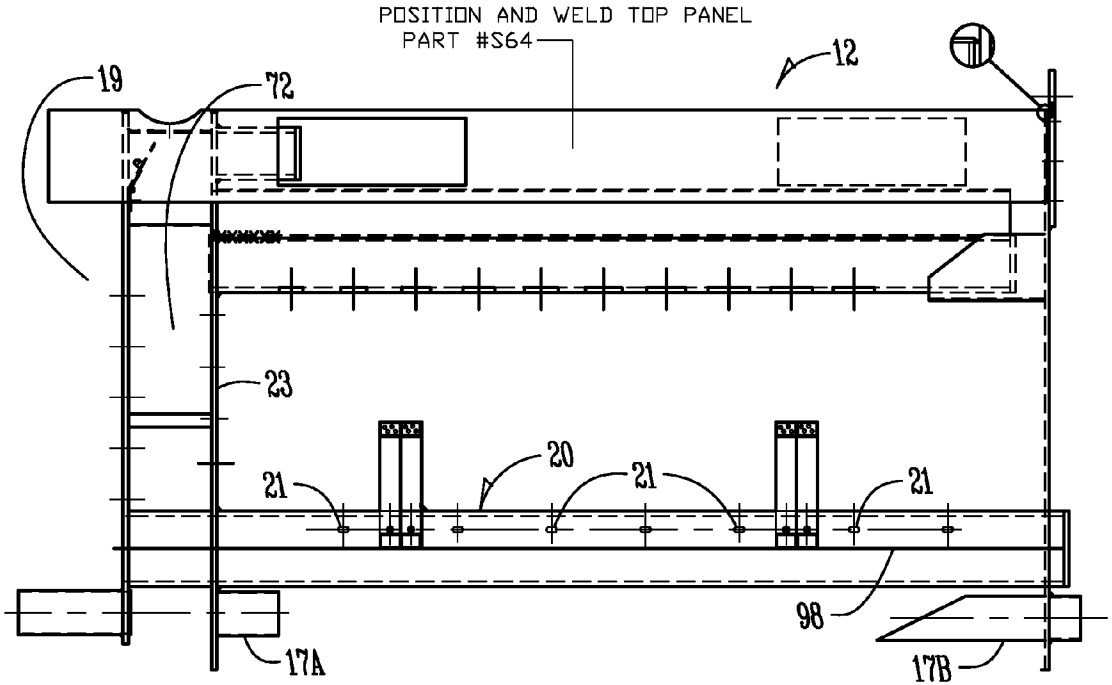

FIG. 6A is similar to FIG. 5A but includes the firebox.

FIG. 6B is a left end elevation of FIG. 6A.

Figure 7C:
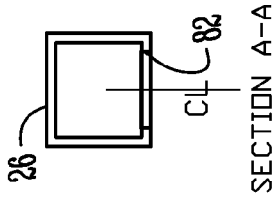
Figure 7A:
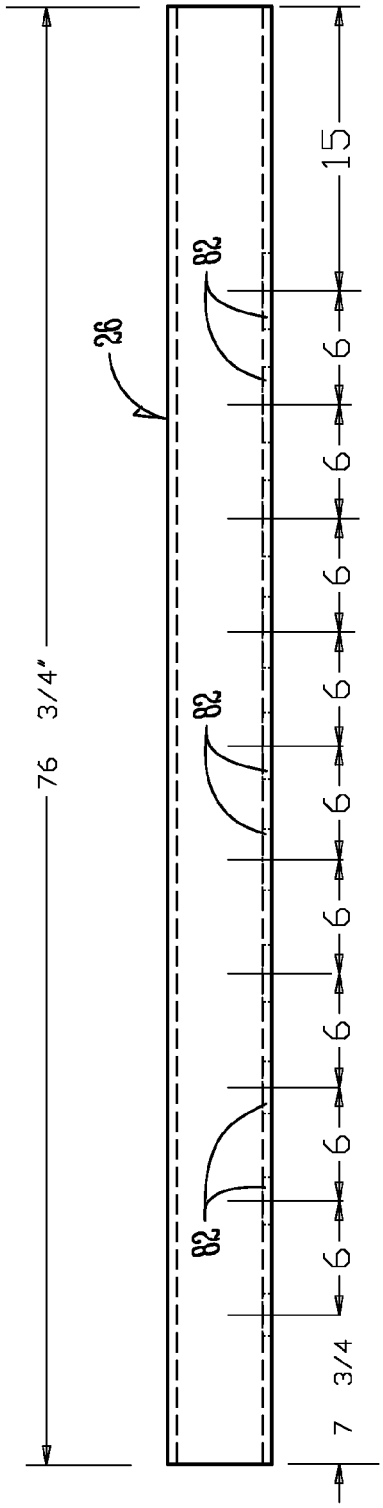

FIG. 7A is an enlarged, isolated side elevation of the exhaust tube.

Figure 7B:
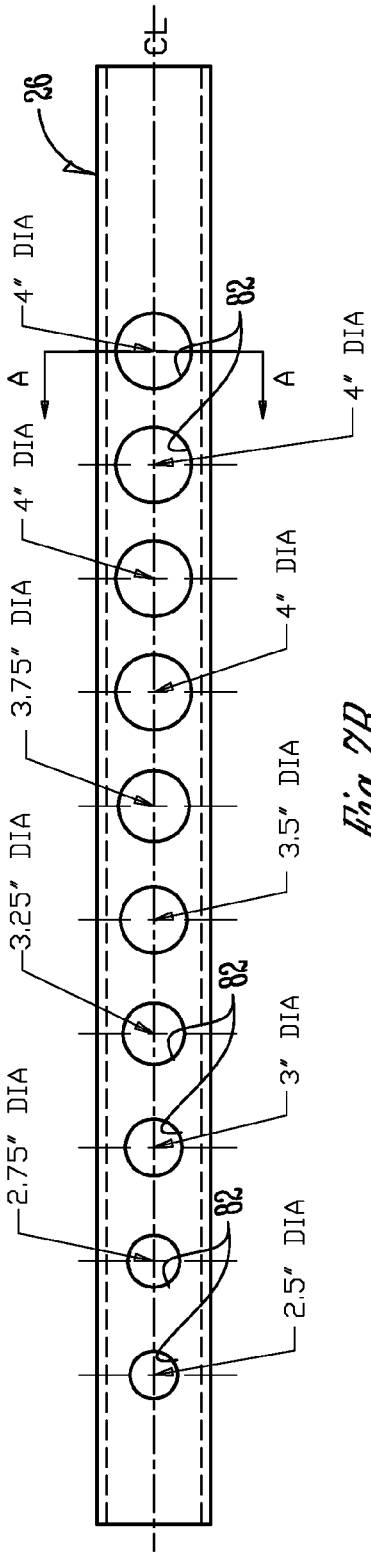

FIG. 7B is a bottom plan view of FIG. 7A.

FIG. 7C is a sectional view taken along line AA of FIG. 7B.

Figure 1A:
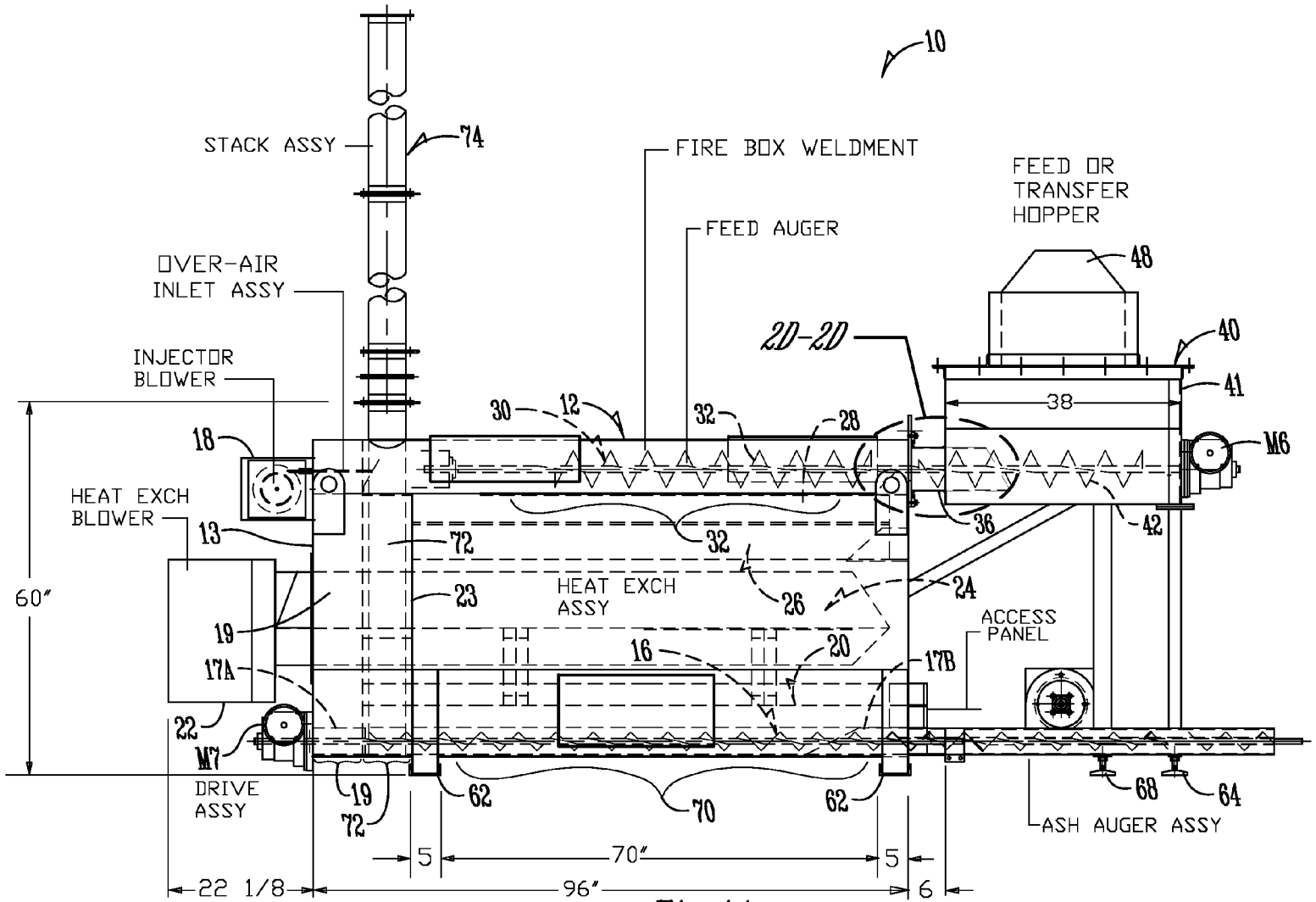
FIG. 1A is a side elevation view of an exemplary embodiment of a biomass combustor and feeder transfer hopper according to the present invention.
Figure 8A:
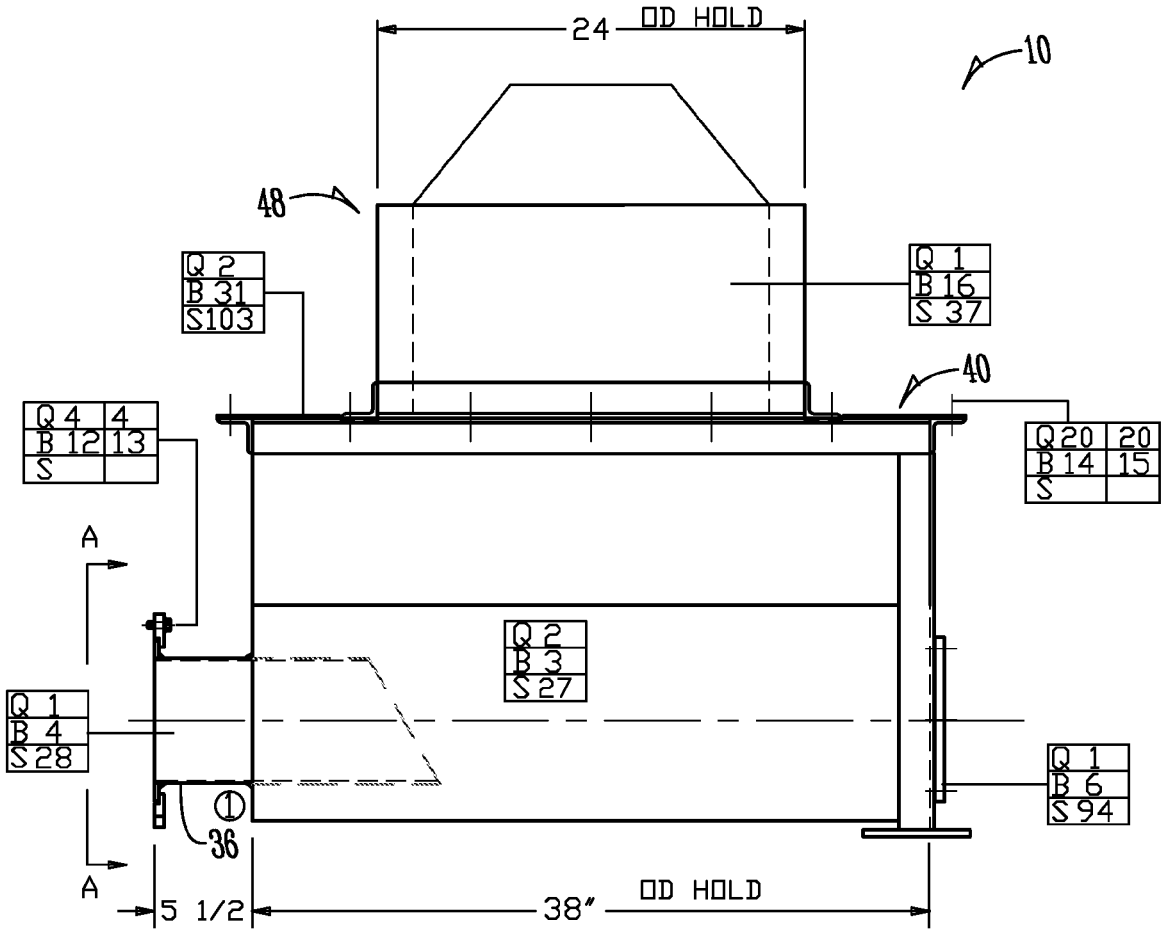

FIG. 8A is an enlarged, isolated side elevation of the feeder transfer hopper of FIG. 1A.

Figure 8B:
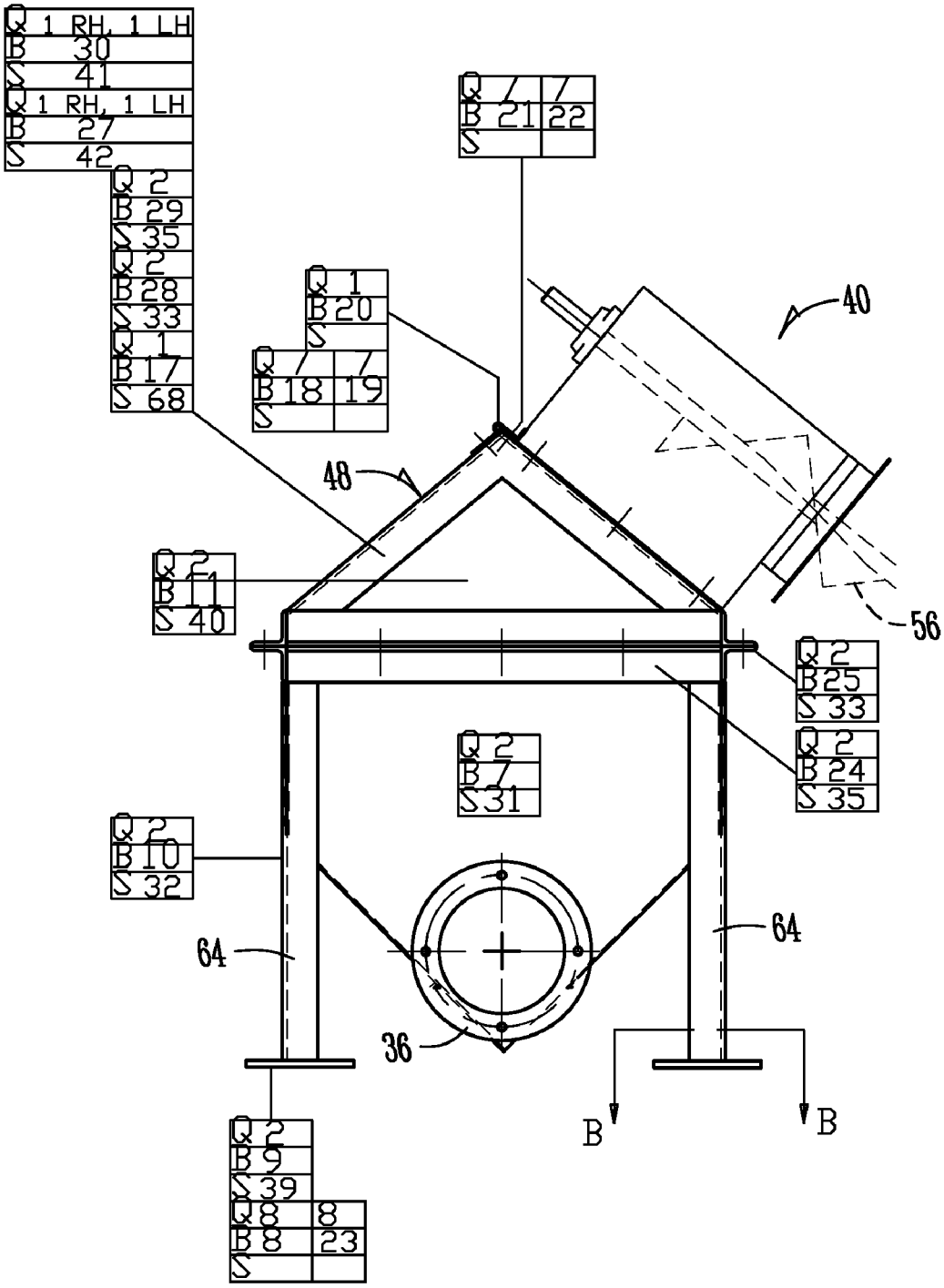

FIG. 8B is a right end elevation of FIG. 8A.

Figure 8C:
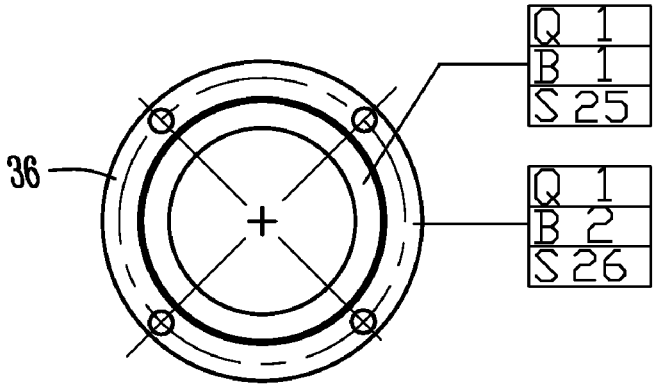

FIG. 8C is an enlarged view taken along line AA of FIG. 8A.

Figure 8D:
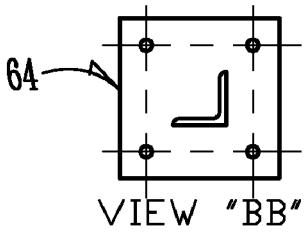

FIG. 8D is a view taken along line BB of FIG. 8B.

Figure 9A:
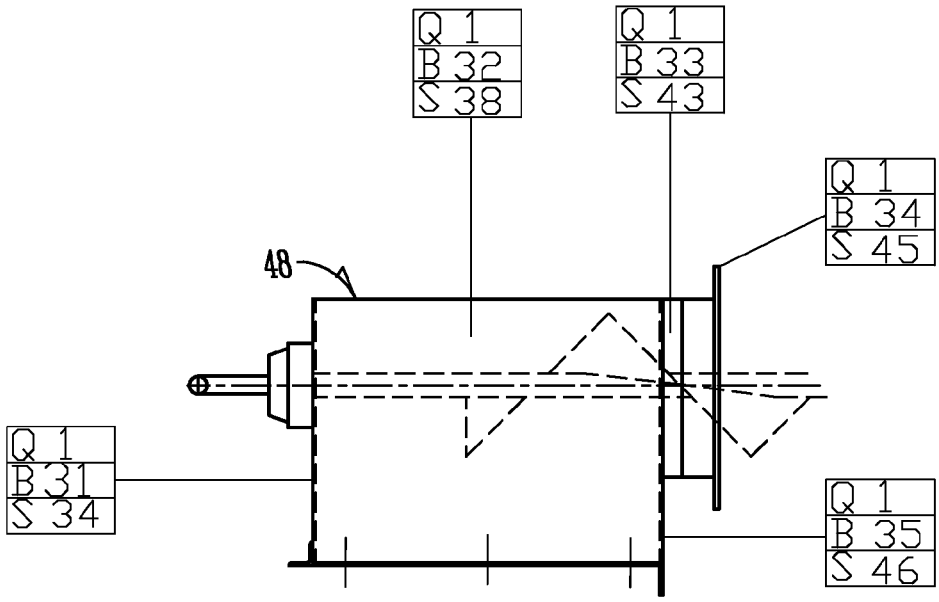

FIG. 9A is an enlarged isolated side elevation view of the feed or transfer hopper outlet fitting of FIG. 8A.

Figure 9B:
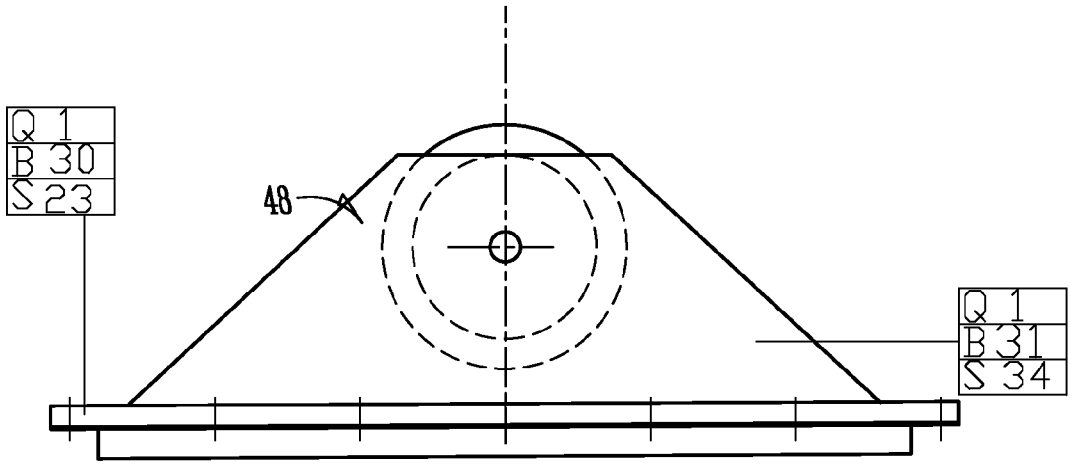

FIG. 9B is a right end elevation of FIG. 9A.

Figure 10B:
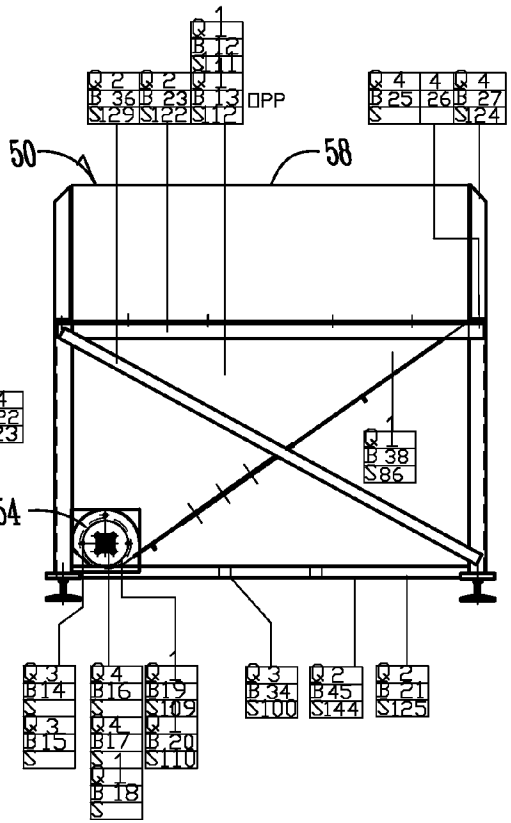
Figure 10A:
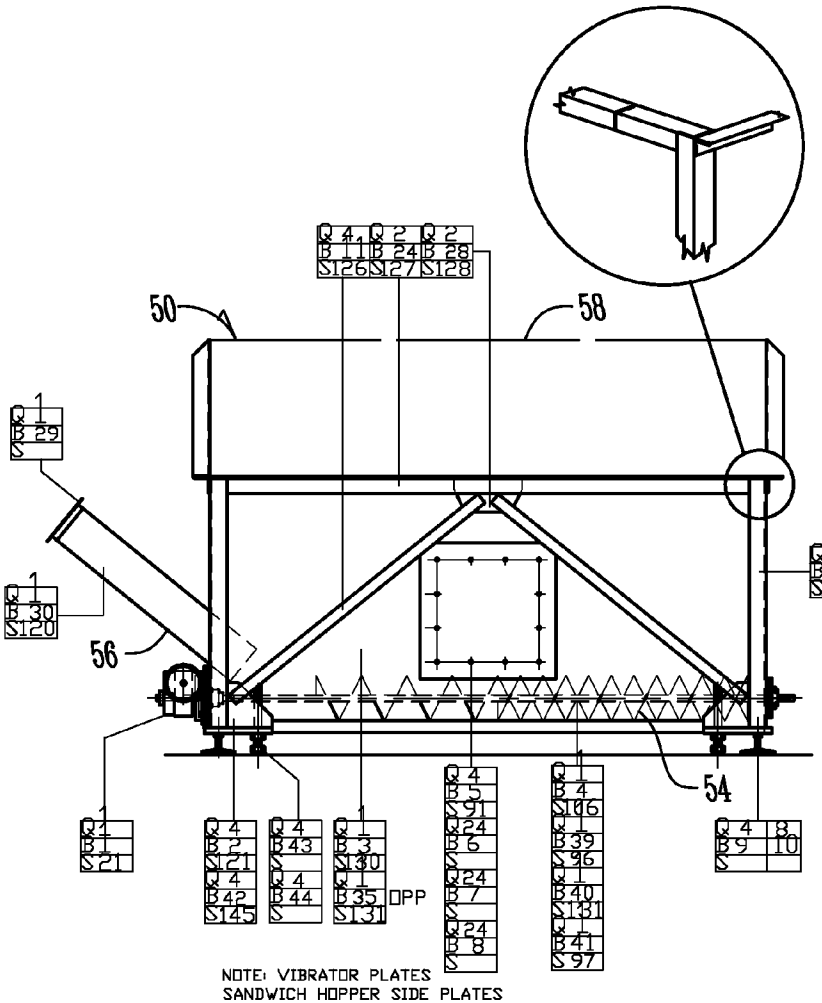

FIG. 10A is an enlarged, isolated side elevation of the ground hopper of FIG. 1A.

FIG. 10B is a right end elevation of FIG. 10A.

Figure 11A:
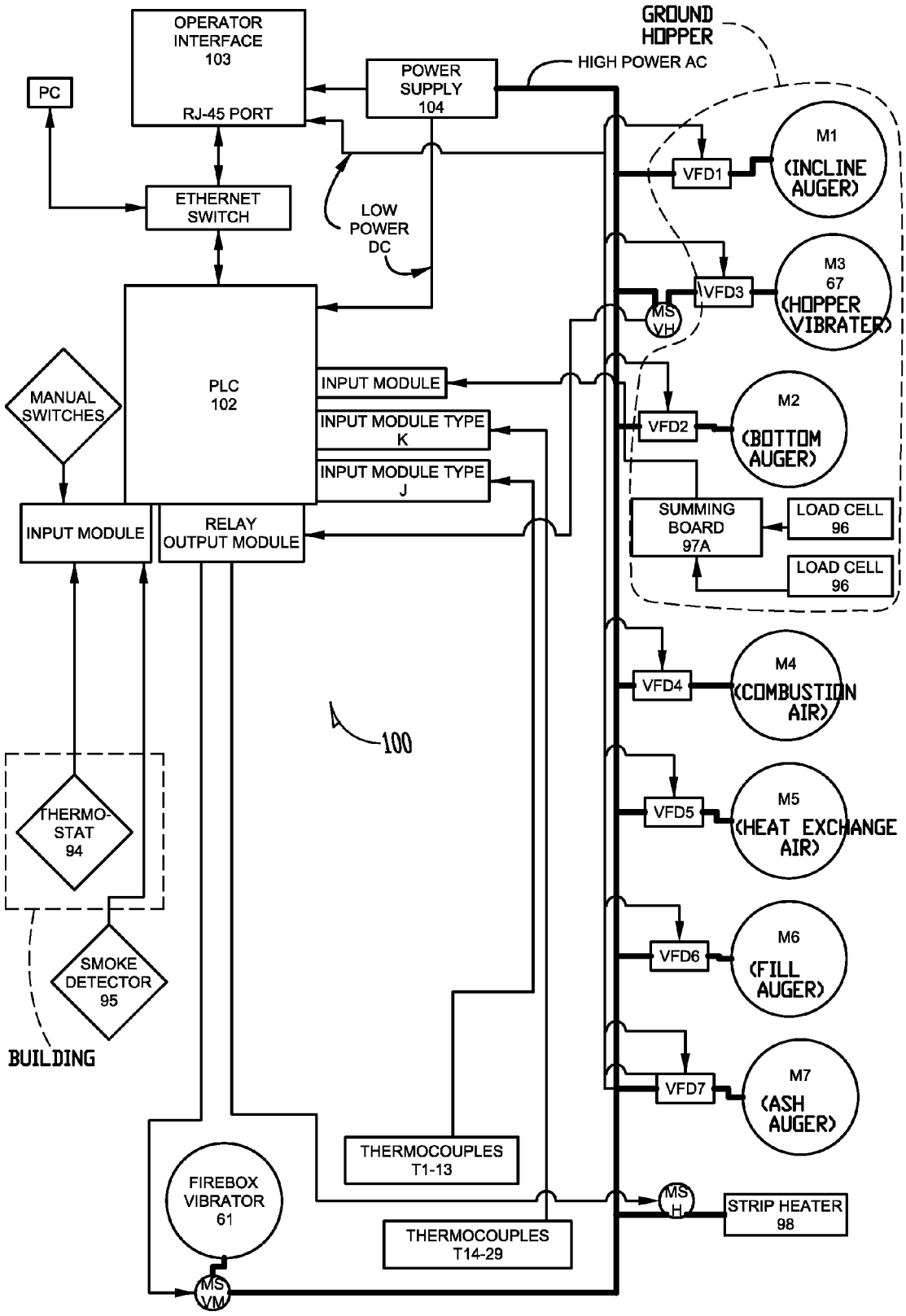

FIG. 11A is an overview block diagram of an electrical control circuit for an exemplary embodiment of the invention shown in FIG. 1A.

Figure 11B:
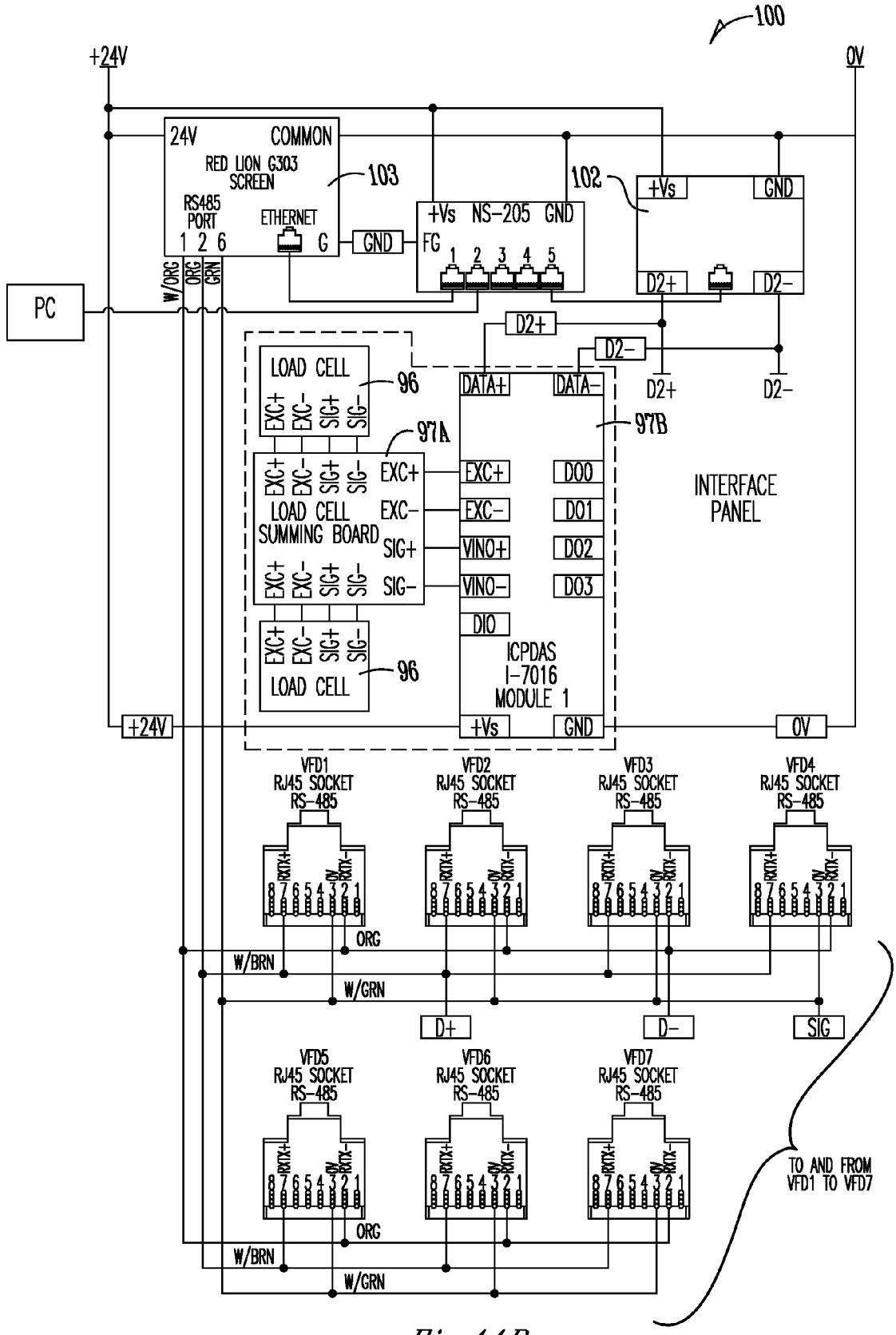

FIG. 11B is an electrical schematic of a part of the control circuit of FIG. 11A, including a programmable logic controller (PLC) and a load cell sub-circuit for measuring weight of fuel provided to the combustor.

Figure 11C:
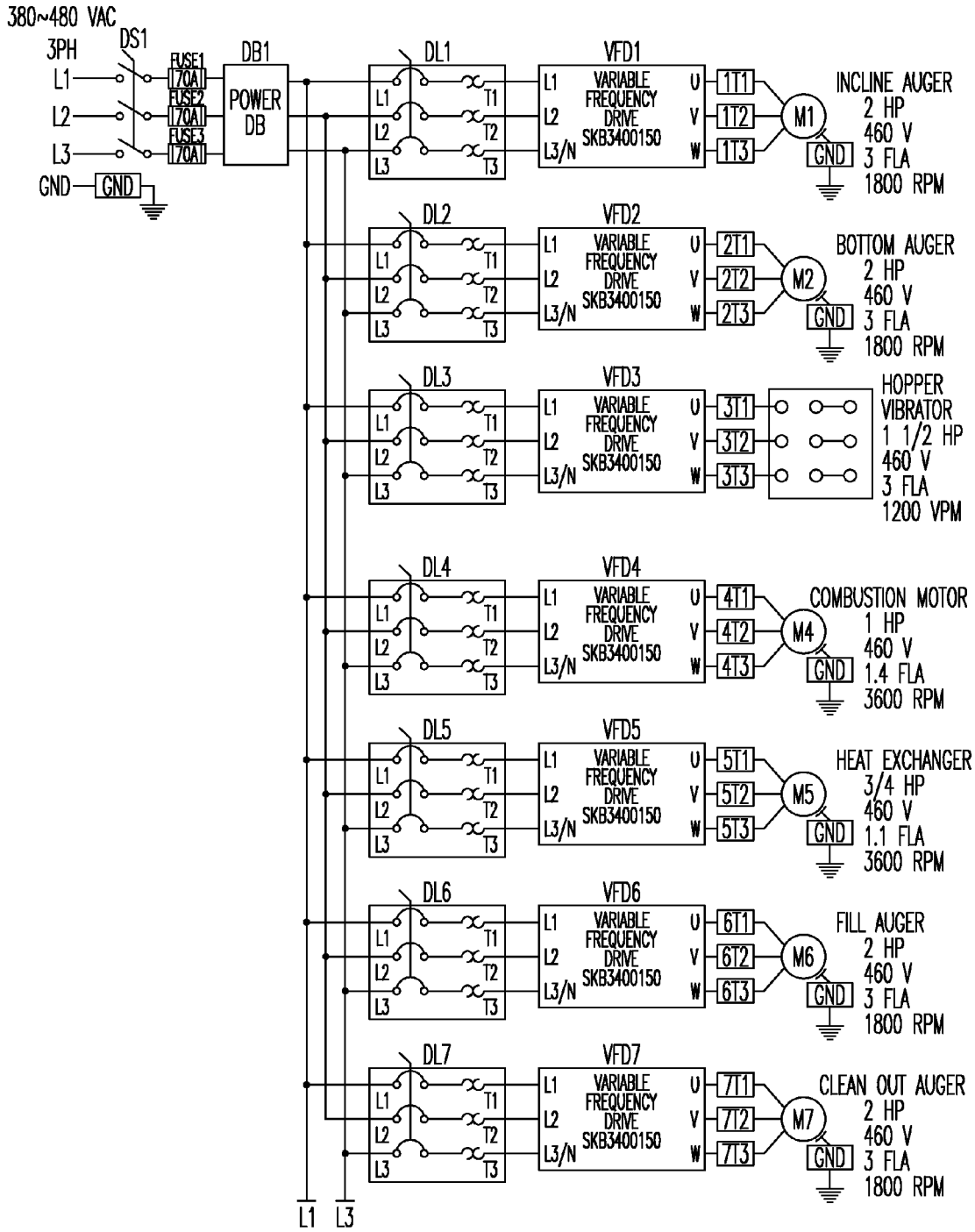

FIG. 11C is an electrical schematic of another part of the control circuit of FIG. 11A, including motors and variable frequency drive controllers for them to allow adjustable PLC control of such things as vibrators, augers, and air blowers or fans.

Figure 11D:
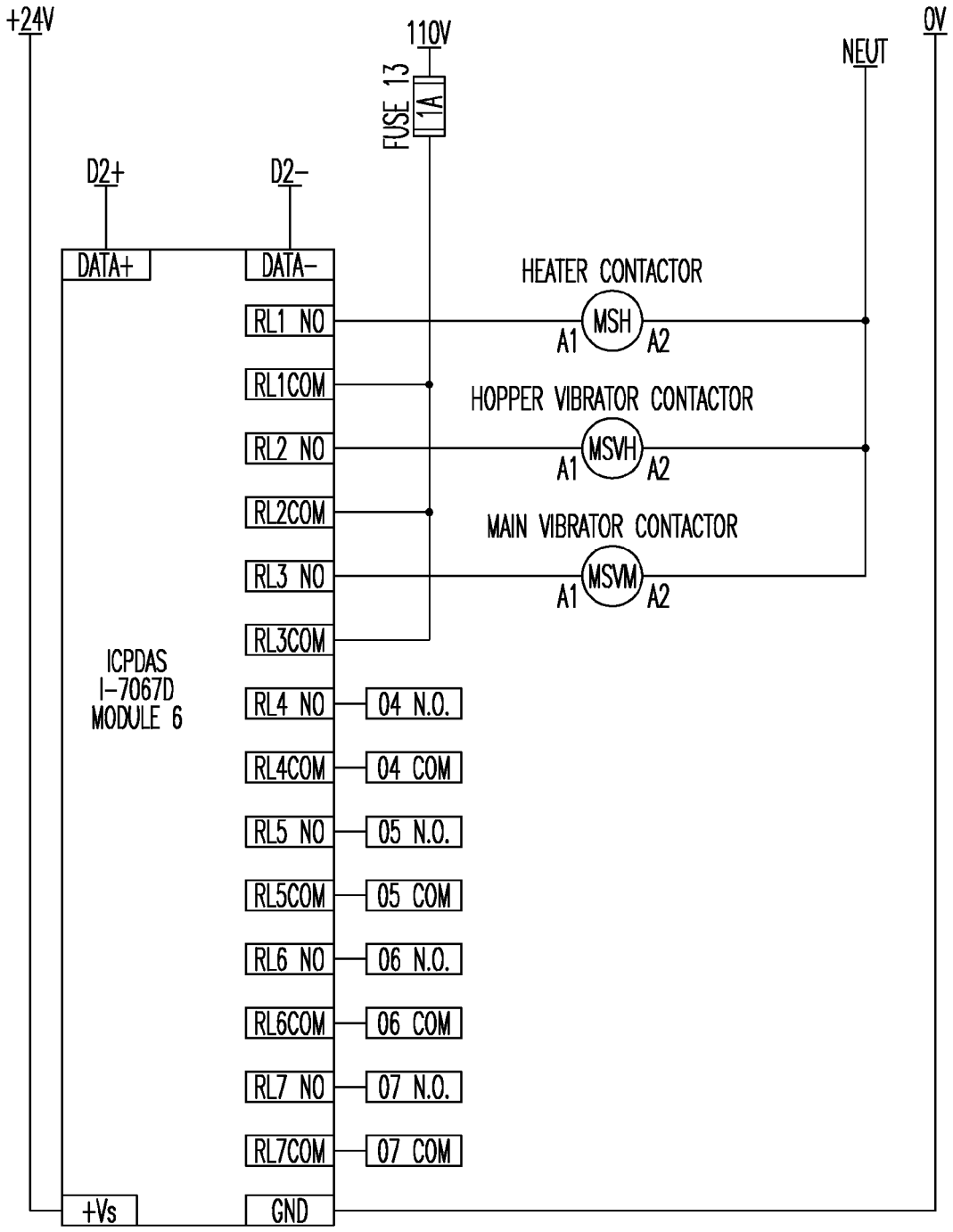

FIG. 11D is an electrical schematic of another part of the control circuit of FIG. 11A, including contactors related to providing electrical energy to an igniter to start combustion in the firebox and to vibrators to deter the fuel from plugging in a ground hopper or in the firebox.

Figure 11E:
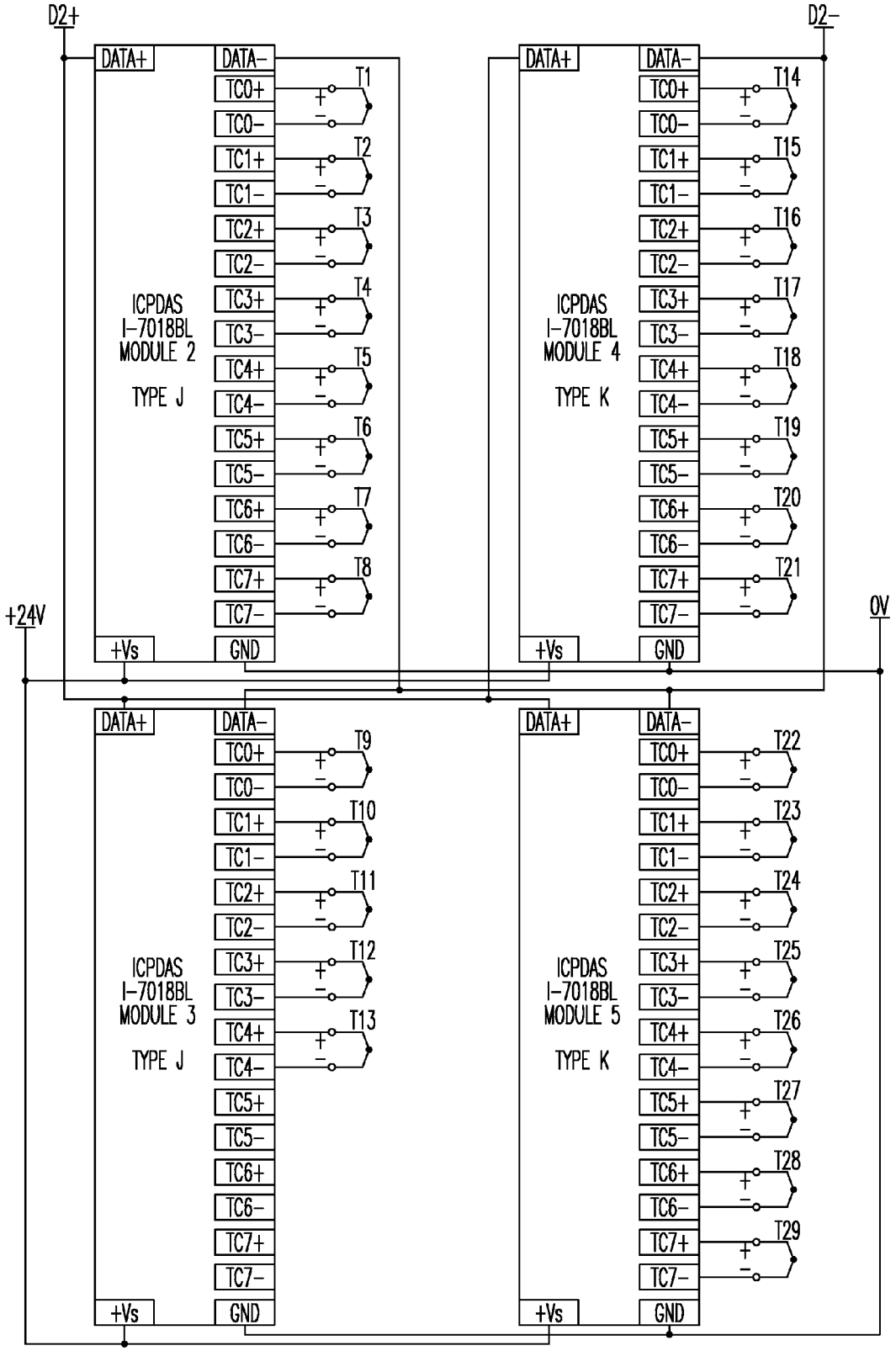

FIG. 11E is an electrical schematic of another part of the control circuit of FIG. 11A, including modules for interfacing a plurality of thermocouples with the PLC.

FIG. 11F is a table listing the function of each of the thermocouples of FIG. 11E in the control circuit of FIG. 11A relative the combustor.

Figure 11G:
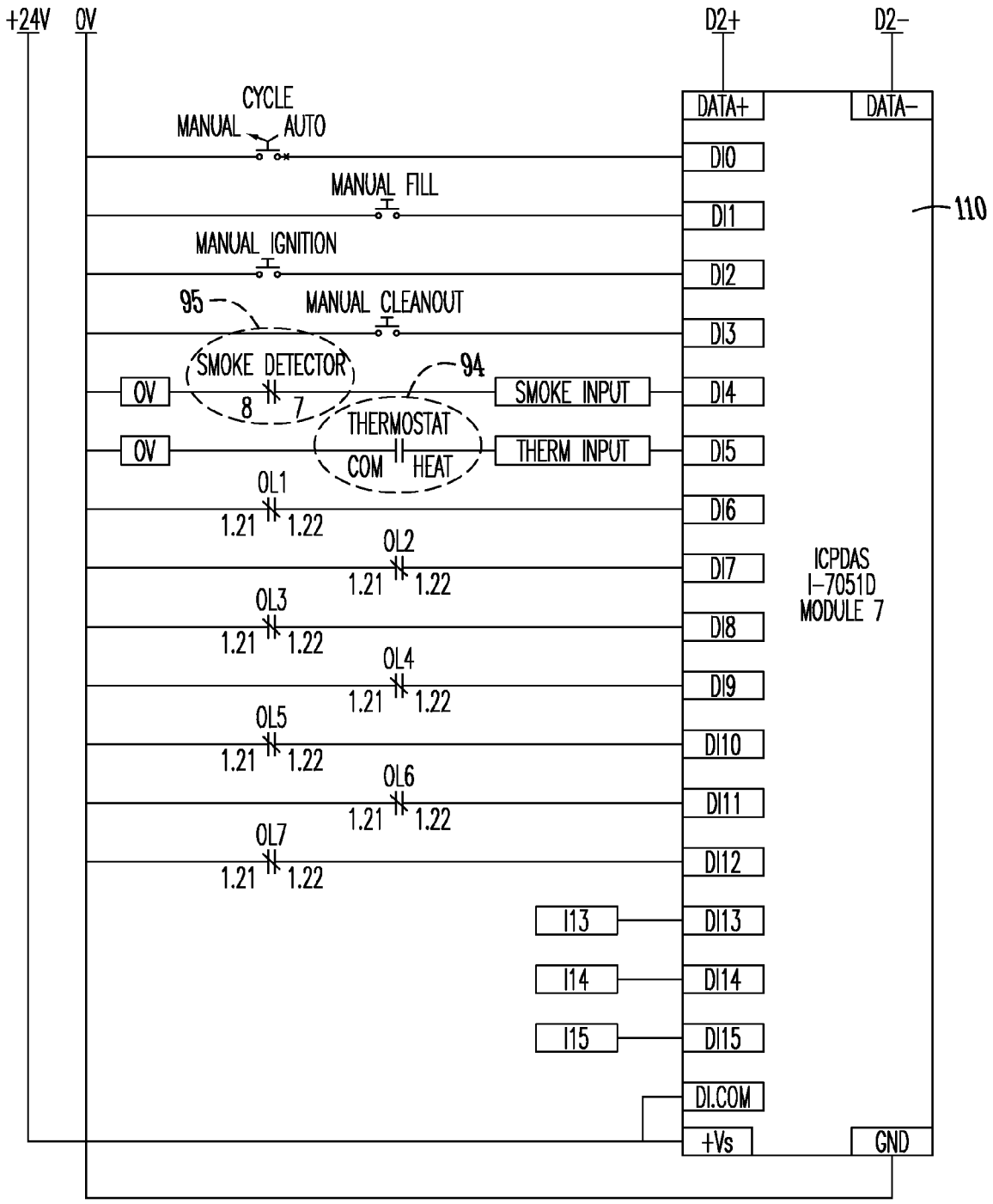

FIG. 11G is an electrical schematic of another part of the control circuit of FIG. 11A, including controls for user selection of various functions, for example, automatic or manual mode of operation of the combustor, manual override or operation of certain features or functions, and other features or functions of the control circuit, including monitors or sensors such as a thermostat and a smoke detector which can supply information to the PLC.

Figure 11H:
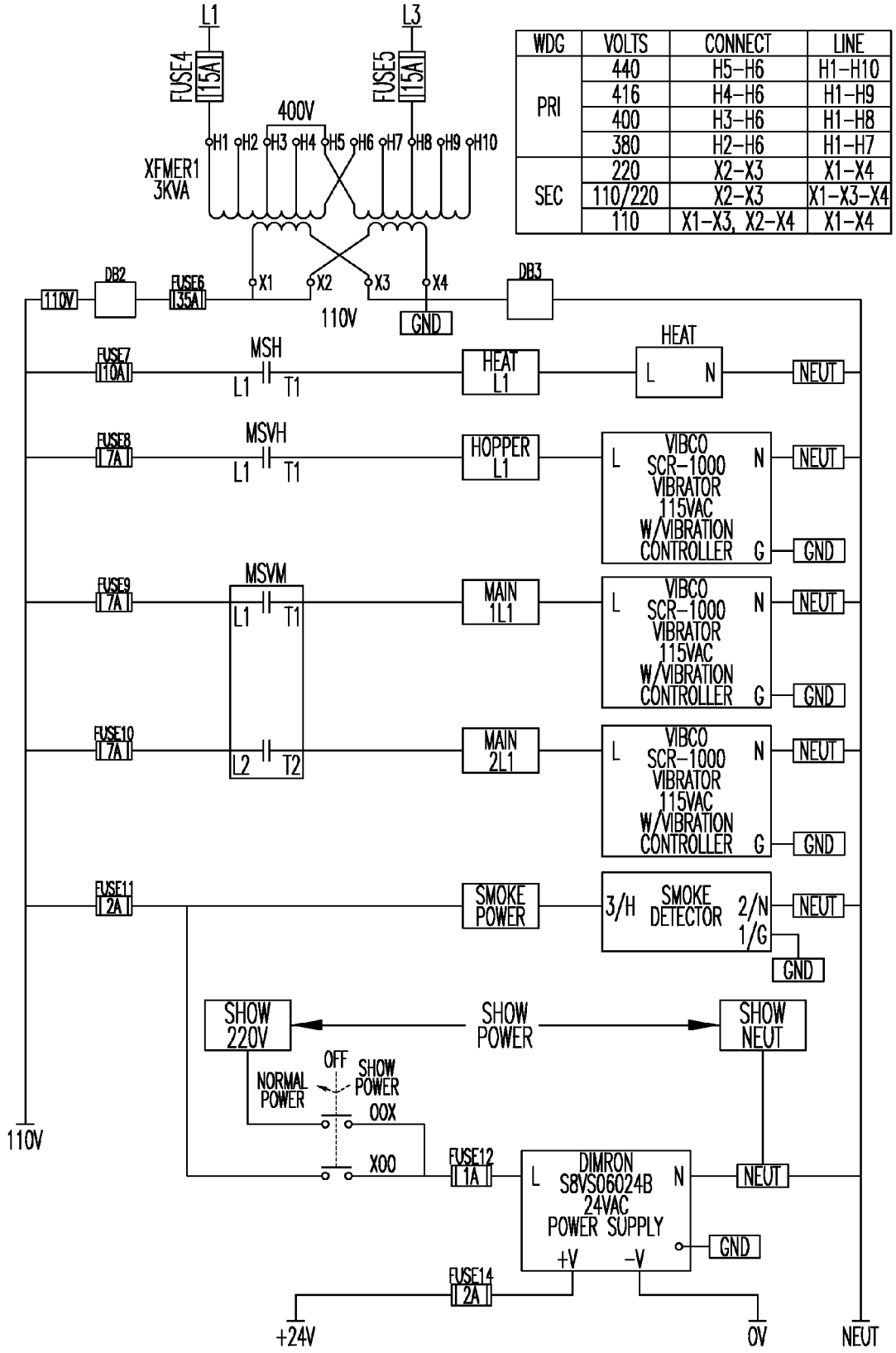

FIG. 11H is an electrical schematic of an electric power supply sub-circuit for the control circuit and other components of the exemplary embodiment of the combustor.

Figure 12B:
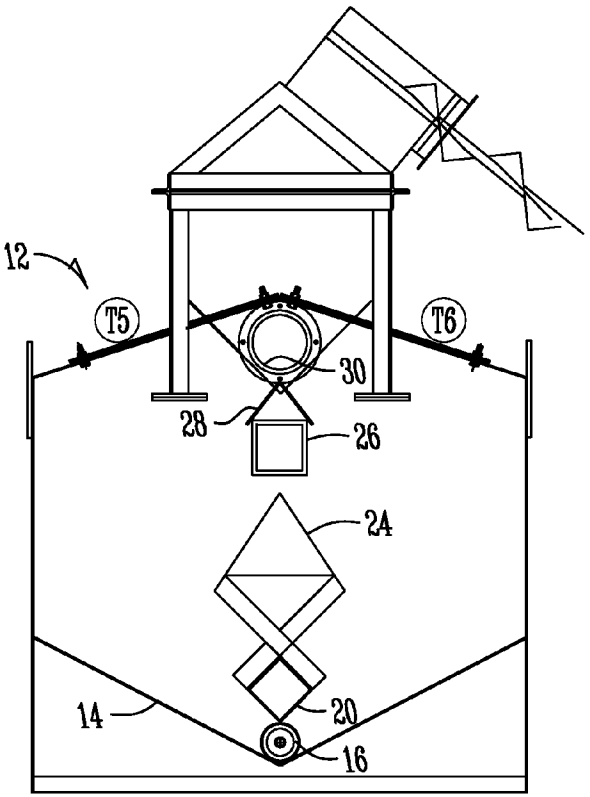
Figure 12A:
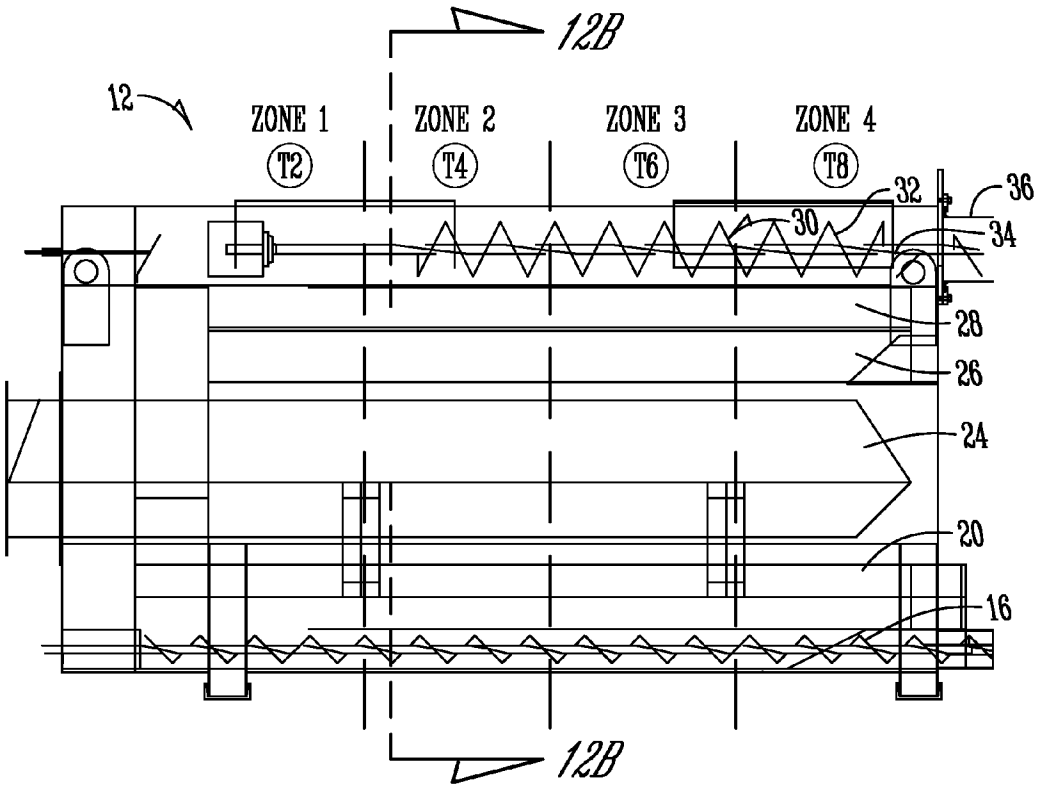

FIGS. 12A and B are side elevation and end elevation simplified diagrammatic views, respectively, of an empty firebox according to the embodiment of FIG. 1A.

Figure 13B:
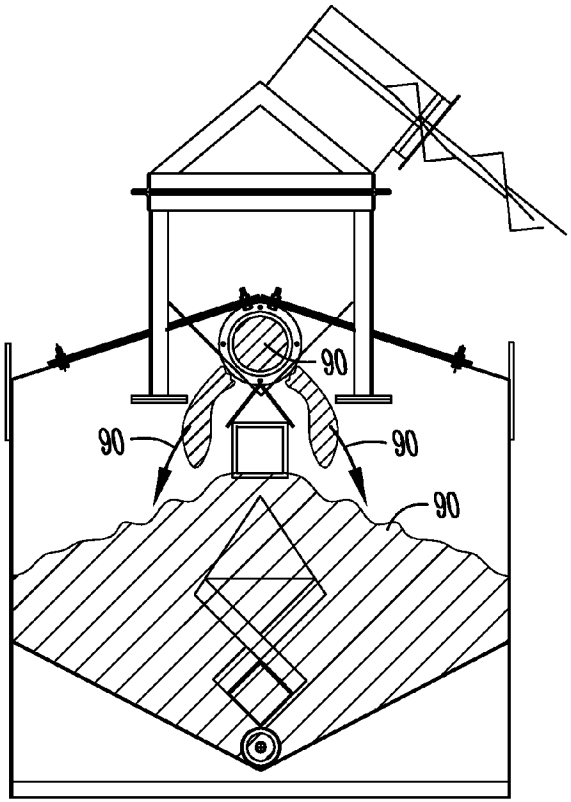
Figure 13A:
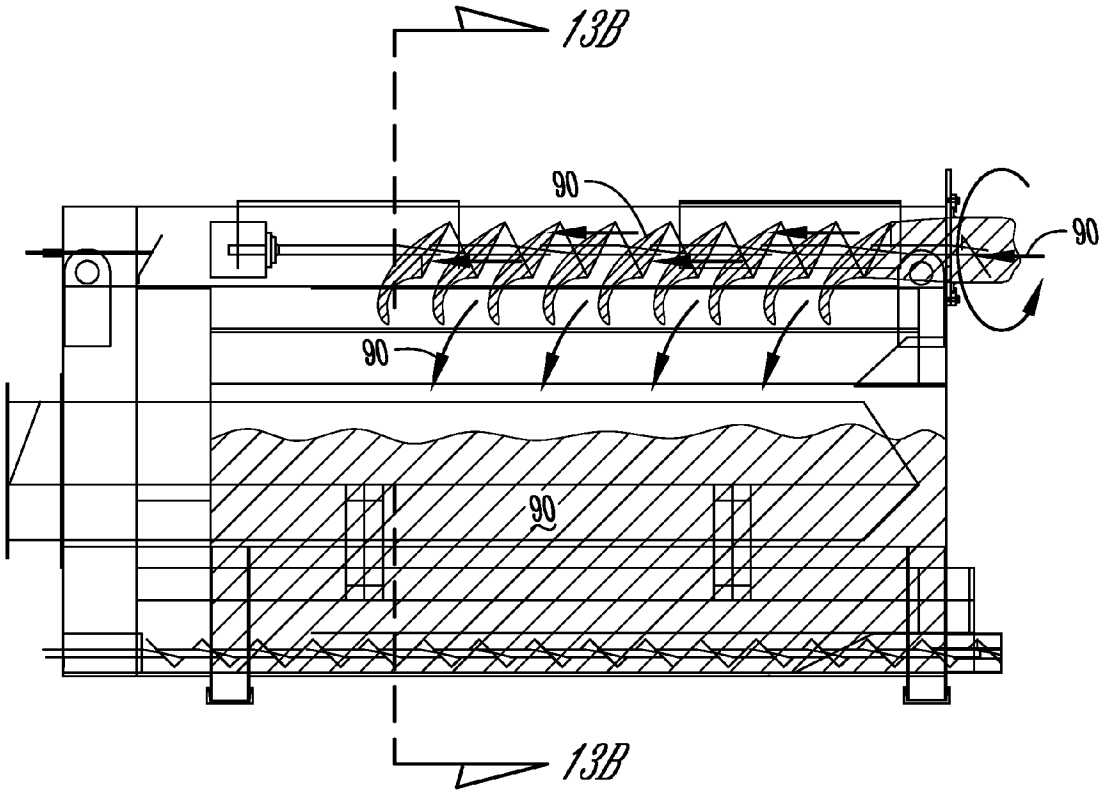

FIGS. 13A and B are side elevation and end elevation simplified diagrammatic views, respectively, of the beginning of a fill sequence for an empty firebox of FIG. 13A.

Figure 14B:
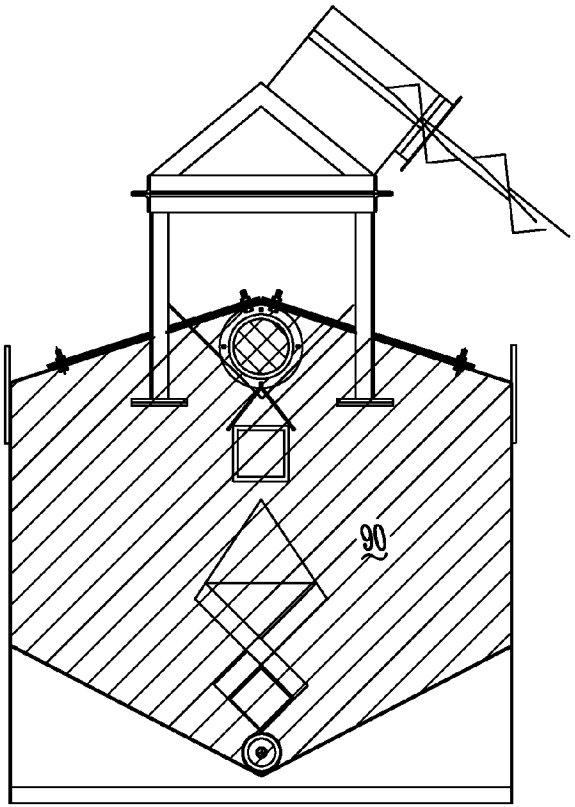
Figure 14A:
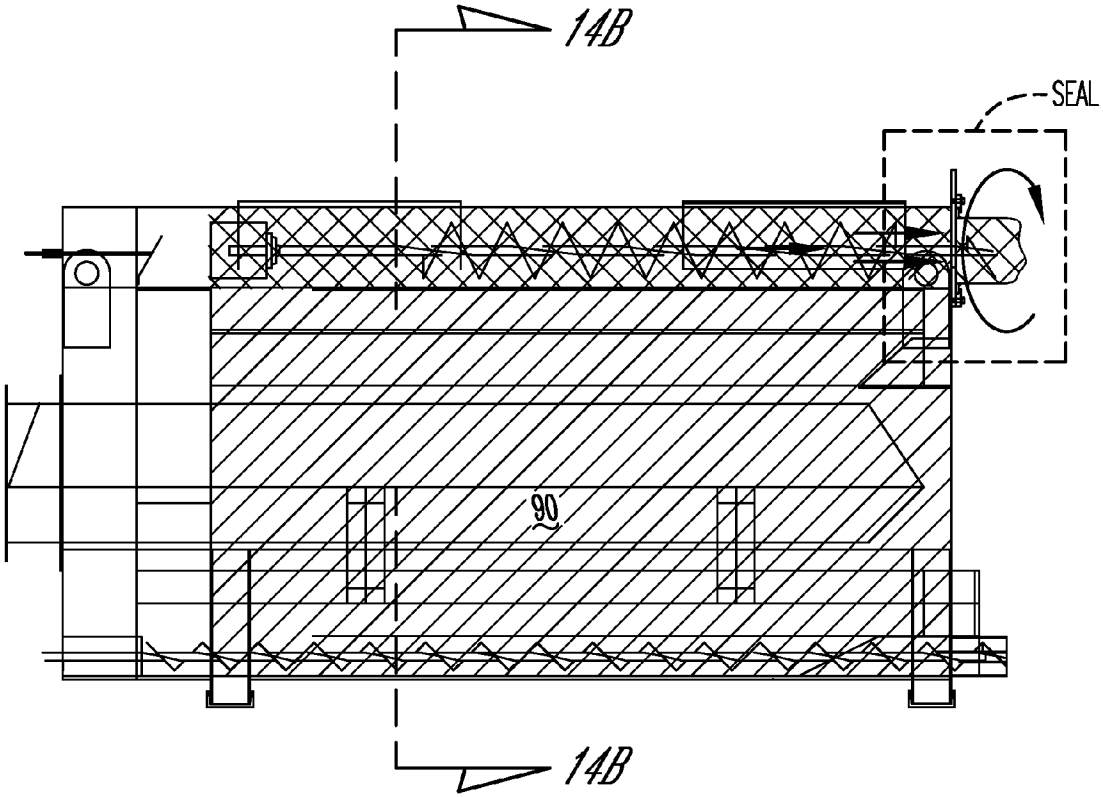

FIGS. 14A and B are side elevation and end elevation simplified diagrammatic views, respectively, of a reversing procedure of the fill auger to seal the inlet tube to the firebox from the feeder transfer hopper after completion of initial fill of the firebox.

Figure 15B:
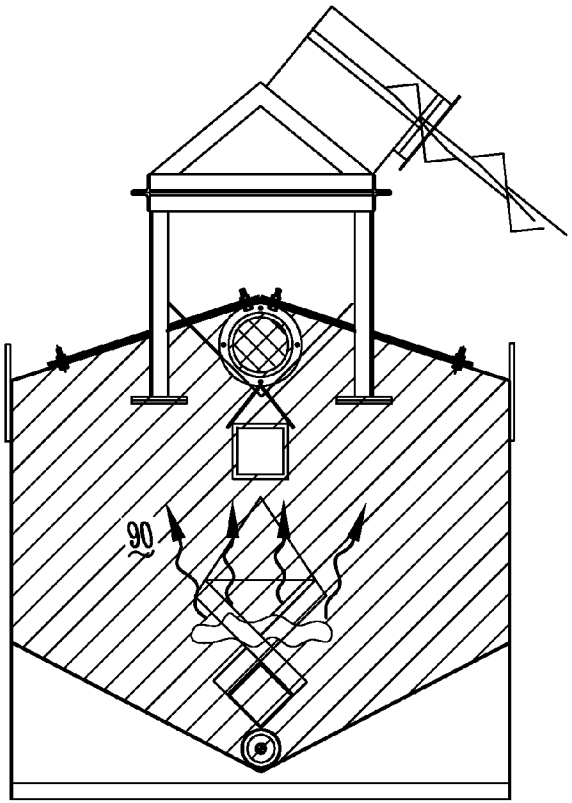
Figure 15A:
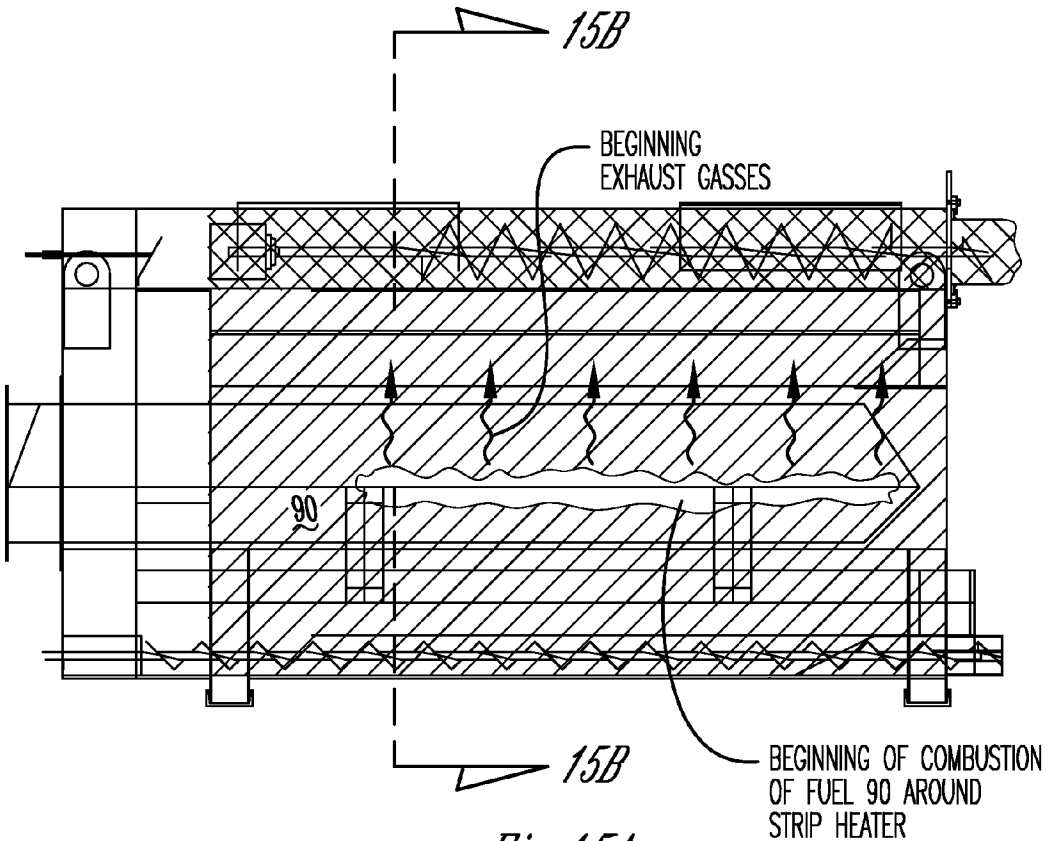

FIGS. 15A and B are side elevation and end elevation simplified diagrammatic views, respectively, of an ignition step of the initially filled and sealed firebox of FIG. 14A.

Figure 16B:
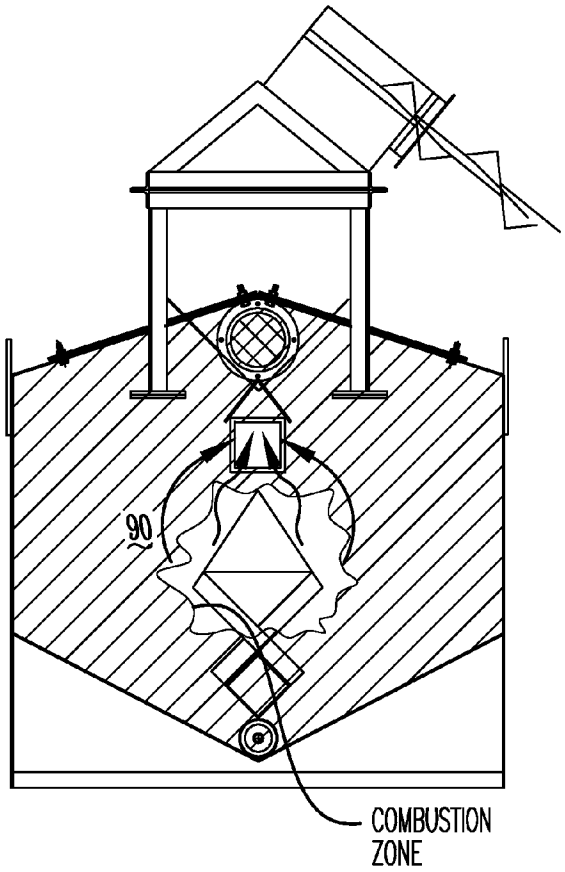
Figure 16A:
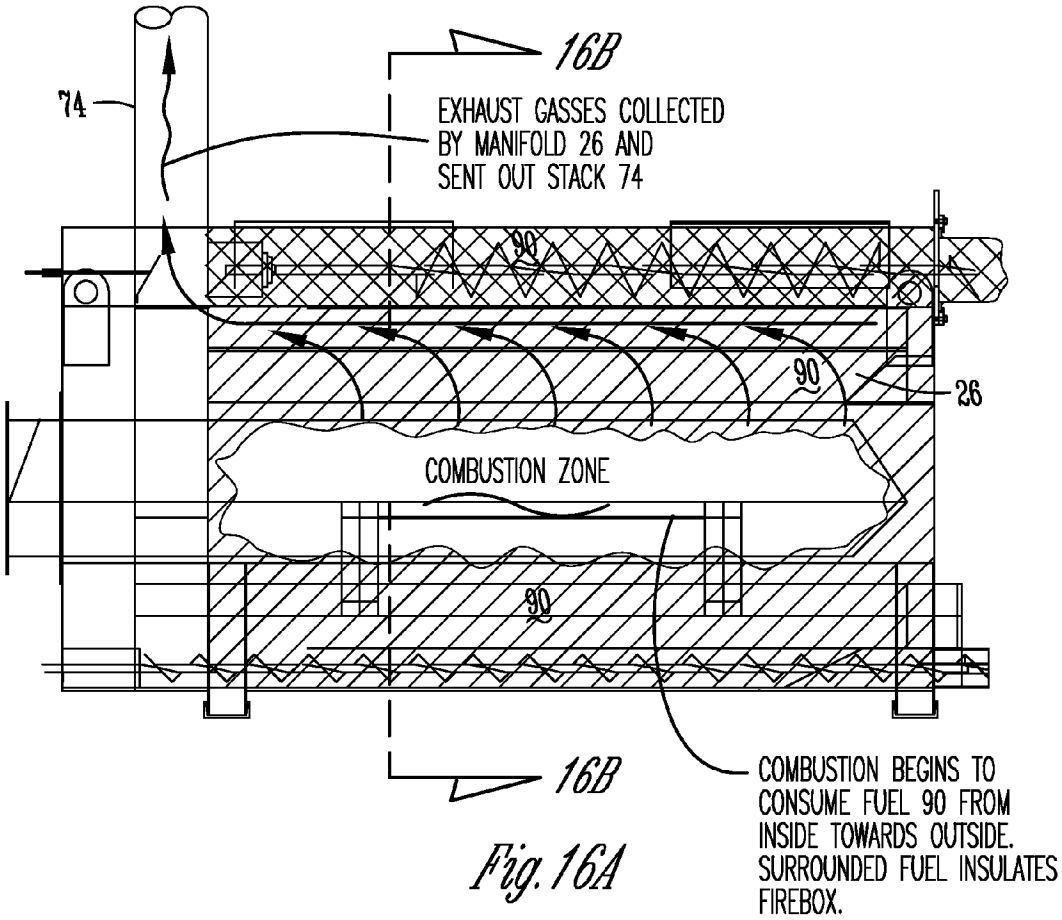

FIGS. 16A and B are side elevation and end elevation simplified diagrammatic views, respectively, of an initial stage of combustion after ignition.

Figure 17B:
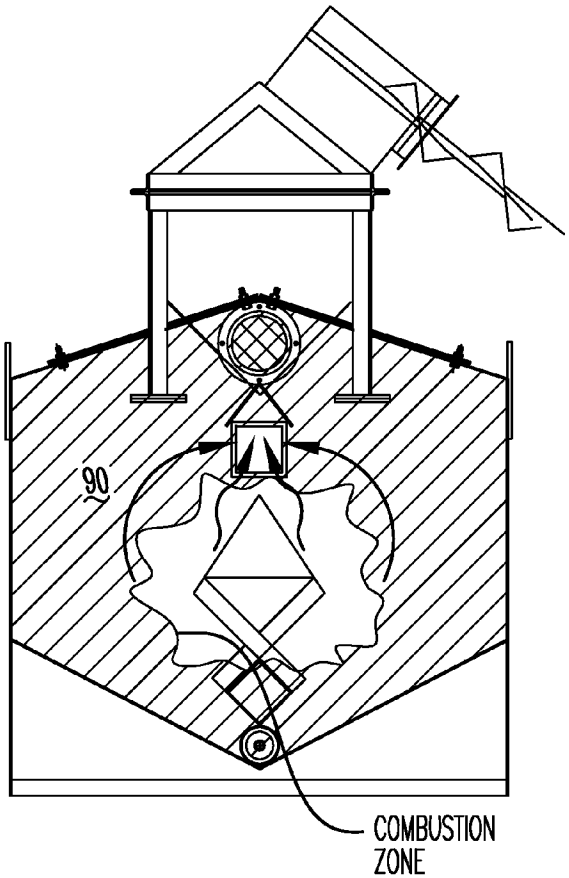
Figure 17A:
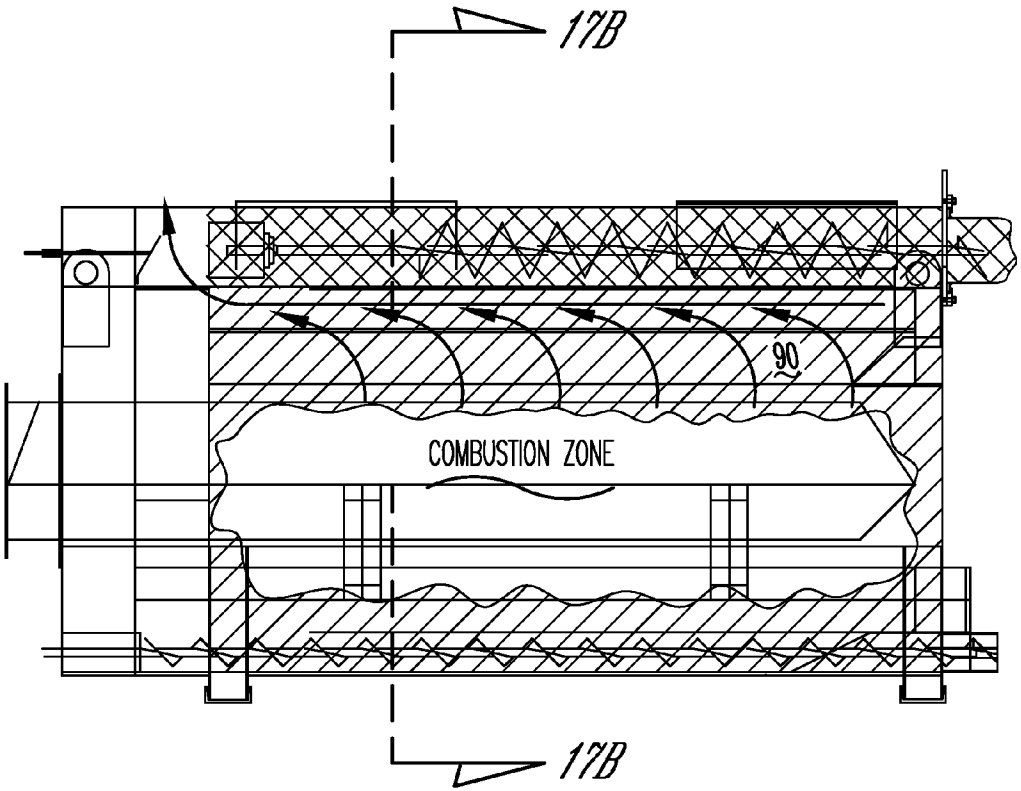

FIGS. 17A and B are side elevation and end elevation simplified diagrammatic views, respectively, of a subsequent stage of combustion.

Figure 18B:
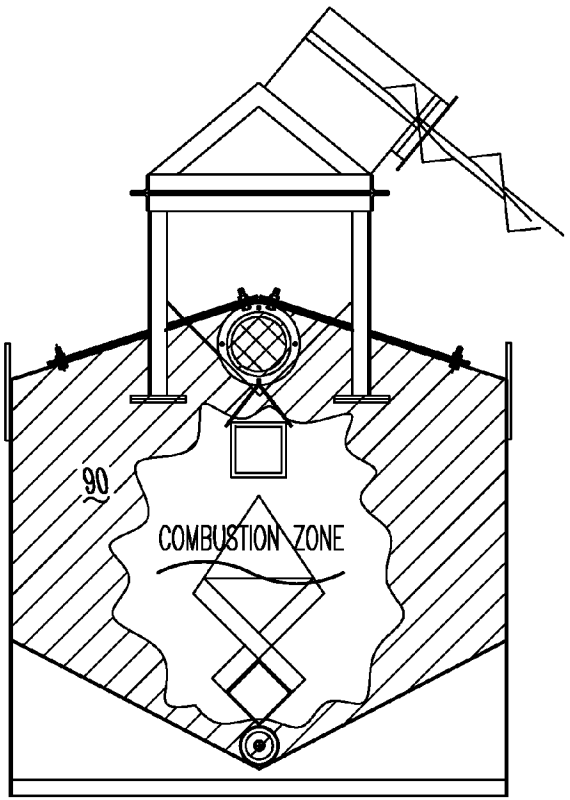
Figure 18A:
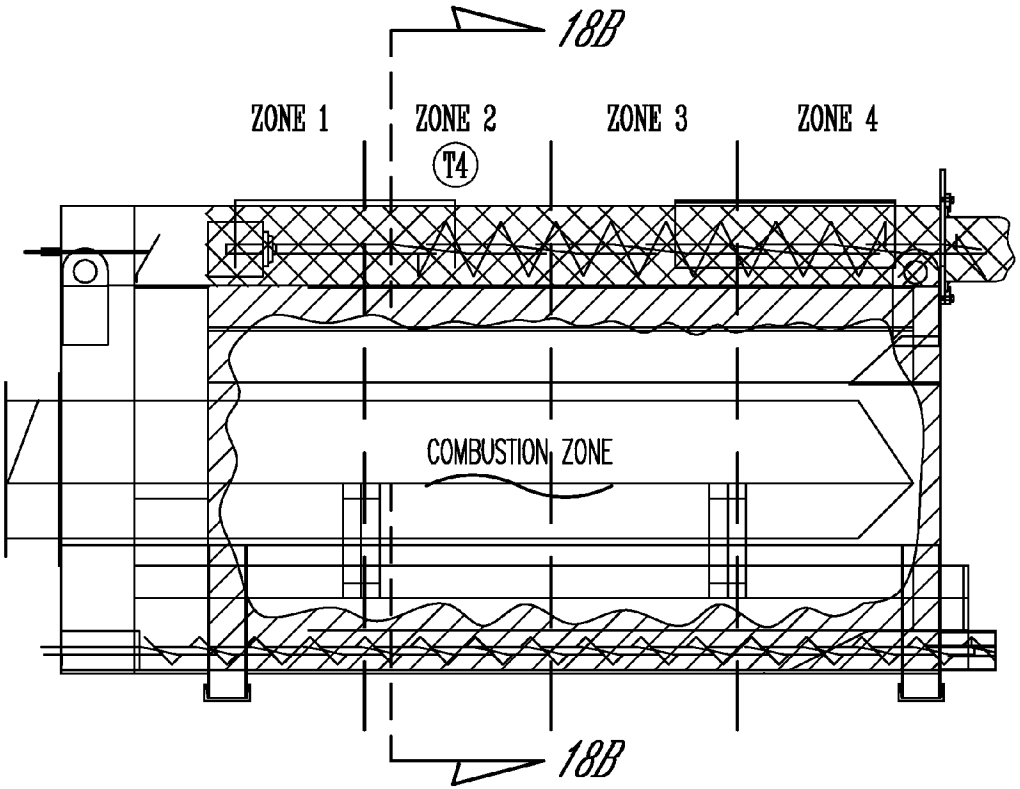

FIGS. 18A and B are side elevation and end elevation simplified diagrammatic views, respectively, of a still further subsequent stage of combustion.

Figure 19B:
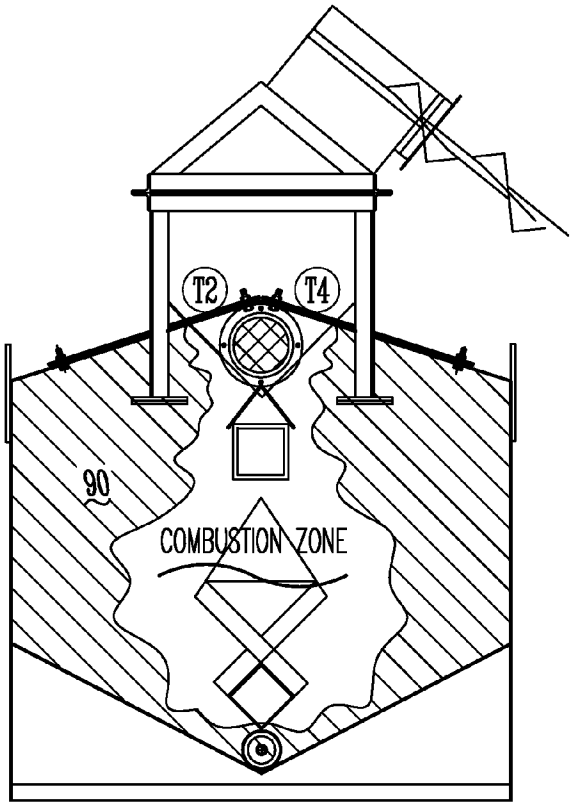
Figure 19A:
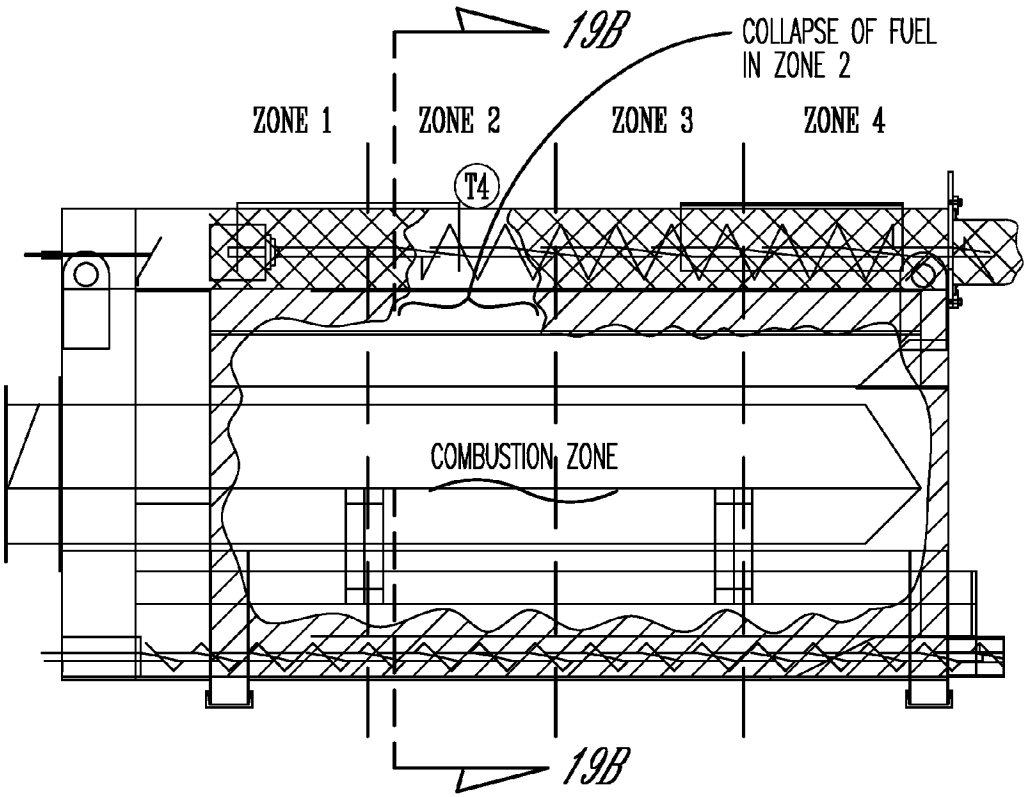

FIGS. 19A and B are side elevation and end elevation simplified diagrammatic views, respectively, of a stage of combustion where there is a collapse of the fuel in one location of the firebox.

Figure 20B:
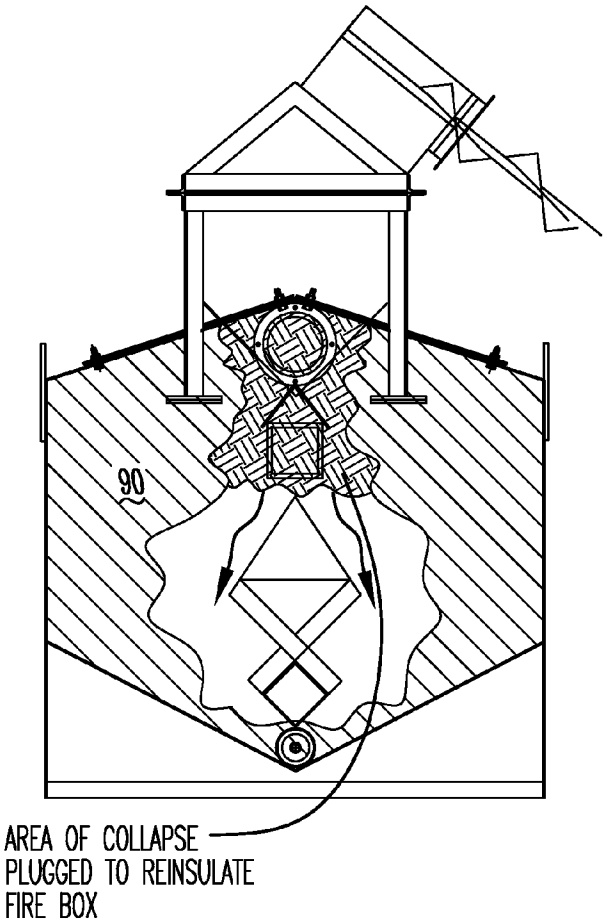
Figure 20A:
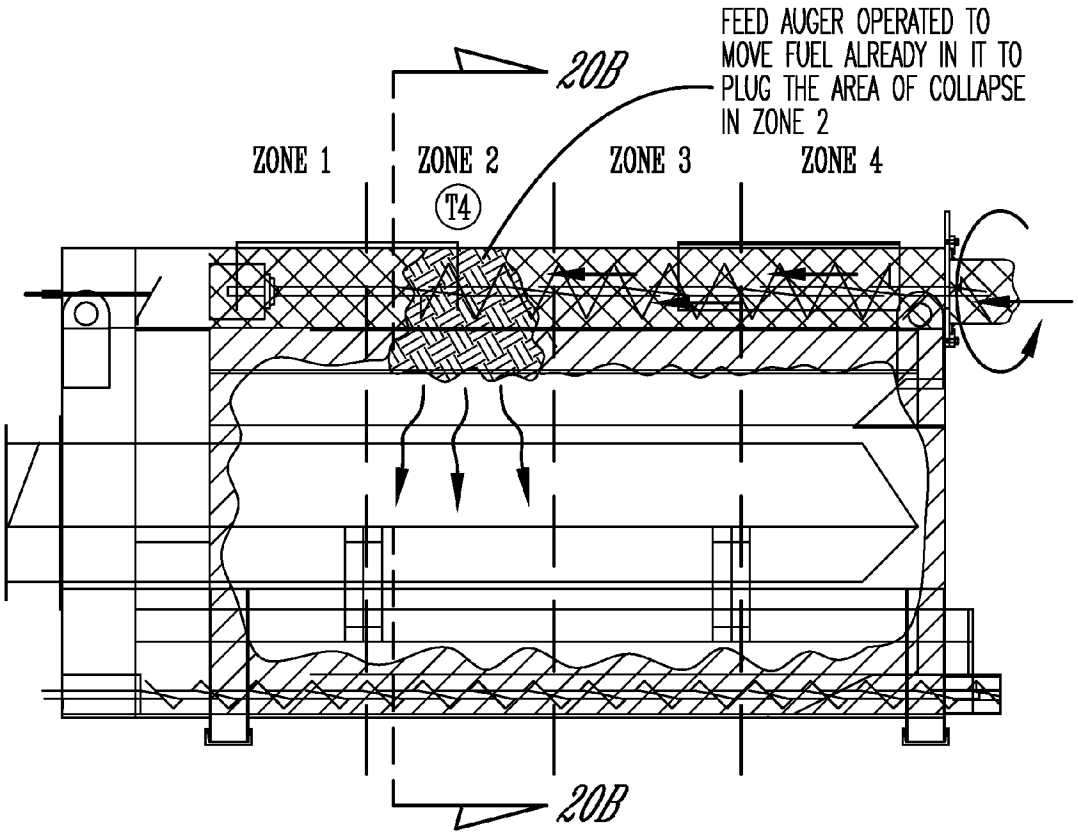

FIGS. 20A and B are side elevation and end elevation simplified diagrammatic views, respectively, of an automatically initiated fill sequence after the event of FIG. 19A.

Figure 21B:
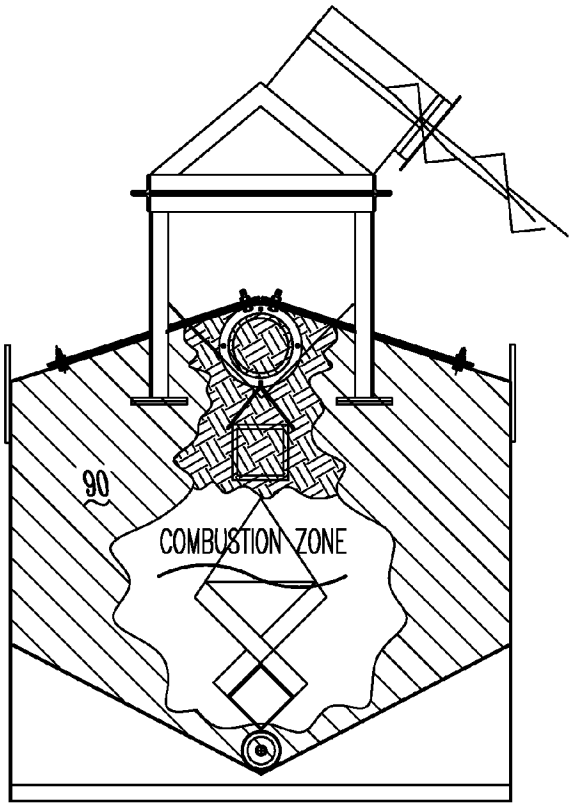
Figure 21A:
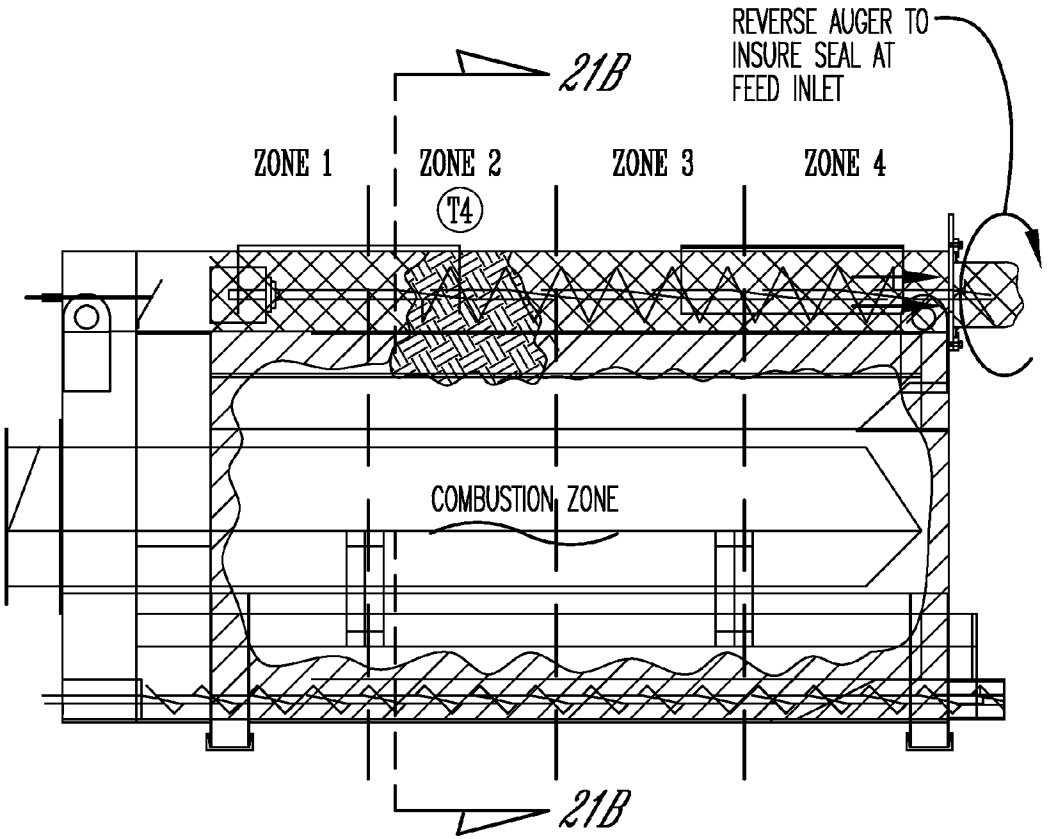

FIGS. 21A and B are side elevation and end elevation simplified diagrammatic views, respectively, of a subsequent state of the fill sequence.

Figure 22A:
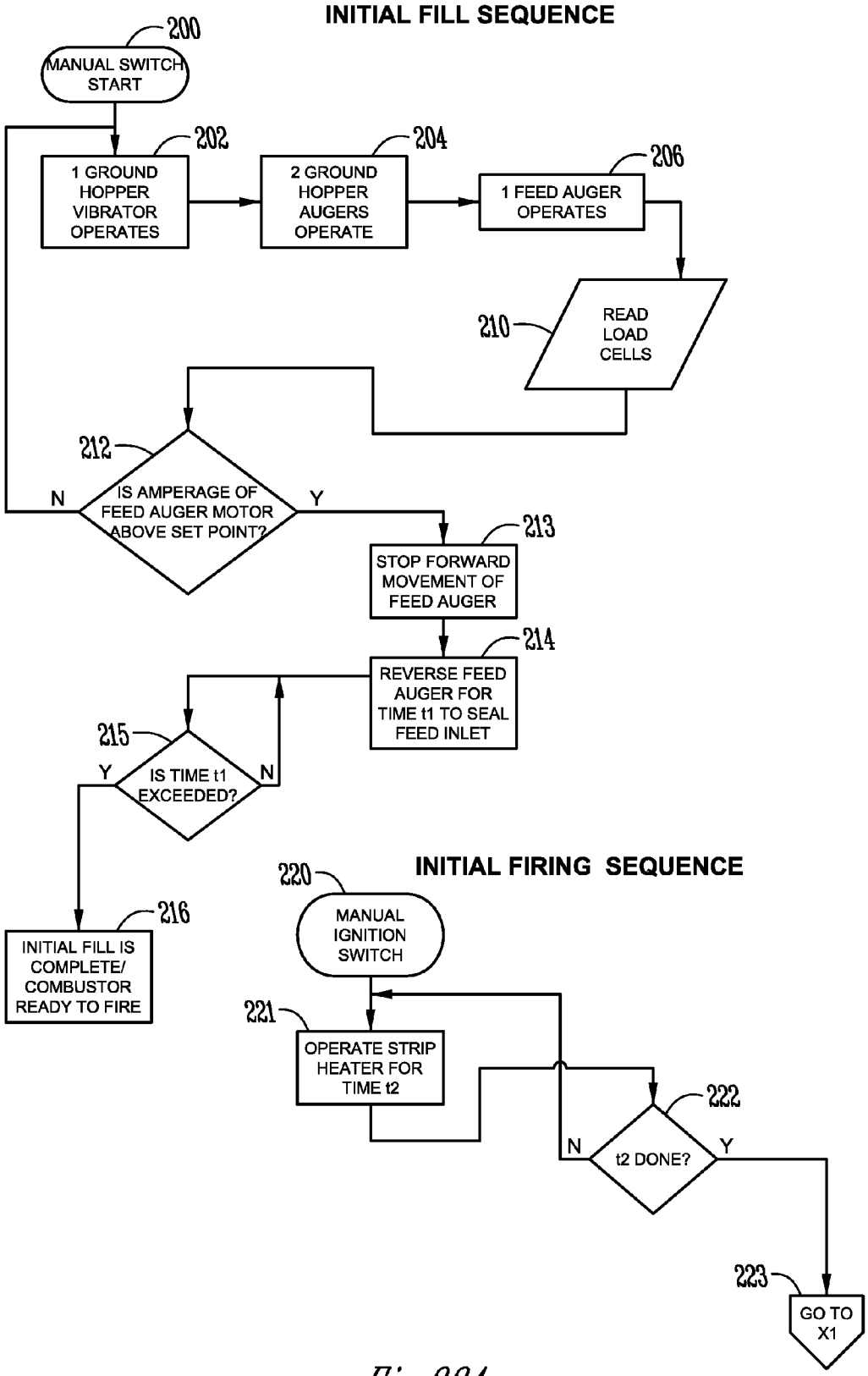
Figure 22B:
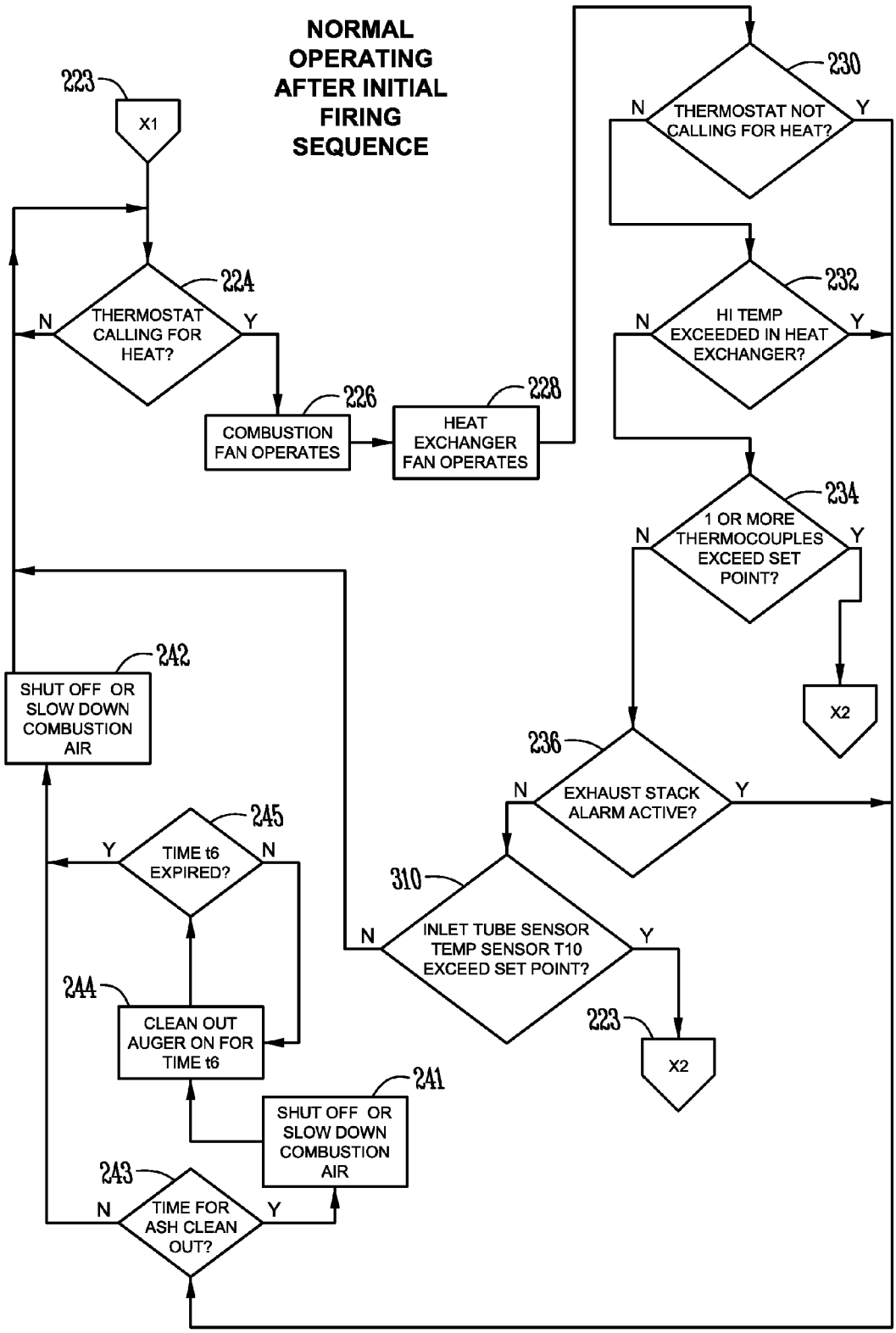
Figure 22C:
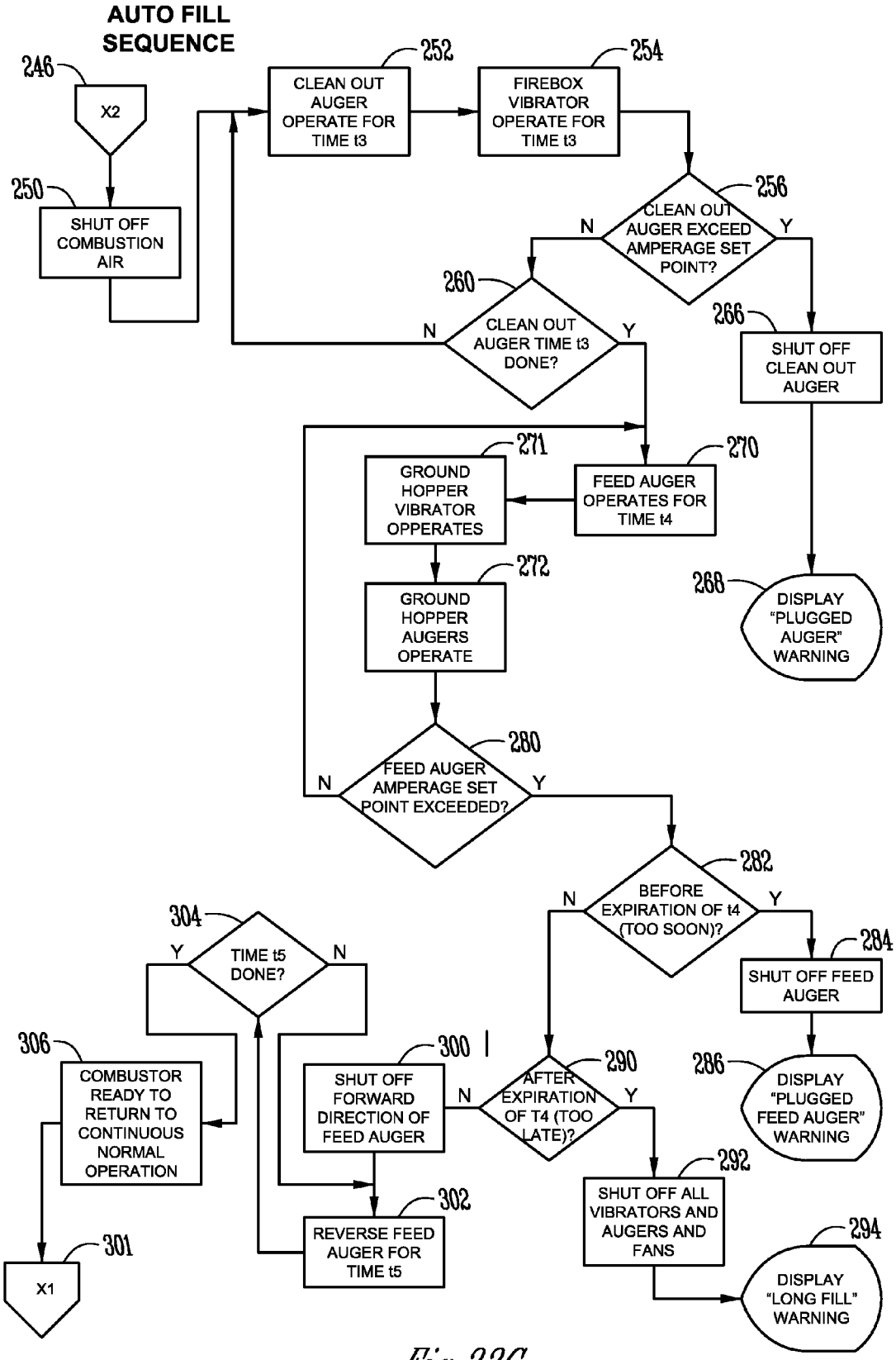

FIGS. 22A-C are a flow chart of certain operations according to an exemplary embodiment of the invention, including for the automatic fill sequence.

Figure 23:
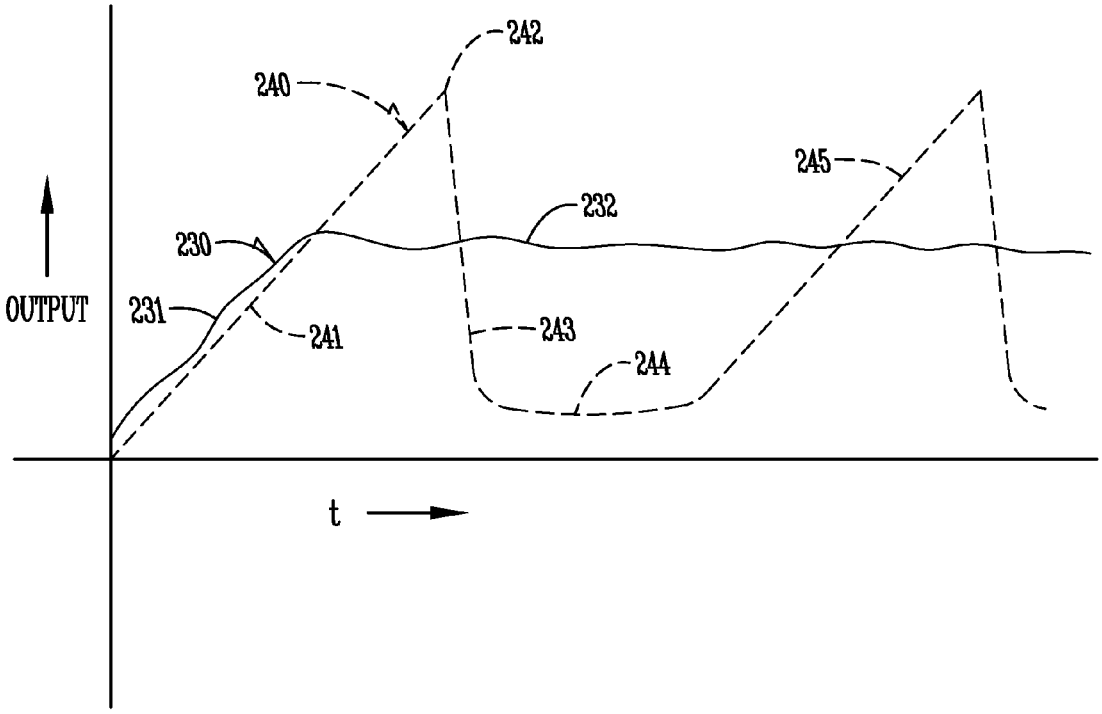

FIG. 23 is a diagram comparing output of the exemplary embodiment of the present invention to a prior art combustor.

IV. DETAILED DESCRIPTION OF EXEMPLARY EMBODIMENT

A. Overview

For a better understanding of the invention and its aspects, one particular example of how the invention can be built and operated will now be described in detail. Frequent reference will be taken to the appended drawings. Reference numerals or letters will be used to indicate certain parts or locations in the drawings. The same reference numerals or letters will be used to indicate the same parts and locations throughout the drawings, unless otherwise indicated.

B. Context of the Exemplary Embodiment

1. Based on U.S. Pat. Nos. 5,839,375 and 6,244,196

This embodiment will be in the context of a reactor combustor like that of incorporated-by-reference U.S. Pat. Nos. 5,839,375 and 6,244,196. Proportions will be similar or the same. For example, a firebox of metal will enclose a volume of space into which biomass fuel is loaded. An air lance or combustion air tube with exit openings is positioned in the firebox towards the bottom but within the fuel, once loaded in the firebox. An exhaust tube with inlet openings is positioned near the top of interior of the firebox. In this embodiment, an air heat exchanger is positioned between the air tube or header and the exhaust tube or header. The heat exchanger is designed to be positioned so it would tend to be in the center of the combustion fireball within the fuel in the firebox.

2. Fuel

By the term "fuel" it is meant material, either substantially the same or a mixture of materials, but is predominantly combustible and has the characteristic that it tends to naturally bridge. That is, it does not naturally flow under gravity, but rather tends to hold its shape, even if there are gaps, spaces, or voids in the material, either when filled into the firebox or caused by consumption of the material through combustion.

As can be appreciated from U.S. Pat. Nos. 5,839,375 and 6,244,196 and the discussion herein, the bridging action causes the fuel mixture to, in effect, be an insulation layer or refractory around the inside of the wall of the combustor. It resists collapse of this layer, even when combustion consumes a substantial amount of the center of the fuel. It replaces a refractory. The bridging of the fuel creates an insulating/refractory layer around the inside of the firebox that allows collection of energy from within the burn rather than exhaust it and take the energy out of the exhaust. Combustion, heat exchange, and exhaust all come from within the fuel. It has been found, however, that many times the weaker the bridging characteristic of the fuel, the better. It is believed that just enough bridging to resist collapse by gravity or other forces of normal operation of the combustor is better than strong bridging. Principally this is because it is believed it would normally make the fuel less dense and thus easier to move and combust.

Examples of some types of naturally bridging materials are given in U.S. Pat. Nos. 5,839,375 and 6,244,196, but the invention is not limited to those examples.

However, one primary example is biomass, either alone, or in combination with other materials such as manure. Examples of such biomass is wood, fodder, grass, tree parts, and beddings. Many others exist. In this exemplary embodiment, the biomass material, and anything mixed with it, is ground or in particulate form.

For example, one definition of "biomass" is found at en.wikipedia.org: "In energy production and industry, biomass refers to living and recently living biological material which can be used as fuel or for industrial production. Most commonly biomass refers to plant matter grown for use as biofuel, but also includes plant or animal matter used for production of fibres, chemicals or heat. It excludes organic material which has been transformed by geological processes into substances such as coal or petroleum. It is usually measured by dry weight. The term biomass is especially useful for plants, where some internal structures may not always be considered living tissue, such as the wood (secondary xylem) of a tree. Biofuels include bioethanol, biobutanol and biodiesel; these two last ones are direct biofuels (so they can be used directly in petroleum engines). Biomass is grown from several plants, including switchgrass, hemp, corn, and sugarcane. The particular plant used is usually not important to the end product. Production of biomass is a growing industry as interest in sustainable fuel sources is growing. Biomass may also include animal waste, which may be burnt as fuel. Other uses of biomass, besides fuel: building materials, biodegradable plastics and paper (using cellulose fibers)."

Such fuel is typically organic, in whole or in part. For example, fuel could be entirely biomass. Another example would be that it could be one type of biomass in combination with another type of biomass. There could even be some non-biomass combustibles or there could be some non-combustibles.

One form the fuel could take is to be, on average, in relatively small pieces. It can be naturally For example, pieces approximately two inches in diameter or less have been used. It has been found that pieces of such size tend to be able to be moved with vibration (or other mechanical help), but also insulate and bridge. They can be that size, on average, naturally or can be grind or processed to that size. Such sizes are not required, however.

It has been found advantageous if moisture content of the fuel is less than 65%. This is compared with many prior art biomass combustors which operate only if moisture is less than 20%. However, the mixture must bridge.

Thus, the fuel could be a single substance or a mixture of substances. In a mixture, at least one of the substances (or the mixture) naturally bridges.

C. Apparatus

FIG. 1A and subparts through 10A and subpart illustrate the basic structure of an apparatus according to an exemplary embodiment of the present invention.

1. Firebox

The overall apparatus will be referred to as system 10. A metal firebox 12 of the dimensions shown in FIGS. 1A-C has a V-shaped bottom 14. The wall of firebox is steel and approximately 3/16th inch thick. It is elongated along its horizontal axis. It has essentially a hexagonal vertical cross section. It defines an enclosure or container to hold fuel and to combust it by its opposite end walls 13 and 15 and its tubular sidewall 11. It is supported on four legs or feet 62, which are robust enough to support system 10 and any fuel in it on, for example, a cement slab or other foundation or support. A vertical wall 21 spaced inwardly of end wall 13 separates the combustion zone from the combustion and exhaust plenums.

2. Clean-out Auger

As shown in broken-lines, a cleanout auger 16 (100 inches long, 3 inch outside diameter flighting, 3 inch spacing of flights, 45 degrees pitch) is supported along the V-bottom 14 of tubular sidewall 11 to remove ash and remnant materials out of firebox 12. Auger 16 is made from carbon steel. It is supported at opposite end walls 13 and 15 of firebox 12 by suitable bearings or bushings, and rotated by an appropriate motor M7, which is controlled by a variable frequency drive (VFD), such as are commercially available and well known to those of skill in the art.

Figure 1B:
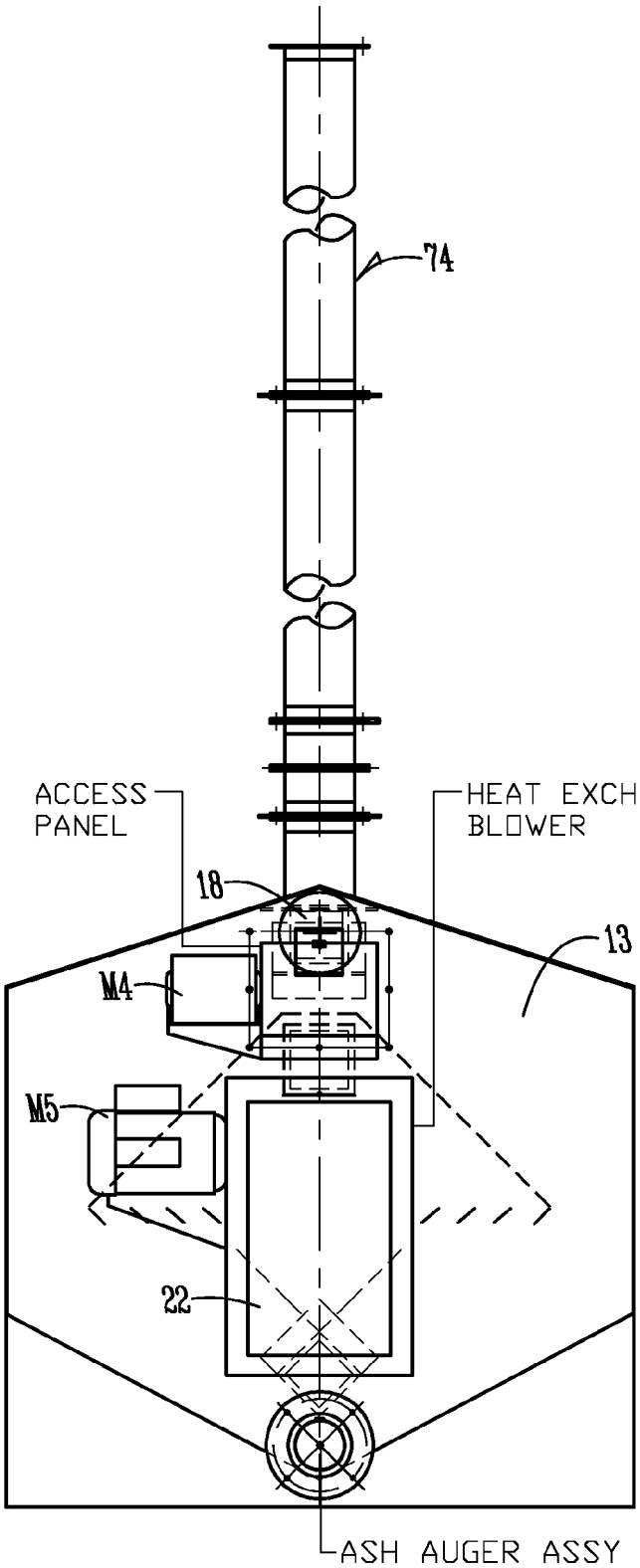
FIG. 1B is a left end elevation of FIG. 1A.
Figure 1C:
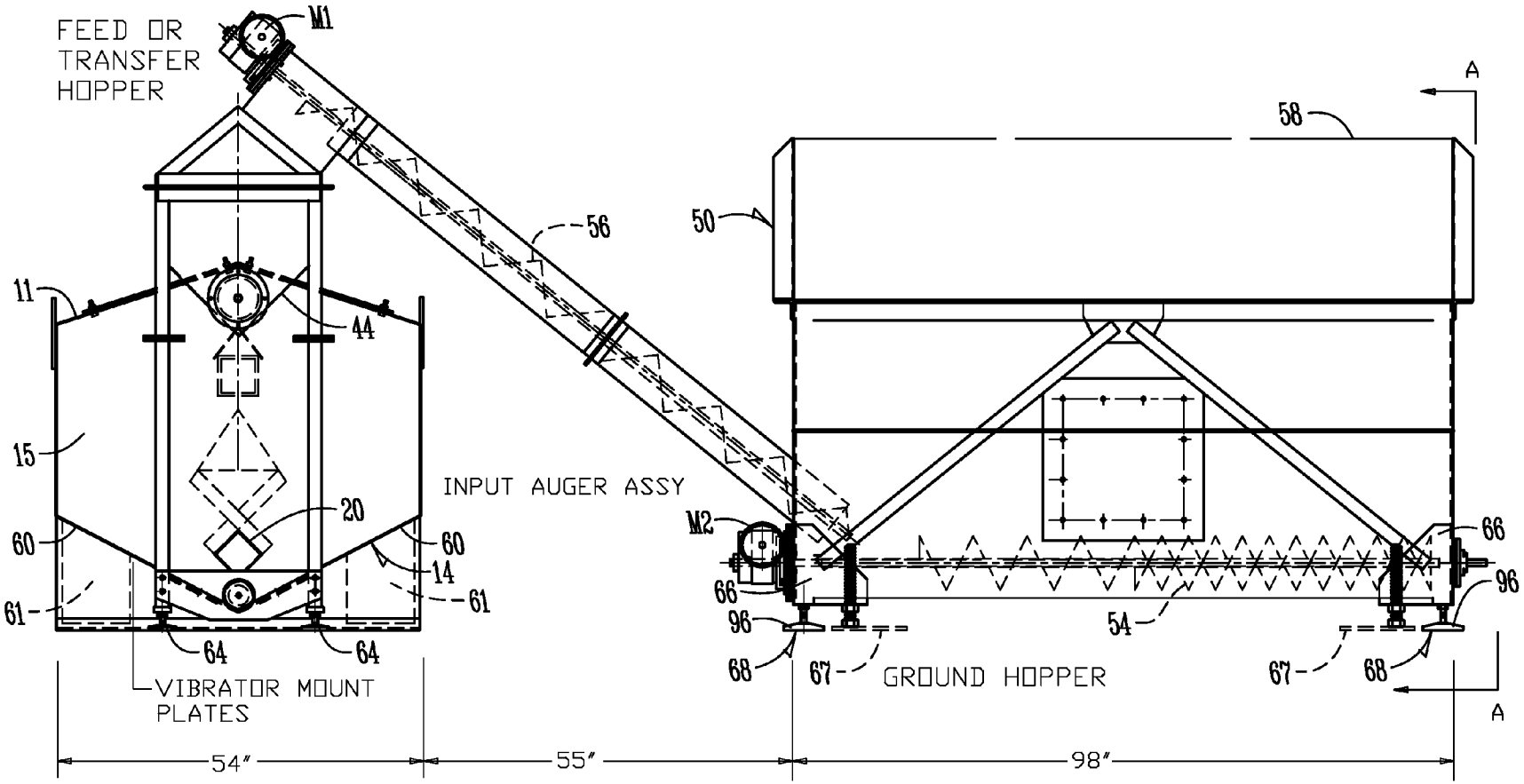
FIG. 1C is a right end elevation of FIG. 1A, but includes a side elevation of a ground hopper which supplies the feeder transfer hopper.

As shown in FIGS. 1A-C, cleanout auger 16 extends across the bottom of firebox 12 from end wall 13 to end wall 15, and then a distance outside of end wall 15 of firebox 12 in an enclosed tube to an outlet. Most of cleanout auger 16 is exposed to the volume above it in firebox 12. Ash, combustion remnants, and sometimes some fuel will therefore fall by gravity to be removed by it. Note, however, tubes 17A and B surround cleanout auger 16 for about six inches just inside vertical wall 23 and end wall 15 of firebox 12 (see also FIG. 6A). As will be described in more detail later, tubes 17A and B are intentionally positioned at those places to deter ash or fuel from flowing down into cleanout auger 16. They are designed to hold and maintain a vertical stack or layer of fuel right at and along the interior walls 23 and 15 of firebox 12. Additionally, tubes 17A and B act like bushings for auger 16 (they each cover about 2 flightings of auger 16). Also the tapered inner end of tube 17B helps eject, flip up, kick or move rocks or other solid non-combustibles up or away from the interior of tube 17B to deter such things from entering and jamming of auger 16 inside tube 17B. Combustion will consume fuel from the center of the fuel mass loaded into firebox 12 and tends to burn along the horizontal axis of firebox. By maintaining a vertical layer of fuel along the interior of wall 23 and wall 15 of the firebox, the fuel insulates each wall 23 and 15 of the firebox. When fuel is filled to the top of firebox 12, it insulates the entire exterior of firebox 12 from the heat of combustion inside firebox 12.

In the exemplary embodiment, the spacing of the flightings on the one-half of auger 16 nearest wall 23 are twice as close to one another (e.g. 1½ inches apart as opposed to three inches apart) as on the opposite half of auger 16 nearest wall 15 (nearest the outlet of auger 16 from firebox 16). This is designed to promote, on average, removing ash evenly from firebox 12. It is believed this takes more ash from the left side of firebox 12 in FIG. 1A than the right side of the firebox, so that, on average, there is an even removal of ash. A similar variation in flighting spacing can be used on ground hopper auger 54, discussed below.

3. Combustion Air Header and Blower

Combustion air fan 18 is attached to the exhaust stack 74 side of firebox 12. It is in fluid communication with a vertical plenum 19 at that end of firebox 12 which extends down to a combustion air manifold 20 that extends horizontally across firebox 12 above cleanout auger 16.

FIGS. 5A/B and 6A/B show combustion manifold 20 in more detail, including a plurality of air outlets 21 along each opposite upper side of tube or manifold 20 through which combustion air is injected into firebox 12. These figures also show how combustion manifold 20 has an entrance end which extends through and outside end wall 13 of firebox 12. That entrance end to manifold 20 would be in fluid communication through a vertical plenum with the output of a suitable blower or fan 18.

Blower or fan 18 can be any of a number of commercially available blowers. An exemplary device is Model #7H125 from Dayton Electric Manufacturing of Chicago, Ill. (USA). It has the capability of providing on the order of 800 CFM of available ambient atmospheric air, under a pressure of from 0 to 2 in water column. The size and performance of fan 18 can vary, however, depending primarily on size of combustor system 10.

Manifold 20, with air jets or outlets 21 along its length, is designed to supply combustion air through and along the lower part of fuel when loaded into firebox. Note also that manifold 20 is spaced apart but just above clean out auger 16 (see FIG. 1A). Therefore, it tends to block fuel from sitting right on top of clean out auger 16. But its diamond shape diverts fuel and combustion ash to opposite sides of auger 16 (see FIG. 5B). The V-shape of the bottom of firebox 12 assists in supporting the lower part of fuel when added to firebox 12. But air outlets 21 of manifold 20 are intended to inject combustion over air in or into the bottom part of the mass of fuel.

4. Heat Exchanger and Blower

A heat exchanger 24 also extends from the stack side of firebox 12 across the interior of firebox 12, but above combustion air manifold 20. FIGS. 4A-E show heat exchanger 24 in more detail and in isolation.

Heat exchanger fan or blower 22, mounted on the outside of the stack 74 side of firebox 12, injects outside ambient air through inlet 84 (see FIG. 4A). A divider wall 88 channels the air in the direction of the arrows in FIG. 4A horizontally to the opposite closed end of exchanger 24, down and through an opening in divider wall 88 and back horizontally, in the opposite direction and out exit 86 for beneficial use. For example, in FIG. 4A, outlet 86 is shown diagrammatically to be in fluid communication with a building to be heated via an appropriate duct or conduit to the building to heat the building with heated air extracted by heat exchanger 24 from the combustion in firebox 12. Note how the interior of exchange manifold 24 has a plurality of fins 89 to provide additional surface area for the transfer of heat from the firebox 12 to the air in manifold 24.

Blower or fan 22 can be any of a number of commercially available blowers (e.g. the same as blower 18). The size and performance of fan 22 can vary, however, depending primarily on size of combustor system 10.

Exchanger 24 can be made of sheet metal having a relatively high thermal conductivity to conduct heat from combustion in firebox 12 and transfer it, as efficiently as possible, to air in exchanger 24.

It is to be understood, however, that heat exchanger 24 could take different forms and embodiments. For example, alternatively, it could circulate liquid instead of air. It could heat water or other fluid to collect and extract heat from the combustion. The heated fluid could then be moved to a different location for beneficial use.

Furthermore, heat exchanger 24 could instead be a boiler that would boil water or other liquid. The steam could then be put to beneficial use, including to turn a turbine to generate mechanical or electrical power. Such systems are well known.

5. Exhaust Manifold

Exhaust manifold 26 extends across firebox 12 above heat exchange manifold 24. One end (the end away from the stack end of firebox 12) is closed. The other end is open to an exhaust chamber or plenum 72 that is in fluid communication with stack 74. FIGS. 7A and B show exhaust manifold 26 in more detail including a plurality of inlet openings 82 along its longitudinal axis. As shown in FIGS. 7A and B, the openings decrease in size from right to left. This has been found to provide a more consistent flow of exhaust through conduit 26 from right to left and out of stack 74.

FIGS. 5A and B, and 6A and B show exhaust manifold 26 in position relative to combustion air manifold 20, and how plenum 72 is on the outside of the stack-side end wall of firebox 12. These figures show how combustion air outlet openings 21 face upward and exhaust manifold inlet openings 82 face down. This is to have the slightly pressurized combustion air be injected upwardly into the fuel in firebox 12, flow towards exchanger 24, and enhance combustion around exchanger 24. Combustion exhaust gases would then tend to rise through the fuel and migrate to exhaust openings 82 (because of lower pressure path to and out of stack 74), and be collected and removed.

6. Feed or Fill Auger

Figure 2B:
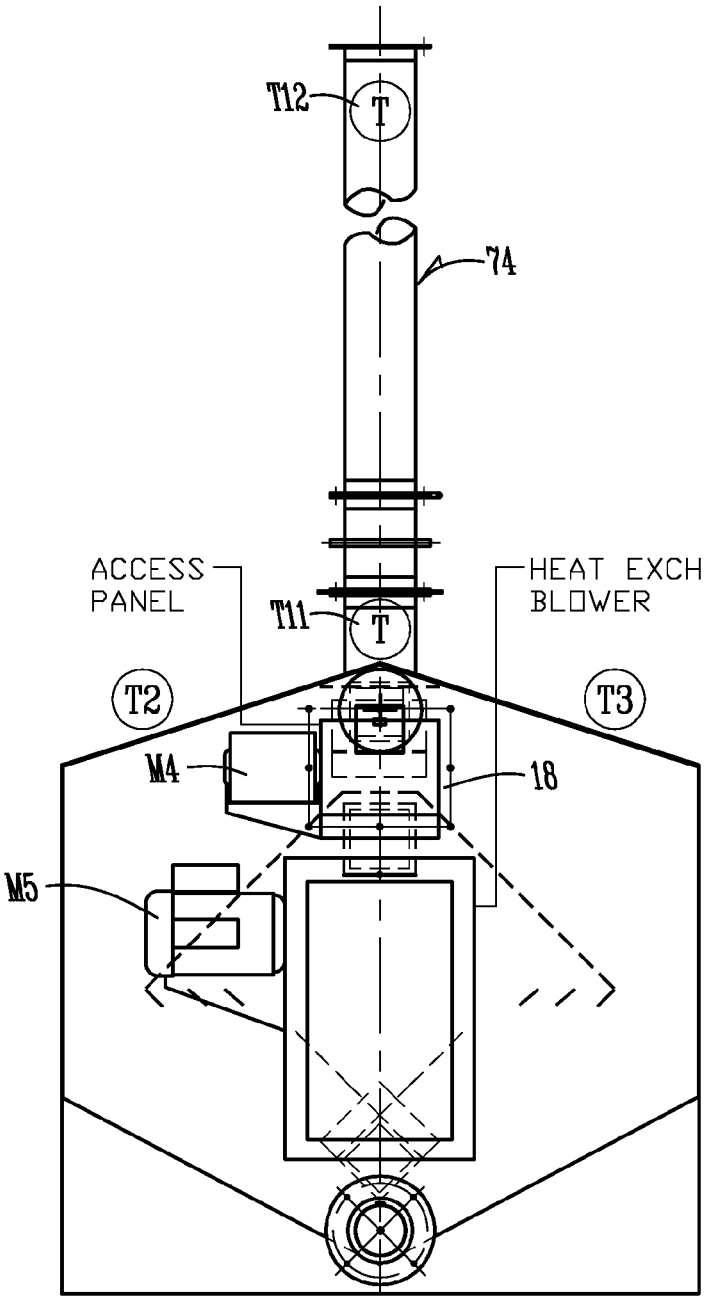
FIG. 2B is essentially an enlarged version of FIG. 1B.
Figure 3A:
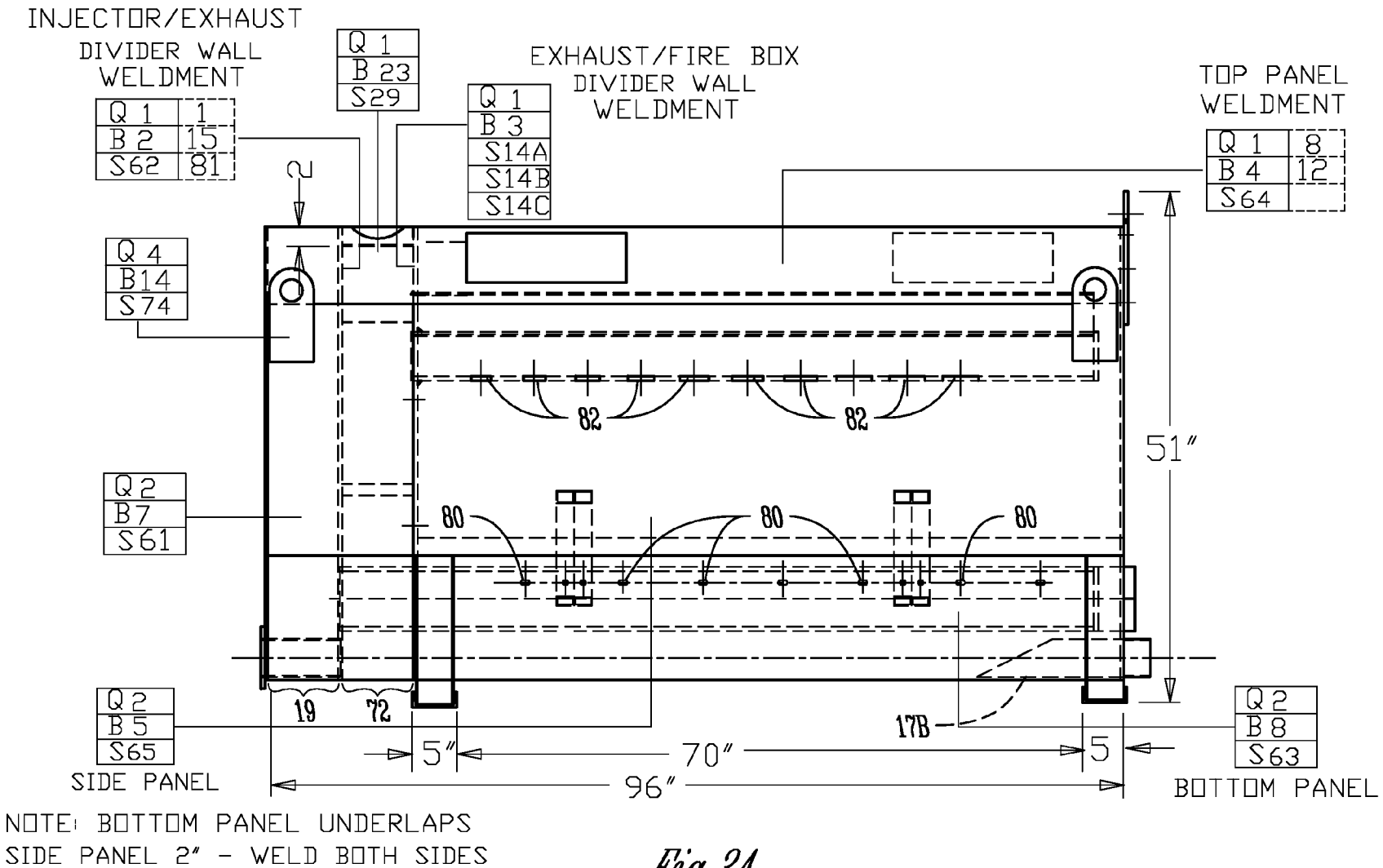
FIG. 3A is an isolated view of the firebox of FIG. 2A with combustion air and exhaust manifolds.
Figures 3B, 3C:
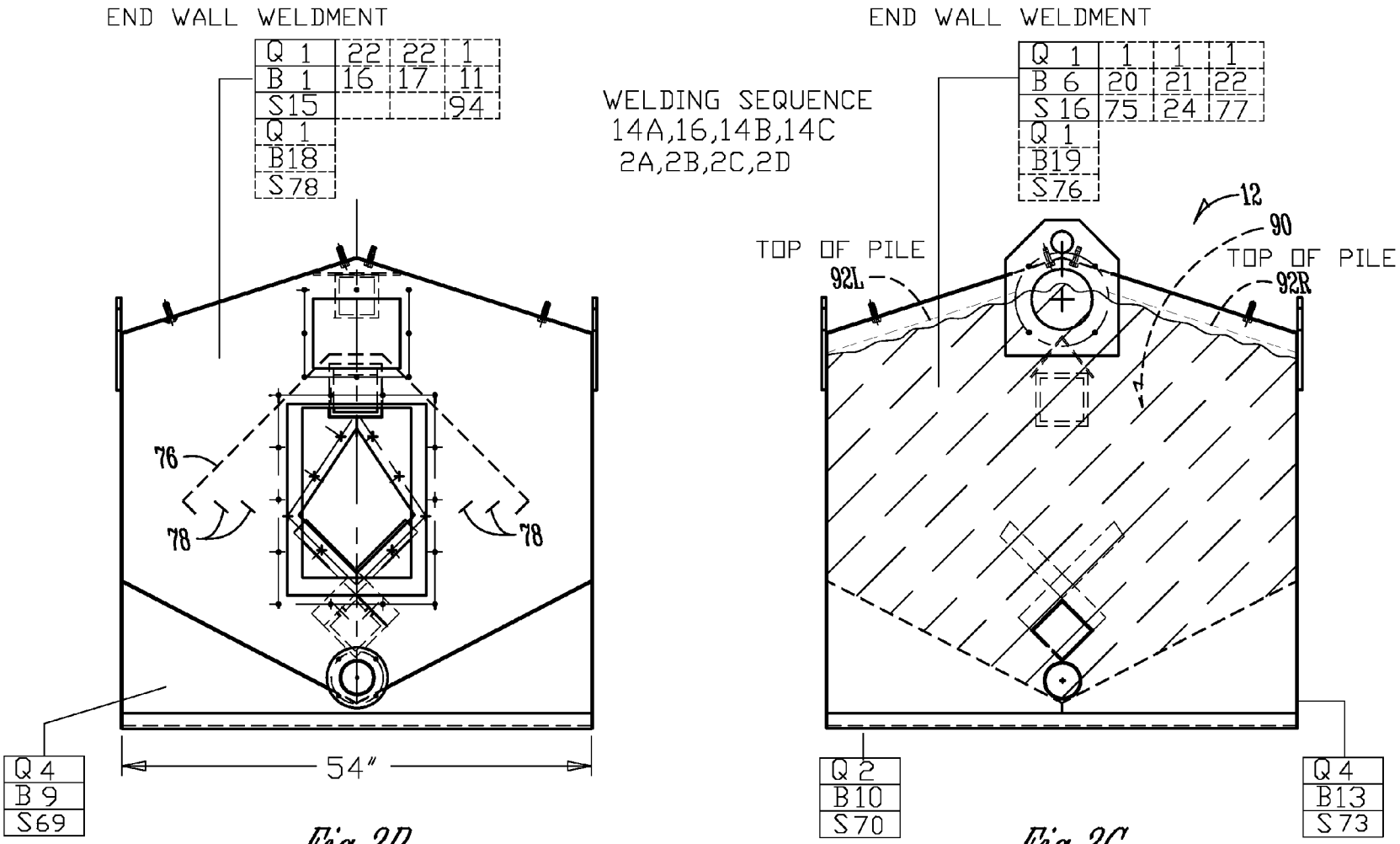
FIG. 3B is a left end elevation of FIG. 3A.
FIG. 3C is a right end elevation of FIG. 3A.

As can be seen in FIGS. 1B, 2B and 3B, the top of firebox 12 is an inverted V shape. A fill or feed auger 30 is operatively positioned along that peak inside firebox 12. Feed auger 30 is designed to bring fuel into firebox 12 and drop it by gravity along the horizontal length of firebox 12. This can be to initially fill firebox 12 fuel or to refill and reinsulate firebox 12 during operation, as will be discussed further below.

Feed auger 30 is supported at the stack side of firebox 12 (at wall 13) by an appropriate bearing or bushing (preferably a high temperature component). Auger 30 extends basically without any enclosure along the interior top or peak of the roof of firebox 30 until it exits firebox 12 through a feed or inlet tube 36 at the opposite end. Feed tube 36 provides a conduit for fuel to firebox 12 from feed hopper 40. Auger 30 extends through feed tube 36, out of firebox 12 and then across the V-shaped bottom of feed hopper 40 and is supported at an end wall 41 of feed hopper 40 by an appropriate bearing or bushing. An appropriate electrical motor M6 is operatively connected to auger 30 and turns it. It can turn in opposite directions, as will be discussed below. It can be turned at a selected speed. Motor M6 is operated through a VFD.

For reasons discussed later, and as indicated in FIGS. 1A and 2A, there is a section 34 (e.g. 6 to 9 inches long) of feed auger 30 that has no flighting or smaller flighting than the remainder of auger 30. For example, in the exemplary embodiment, flighting section 32 of feed auger 30 would have approximately 6 inch diameter flighting at 45 degree pitch with 6 spacing between flightings, but auger section 34 would have no flightings or reduced in size flighting. See FIG. 2D for additional detail. As shown there, approximately 5 to 7 inches of no flighting exists into firebox from wall 15, and approximately 1½ inches of no flighting exists into tube 36. There also could be a section 35 without flighting on the other end of the firebox (e.g. 20 inches). This is to prevent packing of fuel at that end of auger 30 and "fooling" the system that the firebox is full.

Figure 2C:
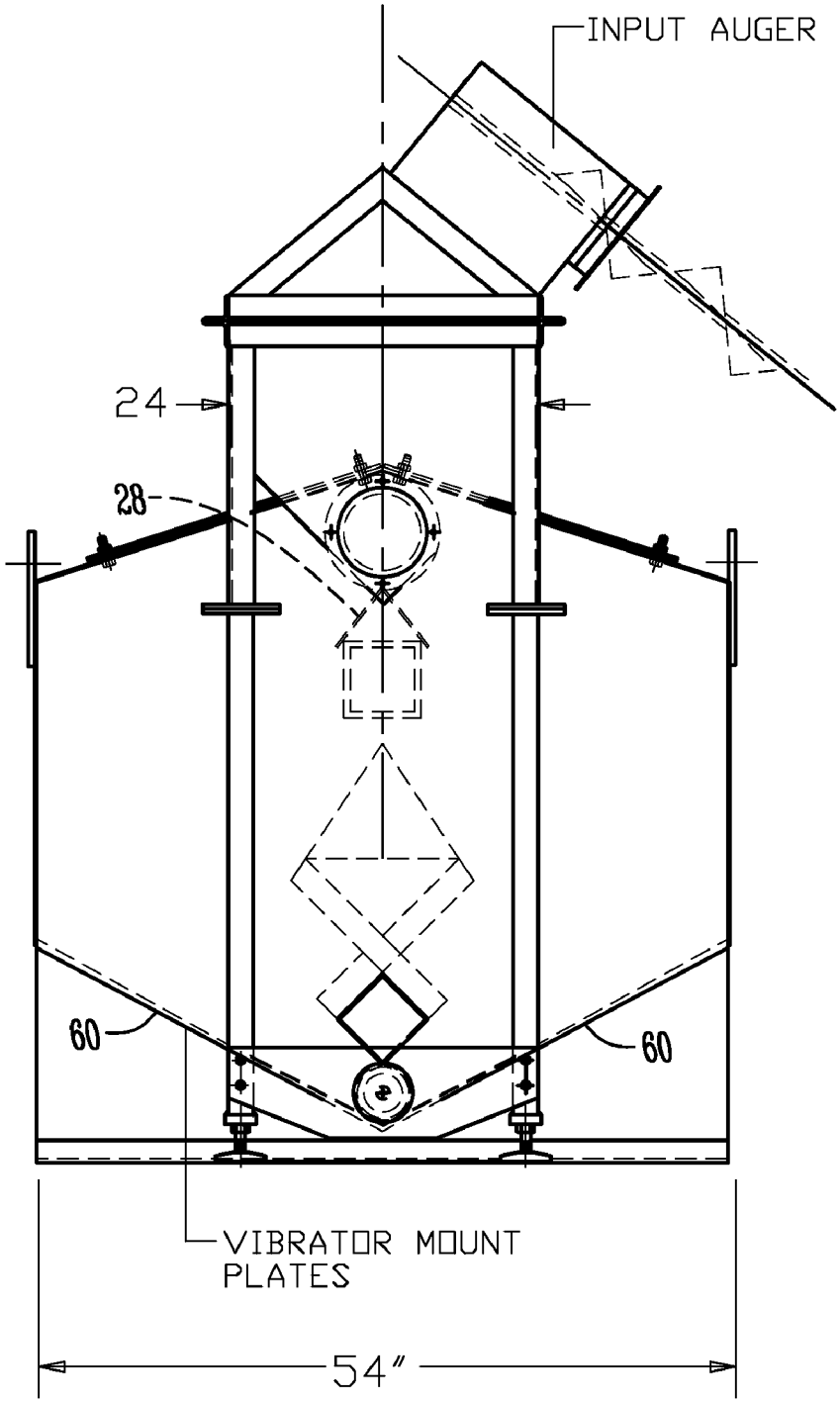
FIG. 2C is an enlarged right end elevation of FIG. 2A.
Figure 2D:
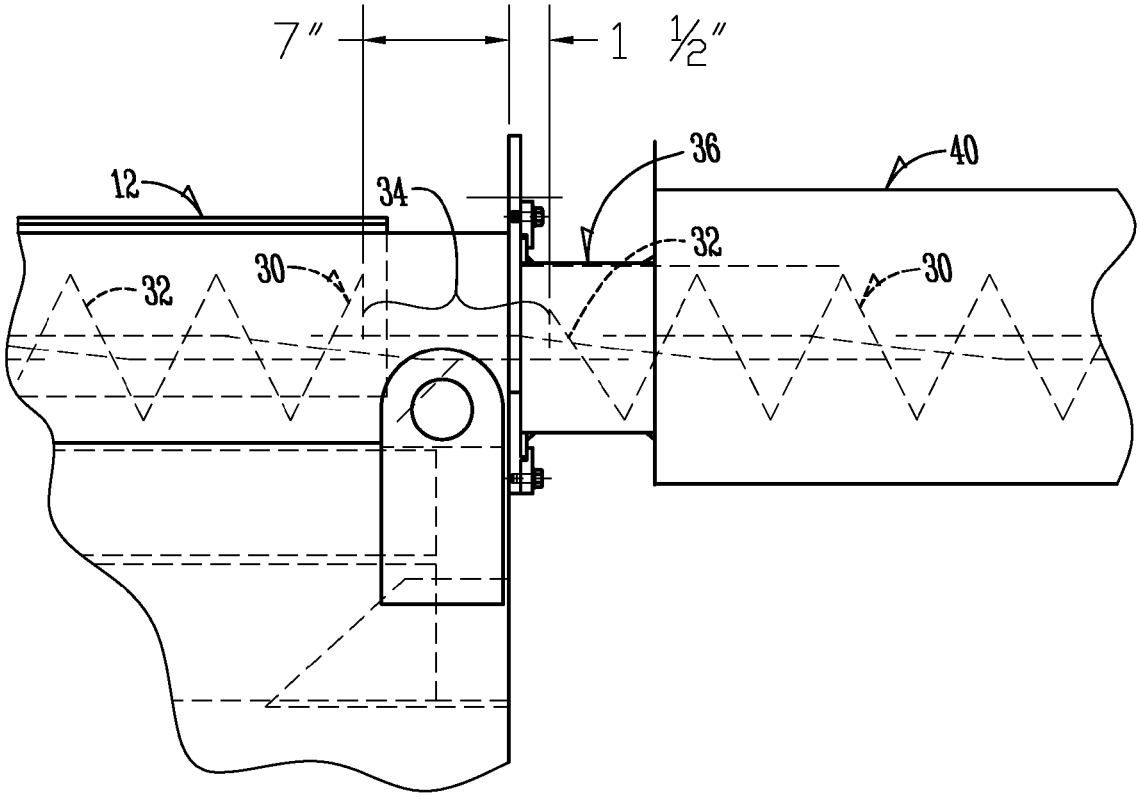
FIG. 2D is an enlarged, isolated view of a part of the fill or feed auger indicated at line 2D-2D of FIG. 2A.

Note that there is an inverted V-shaped cover 28 on top of exhaust manifold 26 (see for example FIG. 2C). As can be appreciated, fuel that is augured into firebox 12 by auger 30 would not be able to move upward beyond the relatively closely spaced inverted V-shape roof of firebox. This shape and gravity would also tend to encourage fuel to drop down into firebox 12. However, the inverted V-shape cover 28 on top of exhaust manifold 26 would tend to encourage fuel to move to opposite lateral sides of firebox 12, and would not drop directly below auger 30 because of inverted V-shaped cover 28 spaced relatively closely along its lower side. Fuel would fall in opposite lateral directions from auger 30 into firebox 12.

Even though section 34 of auger 30 has no flighting or small flighting, flighting 42 of auger 30 in feed hopper 40 would carry fuel through inlet tube 36 and drop fuel into firebox 12. Even though the fuel is a bridging fuel, it would fall and move down into an empty firebox 12. As it starts to fill that end of firebox 12 (the end nearest feed inlet tube 36), the fuel will continue to fall down by gravity. It tends to tumble down the growing pile of fuel in firebox 12 at an angle. This angle can vary but is on the order of 60 degrees. Fuel will eventually fill to near the top of the firebox along that first end wall 13 of firebox 12. At that time, the flighting of auger 30 inside feed hopper 40 would continue to carry fuel into feed tube 36. Even though section 34 of auger 30 without flighting would not be able to carry fuel along auger 30, the continual supply carried by the feed hopper flighting 42 would push fuel over the file that has developed in firebox 12. Eventually the part 32 of flighting of auger 30 inside firebox 12 would pick up fuel and start carrying it farther into firebox 12. The pile of fuel in firebox would then gradually fill firebox to the top across the horizontal length of firebox 12 until firebox 12 is essentially full of fuel. The inlet tube 36 would basically be full of fuel and thus be at least substantially plugged or sealed.

7. Feed Hopper

As shown in FIGS. 1A-C, feed hopper 40 is suspended on legs 64. Auger section 42 of feed auger 30 is substantially inside feed hopper 40 and moves fuel through inlet tube 36 into firebox 12. FIGS. 8A-D show feed hopper 40 and certain of its features in more detail, including inlet tube 36, which extends into hopper 40 and has a slanted entrance end.

An inlet fitting 48 (see FIGS. 9A and B) connects to incline auger 56 from a ground hopper 50 (FIGS. 1C, 1D, 10A and 10B, from which a supply of fuel can be taken on demand.

8. Ground Hopper

Figure 1D:
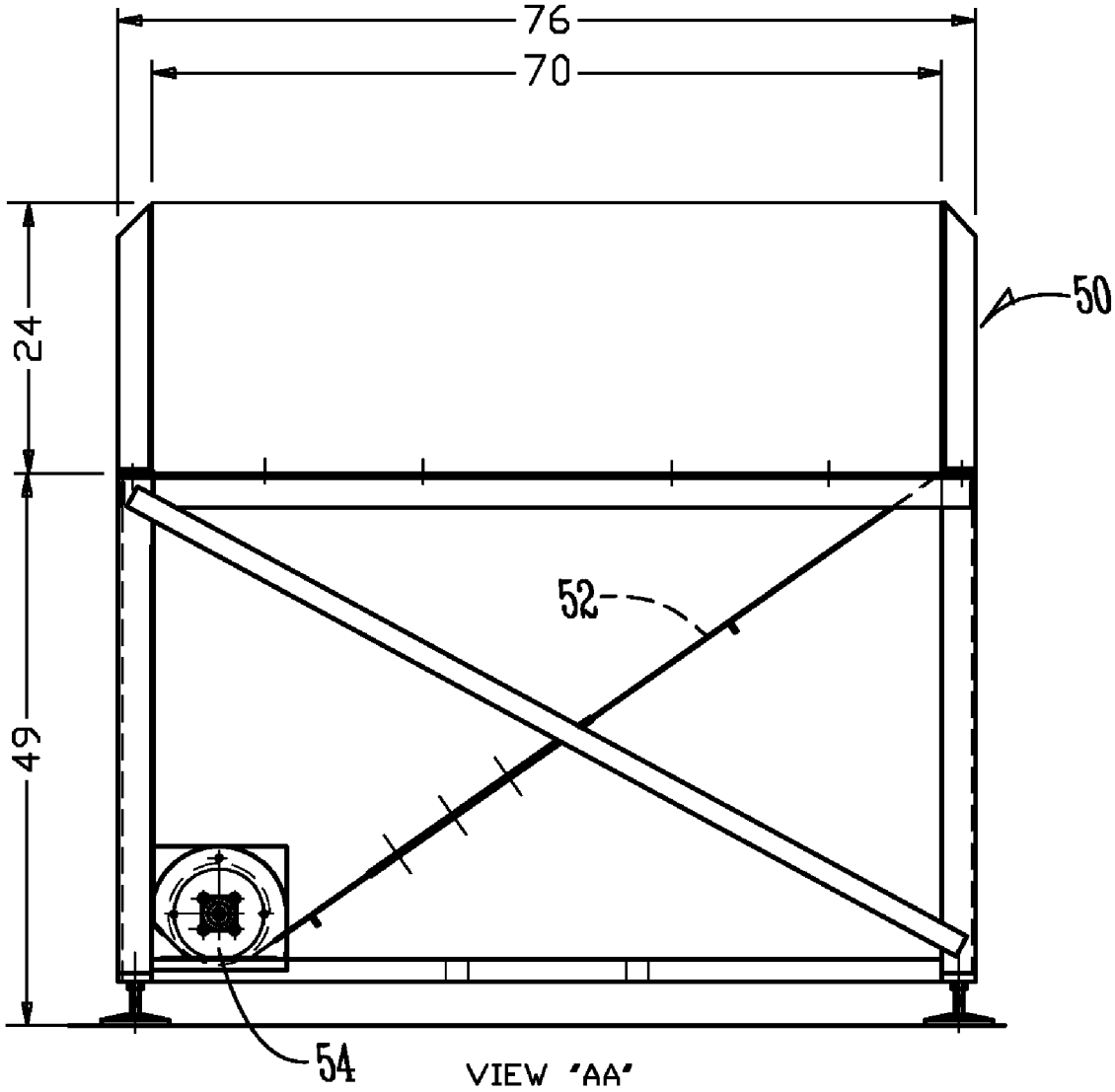
FIG. 1D is an end elevation taken along line AA of FIG. 1C.

As shown in FIGS. 1D and 10B, ground hopper 50 has a slanted bottom floor 52 that would direct fuel to bottom or auger 54 which moves fuel to the inlet end of incline auger 56 to be elevated to feed hopper 40.

A fill opening 58, to ground hopper 50, allows machinery or vehicles to dump fuel into ground hopper 50. FIGS. 8A-D and 10A-B show feed hopper 40 and ground hopper 50 in more detail.

9. Vibrator Assemblies for Firebox and Ground Hopper

In this embodiment, firebox 12 has plates 60 on opposite lower portions of firebox 12 (see FIG. 1C). Feet and legs 62 support firebox 12 on a pad, slab, or other surface. Plates 60 on opposite lower lateral sides of firebox 12 are each adapted for operative interfacing with a mechanized vibrator 61 (shown diagrammatically at FIG. 1C). Therefore, firebox 12 would have two vibrators that would interface with it through plates 60 and be operated in a manner to move ashes or non-combustibles toward ash auger 16, but not adversely disrupt or destroy the natural bridging action of the fuel to maintain insulation of firebox 12 by the fuel. The frequency of vibration for ground hopper can be lower than the firebox because the lower frequency tends to help move the fuel whereas the higher frequency tends to help ashes and non-combustibles move to the ash auger 16 without disrupting or breaching the bridging action of the fuel in the firebox.

Vibrators 61 can be a commercially available device. In the exemplary embodiment, it is a Model SCR-1000 adjustable speed and force electric vibrator (with vibration controller) by VIBCO, 75 Stilson Road, Wyoming, R.I. 02898 (USA) (See FIG. 11H). Their speed of vibration can be controlled by a manually adjustable rheostat or other control. Optionally, speed of vibration might be controlled through a VFD It has the capability of providing vibratory action (e.g. 1000 lbs/N, 950-2500 RPM continuous duty and 2500-4000 RPM intermittent duty; usually 2500 RPM) to deter packing, plugging, and to keep the fuel or ashes moving through the system. The size and performance of these vibrators can vary, however, depending primarily on size of combustor system 10 or fuel.

Similarly, ground hopper 50 has vibrator plates 66 connected to feet (see FIG. 1C) that are on the side and which can be operatively connected to a vibrator mechanism 67 (shown diagrammatically). Mechanism 67 can be any of a number of commercially available vibrators, but in the exemplary embodiment, it is also a Model SCR-1000 VIBCO (with vibration controller that can adjust speed and force of vibration over a range). It is controlled through a VFD (see FIG. 11C) and can operate at 1200 vibrations per min (VPM). The size and performance of this vibrator can vary, however, depending primarily on size of combustor system 10 and the fuel.

Legs and feet 68 support ground hopper 50 on the ground or a slab but vibrators 67 would vibrate ground hopper 50 to deter packing of fuel to promote more efficient transfer and movement of it.

10. Interaction of Components

The basic structure of system 10 thus includes a firebox 12 having essentially a combustion chamber 70 (see FIG. 1A) in which fuel is combusted. Combustion takes place by the presence of fuel and both resident air and injected air through combustion air manifold 20. Combustion air travels through chamber or plenum 19 to air manifold 20.

Heat is collected and extracted by heat exchanger 24. Exhaust gasses are collected through exhaust manifold 26 and routed to an exhaust plenum or chamber 72 and out stack 74.

Fuel can be mechanically provided by feed auger 30 using a supply of fuel available through ground hopper 50 and feed hopper 40. It should be noted that, in the exemplary embodiment, the amount of fuel moved from feed hopper 40 is designed to be greater than the amount of fuel that moves from ground hopper 50 to feed hopper 40 to prevent overfilling and plugging of feed hopper 40. This can be controlled by any of a number of parameters. If the ground hopper augers and feed auger are essentially the same size, this can be controlled by appropriate adjustment of the speed of the augers.

Likewise, clean out auger 16 could be designed to move more material than feed auger 30 for a similar reason, to prevent overload or plugging of clean out auger 16.

FIGS. 3A-B illustrate an optional feature in exhaust plenum 72. An inverted hood 76 and baffles 78 form a scrubber system for the exhaust from firebox 12. They mechanically scrub or force particulate matter in the exhaust from the exhaust gasses flowing upwardly. These particles then tend to fall vertically down due to a low velocity area created by the shape of the scrubber. Scrubber 78 deter emissions of particulate matter.

Also, as previously mentioned, tubes 17A and B around opposite interior combustion zone ends of cleanout auger 16 would promote fuel to stack up above, and not be moved by, cleanout auger 16. It would tend to hold a vertical section of fuel along the inside end walls 23 and 15 of combustion zone 70. The benefit is it creates an insulation layer each opposite end wall so that heat does not transfer to the metal end walls of firebox 12.

FIG. 3C (and FIGS. 12A/B and 14A/B) illustrate that feed auger 30, in combination with the other components, would fill firebox 12 virtually full with fuel 90. Fuel 90 would fall into an empty firebox 12 on opposite sides of inverted V cover 28 over exhaust manifold 26. It would start building up from the V-shaped bottom of firebox 12 upwardly. It would continue to fill both vertically and horizontally. At some point, it would almost essentially pack the entire firebox 12. As can be appreciated, therefore, fuel 90 would basically be adjacent all interior sides of the firebox 12. It would thus form an insulation layer to essentially all sides of the firebox wall or skin.

FIGS. 5A and B show a sub assembly that includes combustion air manifold 20, and exhaust manifold 26 with cover 28 above it. Exhaust chamber 72 is also shown. This sub assembly would be fit inside firebox 12. FIGS. 6A and B are similar to FIGS. 5A and B but show that sub assembly installed in firebox 12. Then FIGS. 1A and subparts and 2A and subparts, show the addition of heat exchanger 24 into firebox 12.

11. Thermostat

In the exemplary embodiment, combustor 10 is operatively connected to building to provide heated air to heat the building. As will be discussed further below, the exemplary embodiment is designed to provide needed heat to the building on demand.

To do so, as indicated diagrammatically of FIG. 4A, outlet 86 from heat exchanger 24 is in communication with a building to send heated air for heating the building. A thermostat 94 would be placed in the building to let system 10 know when heat above the thermostatic set point is demanded.

Thermostat 94 can be a conventional thermostat that allows the building owner/operator to create a thermostat set point which defines the building temperature that is desired. In this embodiment, thermostat 94 generates an output signal that can be sent to a PLC or other controller and be recognized as the set point of the thermostat.

Thermostat 94 can be any of a number of commercially available thermostats. In this embodiment it is programmable to a set point with a three degree F. swing (i.e. it calls for heat if sensed temperature goes more than 1½ degree F. below the set point). It has the capability of providing an output signal that can be read by PLC 102 (see FIGS. 11A and 11G).

12. Smoke Detector

A smoke detector 95 can be placed in the heat exchanger 22 outlet plenum (same location as thermistor T1 in FIG. 2A). Such a smoke detector could be used to alert system 10 if smoke is in the heat exchanger and automatically shut the system down as it would tend to indicate some malfunction in the system. It or the heat exchanger should not contain smoke.

It can be any of a number of commercially available devices. It has the capability of sending a signal to PLC 102 that would be recognized as an indication that smoke about a certain threshold is indicated (see FIGS. 11A and 11G).

13. Load Sensors

FIG. 1C diagrammatically illustrates that load sensors 96 could be placed between legs or feet 68 for ground hopper 50 and the foundation on which ground hopper 50 sits. Such load cells or strain gauges are commercially available. An estimation of the weight of ground hopper 50 empty can be derived from a summing of the readings from the load sensors and then an estimation of the total weight of it and any fuel in it could be taken when needed in the same way, to keep track of how much fuel is being used by system 10. This could be advantageous, for example, if there would be some charge or payment for fuel. Also it could be used to just keep track of the throughput of fuel.

Load sensor 96 can be any of a number of commercially available load sensors or strain gauges. A summing board 97A (commercially available) is used to communicate with strain gauge input module 97B (Model I-7016 from ICP DAS of Hsinchu, Taiwan 303 (ROC)) to allow the load sensors to communicate with PLC 102.

In this embodiment there are two load sensors, one for each end of ground hopper 50. However, there could be four (one for each leg of hopper 50). If more than one, their readings are summed by summing board 97A to get total weight.

14. Strip Heater

FIGS. 6A and B illustrate diagrammatically the general position of at least one strip heater 98 along combustion air manifold 20. These devices, commercially available, use electricity to heat up to a temperature designed to ignite the type of fuel that will be combusted in combustor 10. Strip heater 98 is positioned fairly close to the combustion air inlet openings 21 to promote ignition and combustion.

Strip heater 98 can be any of a number of commercially available devices. In the exemplary embodiment, it is a Model #OS1430-1250B from Vulcan Electric Company of Porter, Me. (USA). It has the capability of providing on the order of 1000 degrees F.

D. Control Circuit

The exemplary embodiment features an electrical control circuit 100 that works in combination with certain components to allow monitoring and control of system 10. FIGS. 11A-H illustrate one example of such a control circuit 100.

1. PLC

A programmable digital device such as a PLC 102 is connected to an appropriate electrical power supply 104. It could be programmed for a variety of functions such as is well known in the art. PLC 102 can be any of a number of commercially available programmable logic controllers. It could also be other types of programmable controllers. In the exemplary embodiment it is a Model I-7188EGD embedded controller with processor (512K static RAM, 512K flash memory) from ICP DAS of Hsinchu, Taiwan (ROC) (see FIG. 11B). It is a palm-sized Ethernet SoftLogic controller that supports ISaGRAF based on IEC61131-3 standard to fully support five conventional PLC languages. It includes a variety of serial ports including RS-323, RS-485, and Ethernet.

2. Operator Interface

PLC 102 works in combination with operator interface 103, which communicates with PLC 102 over its Ethernet connection through a five port Ethernet switch (e.g. Model NS-205 from ICP DAS) (see FIG. 11B). Operator interface 103 can be any of a number of commercially available components. In the exemplary embodiment it is Model #G303 Graphic LCD Operator Interface Terminal from Red Lion Controls, 20 Willow Springs Circle, York, Pa. 17402 (USA). It has internal memory (4 Mbyte flash), an operator display, a keyboard, and communications ports (e.g. Ethernet, RS-232, RS-422/485, USB). It can be used to access and control external devices, as well as log data. It can be configured using Crimson software on a PC (available from Red Lion Controls) through a programming port. Specifications are available at www.redlion.net or from Red Lion Controls.

PLC 102 and operator interface 103 can thus be programmable for a variety of functions for system 10. This can include inputs from peripheral devices and outputs to control peripheral devices.

3. Inputs to PLC and/or Operator Interface a) Thermostat

In this embodiment, one input is from building thermostat 94. Thermostat 94 would send an electrical signal to PLC 102 when there was a call for heat in the building. Thermostat 94 could, of course, have an adjustable set point so that the user could select the level of heat desired for the building. Thermostat 94 has an output that can be communicated to PLC 102 via 16 channel isolated digital input module 110 (Model #I-7051D from ICP DAS) (see FIG. 11G).

b) Smoke Detector

An additional input is from smoke detector 95. If a signal is generated from smoke detector 95 indicating the presence of smoke above a threshold in heat exchanger 24, the PLC would shut down combustion air to allow investigation as to the causes of smoke in the heat exchanger 24. Smoke detector 95 would also communicate to PLC 102 through digital input module 110 of FIG. 11G.

c) Load Cells

An additional input would be from load cells 96. They would send an electrical signal proportional to the weight experienced by them to summing board 97A (FIG. 11B), which would sum them to get total weight, which in turn would communicate that signal through strain gauge input module 97B to PLC 102, which would interpret it as the weight of the fuel in ground hopper 50.

d) Thermocouples

As illustrated in FIG. 11, additional inputs come from 29 thermocouples T1-T29. FIG. 11F indicates the function of each.

Thermocouples T1-T29 can be commercially available stainless steel washer-type thermocouples that could be screwed to metal components of system 10 and read the temperature at or near their location in system 10.

FIG. 11E shows how the readings from each thermocouple can be communicated to PLC 102 through analog input modules (e.g. Model #I-7018BL Eight Channel Analog Input Module for thermocouple types J or K from ICP DAS).

FIG. 11F indicates type J or K for each of thermocouples T1-T29. Type J have a sensing range of −210 to +760 degrees F. Type K have a range of −270 to +1372 degrees F.

(1) Supply Air Temperature for Heat Exchanger

Thermocouple T1 would be placed at or near supply air outlet 86 (see FIG. 4A) from heat exchanger 24 (see FIG. 2A). It would monitor the temperature of air exiting from heat exchanger manifold 24.

This can be used by system 10 to monitor the performance and efficiency of heat exchange, as it could log the temperature exiting heat exchanger 24.

(2) Firebox Exterior Skin Temperature

Thermocouples T2-T9 would be placed directly in contact with the external skin of firebox 12 in the eight positions indicated in FIGS. 2A and 2B. Essentially four zones along the length of each upper side of firebox 12 would be monitored for temperature on the external surface or skin of firebox 12. As indicated in FIG. 2B, pairs of thermocouples T2-3, then T4-5, then T6-7, and finally, T8-9 would be placed on opposite sides of the upper half of firebox 12 for zones 1, 2, 3, and 4 (e.g. four per side, each spaced approximately six to eight inches apart from adjacent ones). Each would be set to monitor whether skin temperature at that point exceeds a certain set point. If so, it would indicate that the insulating layer of fuel 90 in firebox 12 at that location has gone away. This would indicate that there had been a collapse of fuel at that location. As will be explained in more detail later, such a signal from any thermocouple T2-9 will trigger an instruction for an automatic fill sequence to bring in new fuel to plug that collapsed space for continued efficient combustion.

In the exemplary embodiment, the set point for thermocouples T2-9 is around 250° F. for an iron firebox 12. This could vary depending on the type of material used for firebox 12, the type of fuel being combusted, or other factors.

(3) Stack Temperature

Thermocouples T11 and T12 are placed in stack 74 (see FIG. 2B). They will be calibrated such that if their respective temperatures are relatively close, an alarm will not occur. However, if the upper thermocouple T12 registers a temperature exceeding a certain offset from lower stack thermocouple T11, this indicates the presence of a stack fire in stack 74. Creosote build-up could cause the same.

Upon that condition, PLC 102 would assume a stack fire and issue an alarm. For example, the alarm could be to turn off combustion air blower 18 to drastically reduce combustion and heat from firebox 12 and allow the stack fire to burn out. Once the temperature difference between T11 and T12 returns to within normal range, TLC 102 could increase combustion air to bring system 10 back up to full combustion.

(4) Exhaust Chamber Temperature

Thermocouple T13 is placed in exhaust chamber 72 (see FIG. 2A) and monitors the temperature of the exhaust. Again, this could be for recordkeeping or to try to adjust and fine tune combustion.

(5) Firebox/Heat Exchanger Temperature

Thermocouples T14-T29 are positioned as diagrammatically indicated in FIG. 4A. They are spaced apart along the length of the upper and lower halves of heat exchange manifold 24.

In the exemplary embodiment, they are placed about 3 or 4 inches away from exchange manifold 24. They would therefore be inside the fuel, as opposed to being in direct contact with the exterior of heat exchanger 24. They are used as inputs to monitor the temperatures at those locations. This information could be data logged to simply make a record of operation of system 10 or to help control the combustion air and/or exhaust air flow to fine tune combustion.

In the exemplary embodiment, T14-T29 include four on the top of and spaced about 4 inches into the burn around exchanger 24 (two on each side of the top). Another four (2 on each side) are spaced about 4 inches away from the bottom of exchanger 24. They are mounted on but extended about 4 inches from exchanger 24 by a metal bushing or mounting piece.

e) Variable Frequency Drives

As discussed earlier, a number of motors are used for various functions in system 10. As indicated at FIG. 11C, each of motors M1-M7 is operatively connected to respective variable frequency drive VFD 1-VFD 7. As is well-known, VFDs can be used to adjust the speed of electric motors by adjusting the frequency of the electrical power, as opposed to adjusting voltage. This allows for relatively constant voltage to the motors for efficient operation.

However, a VFD also can read the amperage or other operational characteristics of the motor it controls. In this embodiment, VFDs 1-7 communicate an amperage reading or draw of motors M1-7 respectively to PLC 102. These inputs to PLC 102 are used to monitor operational state of certain of the components of system 10, as will be discussed in more detail below. For example, an increased amperage draw implies that an auger motor is bogging down. System 10 assumes that this means the auger is full and that whatever it is filling is full. This can be used by control circuit 100.

VFDs 1-7 can communicate between an RJ-45 serial communications port on each (not shown) to corresponding RJ-45 connections at operator interface 103 (see FIG. 11B). VFDs 1-7 can be any of a number of commercially available products. In the exemplary embodiment they are Model #SKB3400150 Commander SK Series Digital AC Variable Speed Drives from Control Techniques of 359 Lang Blvd., Grand Island, N.Y. 14702 (USA). They are fully digital pulse width modulation (PWM) type, open loop vector AC motor controllers. They are programmable and can control motor speed, direction (forward and reverse), start and stop. They also can monitor amperage draw of their respective motor and communicate that to PLC 102.

VFD's 1-7 can be appropriately protected with fusing (see FIG. 11C), and can communicate whether or not they have exceeded that protection threshold to PLC 102 via digital input module 110 (see inputs D6-12 in FIG. 11G).

f) PC

As indicated diagrammatically in FIG. 11A, a personal computer (PC) or other device could be placed in operative communication with PLC 102 and/or operator interface 103. This could be over an Ethernet connection. Therefore the PC could be either near or remote from system 10, but could be used to program, reprogram, monitor, or otherwise communication and exchange information with control circuit 100.

g) Electrical Power

FIGS. 11A-H indicate schematically how electrical power is provided to control circuit 100 and to peripheral electrical components of system 10. Diagrammatically in FIG. 11A, a personal computer (PC) or other device could be placed in operative communication with PLC 102 and/or operator interface 103. This could be over an Ethernet connection. Therefore the PC could be either near or remote from system 10, but could be used to program, reprogram, monitor, or otherwise communication and exchange information with control circuit 100.

h) Switches

FIGS. 11G and H illustrate several switches that are available for manual selection has inputs to control circuit 100. The "cycle-manual/auto" switch is an input to PLC 102 allowing the operator to select automatic, continuous operation for system 10 ("auto") or manual control ("manual").

Also, "manual fill" allows the operator to decide if fuel is to be filled into firebox 12. For example, this can be used when firebox 12 is empty and is to be filled with the fuel initially. This switch operates the ground hopper and feed augers.

Similarly, "manual clean out" allows the operator, at any time, to operate the clean out auger. This could, for example, be done on a scheduled basis (e.g. every week or month or year) or at any given, chosen time.

Also, FIG. 11G shows a "manual ignition" switch. This momentary switch (see switch MSH of FIG. 11H) is a safety feature. It requires the operator to physically push the momentary switch to start a strip heater. Control circuit 100 would operate the strip heater for a set time period and automatically turn it off; another safety feature.

FIG. 11H also shows that vibrators for the ground hopper and firebox can also be manually controlled through switches MSVH and MSVM.

4. Outputs to PLC and/or Operator Interface

FIGS. 11A-H show outputs to control the following components.

a) Variable Frequency Drives for Motors

As previously mentioned, VFDs 1-7 are operatively connected between PLC 102 and motors M1-7 respectively, to start and stop, as well as control speed and direction of motors M1-7.

Motors M1 and M2 of incline auger 56 and bottom auger 54 of ground hopper 50 can be controlled through a variable frequency drives VFD 1 and 2 (see FIG. 11C). As previously discussed, the VFD not only allows adjustment of auger speed, it can also sense when pressure is experienced on an auger by the amperage draw of the motor with which it is associated. This amperage draw for such motors could be input to PLC 102 and used advantageously as will be further described.

Additionally, it is to be understood that certain augers of system 10 preferably will be run at different speeds or throughputs. For example, in the exemplary embodiment augers 54 and 56 of ground hopper 50 are programmed to run at a lower speed than feed auger 30. Similarly, cleanout auger 16 would be run at a faster speed that feed auger 30. This is to prevent packing or overload from section to section of system 10. The use of the variable frequency drives allows easy programming and adjustment of such speeds as needed or desired.

PLC 102 also can control the vibrator motor M3 for vibration of ground hopper 50 through variable frequency drive VFD3 (see FIG. 11C).

PLC 102 additionally can control motors M4, M5, M6, and M7 for firebox 12. M4 controls volume and speed of combustion air. M5 controls volume and speed of heat exchange air. M6 controls feed auger 30. M7 controls cleanout auger 16. Each utilizes a variable frequency drive as explained earlier (see FIG. 11C).

b) Strip Heater Contactor

Additionally, strip heater 98 is controlled by PLC 102 after momentary switch MSH is manually closed by the operator. As shown in FIG. 11D, PLC 102 would control the "heater contactor" by supplying sufficient electrical power for a preprogrammed time (e.g. 10 minutes) selected to cause ignition for fuel in contact or adjacent to heater 98.

Heater 98 can be any of a variety of commercially available types. It is extended along the top of combustion air manifold 20 substantially across the longitudinal length of firebox 12. It is operated when combustor 10 is initially fired up after initial filling with fuel. It can also be used to re-ignite fuel if combustion has intentionally or unintentionally discontinued.

Strip heater 98 can be a stainless steel, resistance-type strip heater which generates temperatures on the order of approximately 575° F. This could be adjusted depending primarily on moisture content of the fuel. Such heaters can reach up to approximately 1,000° F.

c) Vibrator Contactors

PLC 102 also controls a contactor or relay (see FIG. 11D) to provide electrical power or not to vibrator motors M8 and M9 for firebox 12.

d) PC

Additionally, as mentioned, data can be output from control circuit 100 to peripherals such as a PC. This allows storage of data about operation of combustor 10. This can allow the operator to evaluate and make modifications to operation to optimize performance. It also allows data logging to see how system 10 is operating for research and development purposes. For example, by logging temperature along the heat exchanger, modifications to the heat exchanger might be suggested to improve performance.

5. Miscellaneous

FIGS. 11B-H show additional details for one way circuit 100 could be built. Of course, a variety of ways are possible as is within the skill of those skilled in the art.

Some features to note are as follows. FIG. 11B indicates there could be plug-in connections so that certain sections or parts of circuit 100 could be made modular. There could be a display that could indicate information to the user.

FIG. 11C illustrates there could be appropriate protection such as fuses and relays. There could also be electrical outlets supplied for plug-in of other electrical equipment.

FIG. 11G illustrates that there could be manual overrides or selections related to various functions of circuit 100. From top to bottom in FIG. 11G, there could be a manual switch or control to select between manual or automatic cycling. As mentioned, there could be manual operation to fill firebox 12. Also, it is preferable there be a manual momentary ignition switch. This is because, ideally, system 10 would only have to be started once at the beginning of the heating system. A momentary switch to trip contactors or relays to operate strip heaters 98 for a preset time period is a failsafe such that strip heaters 98 would automatically turn off after the time period. There could also be a manual control for manual cleanout. As can be appreciated, there may be situations where the operator would periodically (for example, monthly) run the cleanout auger 16 to cleanout the system. The operator could visually watch the discharge from cleanout auger 16. Once ash and remnant ceases and fresh, uncombusted fuel is seen, the operator could assume cleanout is complete. Other controls and features could be incorporated into circuit 100. The collapse of fuel is solved by automatically instigating a filling of firebox 12 to plug up the collapse and then a procedure to ensure the inlet to the firebox 12 is plugged so that firebox 12 is repressurized for combustion.

E. Operation

FIGS. 22A-C are a flow chart of one way to operate system 10. There would be an initial fill and ignition sequence and then a continuous automatic on demand operation sequence that would include an automatic refill of firebox 12.

Control circuit 100, in combination with the hardware of system 10, is designed to allow automatic, continuous, on demand generation of heat through combustion for the purpose of providing heated air to a building. This is in contrast to batch-mode or intermittent-mode combustion. It promotes consistent, highly efficient combustion by automatically maintaining pressurization inside firebox 12 while utilizing and maintaining surrounding insulation of the combustion area to keep the outer part of firebox 12 relatively cool and to avoid the need for refractory material on the inside of firebox 12. It automatically senses loss of the insulating layer through thermocouples T2-9 which sense an increase of temperature on the outside skin of firebox 12. This automatic operation is designed to allow continuous operation of the combustor at a relatively constant burn and constant heat output. This can not only be more efficient, but also can effectively operated, for example, a steam generator, which needs a relatively constant, long-lasting heat source. Prior art biomass combustors have been plagued with the problem of being essentially batch mode—they are filled with a batch of biomass. It is combusted, but once substantially combusted, the process either extinguishes because the fuel is consumed, or extinguishes. The system must be shut down and the next batch filled. It must then be re-ignited. It takes a while to build up heat to a high level.

FIG. 23 gives a rough diagrammatical illustration of the difference between continuous operation of the exemplary embodiment of the present invention (line 230) and operation of batch-mode biomass combustors (line 240). On initial firing, both types have a gradual build up of output (cf. portions 231 and 241). Once the present embodiment reaches a continuous operation output, it is relatively constant over time. This is even though there must be periodic refilling. This relatively constant output is possible because combustor 10 automatically senses when partial refilling is needed to continue full operation, and accomplishes the partial refilling when needed. There can be some drop in output, but it is relatively minor.

In contrast, the batch-mode type combustor builds up to operating output 242, but then the batch of fuel is either consumed or is substantially consumed to the point output drops quickly and substantially (see portion 243). It must be essentially shut down, refilled and reignited. This takes substantially time with little or no output (portion 244). Also, a substantial amount of time is needed to build up to operating output again (portion 245). When the second batch of fuel is consumed, output drops out again. This repeats.

As can be seen by comparison of lines 230 and 240 in FIG. 23, the batch-mode combustor 240 has serious drop-outs in output compared to the present exemplary embodiment.

The exemplary embodiment theoretically can run indefinitely. Hundreds and even thousands of hours of continuous operation are contemplated between periodic maintenance or cleanings.

1. Initial Fill Sequence (see FIG. 22A and FIGS. 12A/B to 14A/B)

Initial filling of an empty firebox 12 (FIGS. 22A and 12A/B) is by depression of "manual fill" momentary switch (see FIG. 11G and step 200 in FIG. 22). Each of the two ground hopper augers 54 and 56 are started by PLC 102, as are fill auger 30 and the vibrators for both the ground hopper 50 and firebox 12 (see steps 202, 204, and 206 of FIG. 22). Load cells 98 can also be read (step 210). Fuel 90 begins filling relatively evenly into the firebox (FIGS. 13A/B).

When firebox 12 gets full of fuel 90 (FIGS. 14A/B), pressure (resistance) builds against fill auger 30. When this pressure, converted from amperage of fill auger motor M6 (monitored by PLC 102 by reading VFD 6) reaches a set point, circuit 100 assumes firebox 12 is full of biomass or fuel. A higher amp draw on motor M6 occurs because torque packs in fuel 90 and works against auger 30.

If amperage of auger motor M6 exceeds its set point (step 212), feed auger 30 is stopped from turning forward (step 213) and reversed (FIGS. 14A/B) in direction for a set period of time (step 214). Alternatively, instead of simply reversing auger 30 for a set period of time or times, auger 30 can be reversed and amp draw of motor M6 monitored, and if amp draw rises to a level indicative of inlet tube 36 being packed or sealed with fuel 90 (i.e. it is sensed to bog down because of packing of fuel 90 in tube 36), it is stopped from operation. This reversal of auger 30 organically seals firebox 12. As previously described, there is a "drop out" of flighting at section 34 of feed auger 30. This drop out section has no or reduced diameter flighting, depending on the fuel, of approximately 6 to 8 inches around the point where inlet tube 36 spills into firebox 12. When fill auger 30 is reversed, it packs fuel against this entrance hole because of the drop out section. In other words, the drop out section does not move fuel backward along auger 30. However, the flighting of auger 30 on the firebox side of drop out section 34 would move fuel and plug or jam it at that location which in turn plugs or seals inlet tube 34.

In the exemplary embodiment, auger 30 is reversed three successive set periods of time, to further ensure the seal is formed. Fuel remaining in feed auger 30 over the combustion zone inside firebox 12 would move back toward inlet tube 34, but because of the drop out of flighting, would pack the fuel in the most adjacent flights of flighting 32 and that part of inlet tube 34 to pack and seal the fuel in inlet tube 34 and around its opening into firebox 12. This deters any air or gas flow out of inlet tube 34 and promotes an air flow path from the outlets of combustion air tube or manifold 20, which is pressurized, through the combustion zone inside firebox 12, through the fuel above the combustion zone and into the exhaust manifold 26 for venting through stack 74. This is called an "organic seal" because it is using the biomass fuel to plug or seal that opening to maintain the pressurization and air flow accordingly for combustion, instead of any mechanical part or structure.

As noted at step 214 in FIG. 22, fill auger 30 is reversed for a brief period of time. It could be stopped and reversed for two similar periods of time. These three reversals essentially "prove" or ensure that there is likely a packing of an organic seal in that opening. It is to be understood, however, that one reversal may be sufficient. For example, amperage draw on feed auger 30 could be monitored and when it reaches a set point, system circuit 100 would assume there is a seal on a single reversal. Alternatively, two, three or more reversals could be made if further assurance is required or if auger amperage is not monitored. Once time t1 is expired (step 215), initial filling of an empty firebox is complete (step 216). System 10 is ready for operation.

2. Ignition (see FIG. 22A and FIGS. 15A/B)

Initial firing of the reactor combustor involves manual activation of momentary ignition switch "manual ignition" of FIGS. 11G and H (see step 220 of FIG. 22). This switch energizes resistance-type strip heater 98 for a set time (steps 221 and 222; approximately 10 minutes). As biomass fuel 90 has been filled around the strip heater 98, ignition commences. Heater 98 cause fuel 90 in contact with it to ignite (FIGS. 15A/B). There tends to be enough ambient or residual air initially in firebox 12 to start this limited combustion. Air from combustion fan 18 is not normally needed at this point.

As described earlier, this ignition is only needed, ideally, once at the beginning of the heating system. The fire usually does not go out unless the machine is run to empty and sits idle for at least a few days. However, the manual ignition is made available in the event it is required at any time. Combustor 10 is ready for normal continuous operation (step 223).

3. Normal Operation (see FIG. 22B and FIGS. 16A/B to 19A/B)

FIGS. 12A and B diagrammatically illustrate an empty firebox 12 and the relationship of the components inside it.

FIGS. 13A and 13B illustrate forward operation of fill auger 30 to begin filling biomass fuel 90 into firebox 12. As can be seen, it begins to cover cleanout auger 16, combustion air manifold 20, and heat exchange manifold 26. Initial filling would continue until the level of fuel goes all the way to the top of firebox 12 and PLC 102 senses an amperage draw of motor M6 of feed auger 30 indicative that it has filled firebox 12 with fuel.

FIGS. 14A and B illustrate a reversal of fill auger 30 to push some of the fuel in firebox 12 back against the opening of feed tube 36 for the organic seal of firebox 12.

FIGS. 15A and B illustrate the basic position of the initial ignition of fuel in firebox 12. This ignition would start exhaust moving upward through fuel above it and start heating and drying that fuel.

FIGS. 16A and B show a subsequent stage after ignition. Because fuel 90 basically bridges and stays in its position after the initial fill, combustion would start consuming fuel in and around the ignition strips across the longitudinal length of firebox 12. This consumption would tend to create a void or cavity in which a fireball would exist of extremely high temperature. Fuel 90 around that void would insulate and hold in heat for efficient consistent combustion.

After initial ignition and firing with igniters 98, system 10 would wait until thermostat 94 calls for heat (when the temperature of this conventional thermostat is below and adjustable set point) (see step 224 of FIG. 22). If thermostat 94 calls for heat, circuit 100 turns on combustion air blower motor M4 (step 226). At approximately the same time it turns on heat exchange air, the fan or pump M5 to bring outside air into heat exchanger manifold 26 and circulate it there through and then back out heated air outlet 86 which is in fluid communication with the building to provide heated air to heat the building (step 228).

Combustion air blower 18 runs continually unless one of the following cycles it off (or alternatively slows blower 18 down—see step 242):

a. The set point of thermostat 94 is satisfied (step 230).

b. A high temperature limit (e.g. one Underwriters Laboratories, Inc. standard is 175 degrees F. or greater) of the exchange medium (heat exchanger air output in this case) is reached (would be indicated by thermocouple T1 exceeding its set point) (step 232).

c. Automatic continuous reaction fill cycle is in operation (step 234). Thermocouples T2-T9 would signal if a refill sequence is needed. During that time, combustion air is turned off so smoke or fire does not leak out of feed auger entrance to firebox 12. In other words, as described later below, if the feed auger 30 is operating, combustion air is turned down or off to depress combustion until firebox 12 has its organic seal back in place.

d. Exhaust stack alarm is active (step 236). Depending on the makeup of the bio fuel, creosote tends to build up in exhaust stack 74. This build up can ignite because the exhaust can reach temperatures in the range of 1000° F. or more. Thermocouples T11 and T12 are monitored by PLC 102. Thermocouple T11 is towards the bottom of stack 74, whereas thermocouple T12 is above it (e.g. separated by a few feed). When higher sensor T12 measures a higher temperature than lower sensor T11 (e.g. by more than a few degrees) circuit 100 assumes there is a stack fire because normally higher sensor T12 would register a lower temperature than lower sensor T11 because exhaust tends to cool as it travels up and away from firebox 12. At this point, combustion air blower of fan 18 is cycled off to prevent sparks from coming out of stack 74.

It is noted that system 100 has a optimization routine regarding either combustion air or exchanger air. PLC 102 can automatically increase combustion air during this continuous combustion operation. Through the various monitors in system 10, it can decide at what point optimal combustion is occurring relative to the amount of combustion air being supplied. It does so in a manner in which it increases combustion air until it senses a condition that indicates detrimental trend in the combustion. It then reduces combustion air linearly or in a step fashion until it senses diminishing returns. It continues to go back and forth until it settles on a "sweet spot" for operation. This could be on a continuous basis or periodic basis. It essentially is fine tuning the combustion air, first between a larger upper and lower limit but then continuously narrowing that range until it settles into a single value or very narrow range of operation.

Alternatively, or in addition, exchanger air blower 22 can be adjusted similarly. Even though it is not directly moving air through combustion zone, the amount of air moved through heat exchange manifold 26 can increase or decrease the amount of heat removed from firebox 12 which in turn can affect the combustion.

FIGS. 22A-C illustrate at steps 230, 232, 234, 236, 238, 240 and 241 these various conditions for cycling combustion air off.

As indicated at FIG. 22B, for steps 230, 232, 234 or 236, combustion air is cycled off or slowed down (step 242) and a worker can then investigate and resolve any problem. Once fixed, circuit 100 would go back to continuous operation. If thermostat continues to call for heat, combustion fan and heat exchange fan would be turned on. If the thermostat does not call for heat, combustion air would not be turned on nor would exchange fan be turned on until it does so (step 224 of FIG. 22B).

Similarly, if thermocouple T29 at the outlet of heat exchanger manifold 24 exceeds a set point, combustion air could also be turned off. This could be a back up to thermostat 94 or a safety feature. Likewise, if stack fire is indicated, combustion air is turned off until the problem is fixed.

Note in FIG. 22B that PLC 102 could be programmed to periodically run clean out auger 16. For example, a internal clock in PLC 102 could run auger 16 for a given time period, regardless of any other condition, once a year, month, or even day (steps 243, 244, and 245). Combustion air is also off during this time (step 241).

Note also that combustion air can be turned off or slowed down if thermistor T10 exceeds its set point (step 310, FIG. 22B). This condition tends to indicate that the seal of inlet tube 36 has been lost. As shown in FIG. 22B, this would automatically instigate an auto fill sequence (FIG. 22C) culminating with a reversal of auger 30 to re-instate the seal in tube 36. Although combustion could proceed even if the seal of tube 30 is lost or compromised, the re-sealing is done to prevent smoking out of firebox 12 through inlet tube 36, as well as to maximize retention of heat and combustion in firebox 12.

4. Automatic Fill Sequence (see FIG. 22C and FIGS. 20A/B to 21A/B)

As described above, FIGS. 16A and B illustrate an initial void in which a fire ball is established during early combustion of the fuel in firebox 12. FIGS. 17A and B illustrate how that void would tend to expand vertically as the combustion consumes fuel from inside out in firebox 12, but with the defacto refractory of the insulating layer of fuel 90 around the fire. This would be the continuous normal operation of system 10. FIGS. 18A and B illustrate a fully developed fire ball. As can be seen, a rather substantial void is created but it is still completely surrounded and insulated by fuel. As previously mentioned, the ends would tend to be insulated by layers supported above tubes 17A and B because they would deter fuel from dropping down into cleanout auger 16.

However, as fuel 90 burns from the inside out, the void or fire ball in the center of firebox 12 gets larger and larger (compare FIGS. 16A-B, 17A-B, and 18A-B). At some point, some portion of fuel 90 above the void collapses by gravity. Testing has shown it is usually a spot within one of the four zones 1, 2, 3, or 4 in the firebox 12 (see FIGS. 2A and 19A). In FIG. 19A, the collapse is in zone 2.

One of the temperature sensors or thermocouples T4 or T5 associated with zone 2 of firebox 12 would exceed its set point because the fire ball would be released to move up and heat up the skin of firebox 12 in that area (step 234). The system would then go to an auto fill sequence (see step 246 and FIG. 22C). Fuel 90 is no longer insulating the top skin of firebox 12 in that area, and therefore, not concentrating the heat on heat exchanger manifold 24. The temperature sensor thermocouple in the relative area senses the heat and would call for an automatic fill sequence. (Step 234 of FIG. 22B). Also, if thermocouple T10 in the feed tube 36 in the firebox 12 exceeds its set point, circuit 100 will assume the organic seal is not intact and call for an automatic fill sequence.

When the auto fill sequence is initiated by controller 102, the following occurs:

a. Cleanout auger 16 and vibrators 61 on the bottom of firebox 12 are turned on after combustion air is shut off (see steps 250, 252, 254 of FIG. 22C). This is a timed event depending on the amount of noncombustibles in the fuel, e.g. 2 to 5 minutes. Note that if cleanout auger motor M7 exceeds its set point amperage during this cycle (step 256), control circuit 102 shuts motor M7 off and displays an error message (e.g., "plugged cleanout auger"). (Steps 266 and 268). This would give the operator a chance to unplug the cleanout auger before continuing further with operation of system 10. It is preferable that a manual cleanout be conducted perhaps once a week or so.

b. If the cleanout auger operation cycle times out (step 260), fill auger 30 is turned on (step 270), along with ground hopper augers and vibrators (steps 271, 272). The system watches amperage draw of fill auger 30 (step 280). If fill auger 30 reaches its amperage set point too soon (step 282), control circuit 102 stops it and displays an error message (e.g., "plugged fill auger") (steps 284, 286). This can occur if for example large rocks obstruct its operation. This gives the operator a chance to unplug the fill auger before operation of system 10 continues.

c. On the other hand, if a fill auger 30 does not reach its amperage set point in the correct time (too late, step 290), circuit 102 stops it and an error message (e.g., "long fill") is displayed (steps 292, 294). The system assumes that the fill hopper 40 is empty.

d. Otherwise, the fill cycle continues with the fill and ground hopper augers and vibrators on (steps 270, 271, and 272) until firebox 12 is full, which is observed by circuit 100 when fill auger 30 exceeds its amperage set point within a time window between too short and too long (step 280). Fresh fuel 90 moves along existing fuel in firebox until it reaches the gap caused by the collapse (FIGS. 20A/B). The fresh fuel 90 falls into the gap. Some falls through the gap into the combustion, and even to the bottom of firebox 12. But the natural bridging characteristics of fuel 90 eventually fill, plug, and/or bridge the gap to close it and re-insulate the firebox 12 (FIGS. 21A/B).

e. Once the firebox is assumed full, the forward direction of feed or fill auger 30 is terminated (step 300) and then the organic seal is "proven" by reversing fill auger 30 (step 302) for a preprogrammed time (step 304) as previously described. System 10 is then ready to return to normal continuous operation (step 206 of FIG. 22B). For example, if there is a call for heat, the system turns combustion air blower motor M4 on with a call for heat from thermostat 94 (step 224) and the continuous operation proceeds as previously described.

The auto fill sequence therefore automatically senses a need to plug a collapse of the insulating fuel around the fire ball, feeds fuel across fill auger 30 to fill any such plug by operating fill auger 30 for a timed period and then monitoring when it starts to labor because the fuel has completely filled up firebox 12. It proves the fill and the organic seal by reversing feed auger 30 and thus reinstitutes a complete seal around the fire of insulating fuel to continue efficient, consistent operation of the combustor.

Of course, the operator must make sure there is sufficient supply of fuel in ground hopper 50 to allow that continuous operation. As can be appreciated, the ground hopper 50 can be made to various sizes to have whatever feed supply or fuel is desirable. System 10 could theoretically operate indefinitely with sufficient supply of fuel and if any of the conditions mentioned do not cause circuit 100 to shut down the system.

As can be further appreciated, optimum heating likely occurs when there is a fully developed fireball and void surrounded by fuel in firebox 12. Once developed enough that one area of fuel collapses, other areas would likely shortly follow. In other words, when one area collapses, it is likely that fuel has been consumed and fuel has been dried out sufficiently that it is more likely to collapse. The system monitors this and when any part or areas of fuel collapse, the auto fill sequence is initiated. The setup is such that even though some areas are not yet collapsed, the operation of auger 30 would move fuel to where gravity would drop it into any collapsed area. This would tend to drop it through the collapsed area and fill up some of the fireball void. However, the fuel would tend to stack up and then plug the collapsed area. Feed auger 30 would then start feeling the pressure of fuel all along its length and reach its amperage set point and then reverse for proving the organic seal and shut down.

Sometimes there could be a collapse of fuel in multiple areas. The fill cycle would take care of that.

As can be appreciated, at the end of the heating system, the system can be intentionally shut down by either shutting off the automatic fill sequence so that all fuel in firebox 12 is consumed and then turn off system 10. Alternatively, combustion air could be turned off and heat exchanged air turned off to hopefully shut down combustion and then the remaining fuel augured out with the cleanout auger 16.

F. Failsafes

As described, a number of failsafes are built into system 10. For example:

a. Thermocouples T2-9 on firebox skin. If the fireball is lost because of a dropout of fuel, combustion air is turned off until the firebox is refilled, plugged, and pressurized.

b. Stack thermocouples T11-12. They sense and dose stack fires. Normally they should both see about 200 to 500° F. However, if offset in sensed temperature between them (e.g. top thermocouple T12 is hotter than bottom thermocouple T11 by greater than approximately 50 degrees F.), the system assumes a stack fire and turns off combustion air.

c. Thermocouple 13 in the exhaust path could indicate if emissions contain undesirable substances.

Other failsafes are possible. Below are some examples:

a. A thermocouple could be placed and monitored in the inlet tube 36 from the feed hopper. If it exceeds a set point, it could indicate there is a faulty fill or the feed hopper is empty (FIG. 22B, step 310). It would sense the presence of hot exhaust air. The could result in an instruction to turn off combustion air, to commence an auto fill sequence, or issue a warning to the operator to check on the situation.

b. Auto damper—if the thermostat is not calling for heat, after a set period of time a damper could be closed either partially or fully to diminish or shut off combustion air to save fuel.

c. There could be an electronically controlled lock on an access door to the interior of the firebox 12 so that it can't be opened so long as there is a fire generated in it.

d. Not only could combustion air be turned off and augers turned off if they indicate a plugging or binding from a rock or whatever, any of the augers could be reversed to try to eject rocks for example.

G. Options and Alternatives

It will be appreciated that the present invention can take many forms and embodiments. Variations obvious to those skilled in the art are included within the invention which is defined solely by the appended claims. The invention is not limited to the specific exemplary embodiment disclosed herein.

For example, the scale of system 10 or its components could be changed according to need and desire.

By further example, substitutions and shape, materials, or configurations are possible.

One of the features of the present invention is that it has been found to work with a variety of different types and characteristics of fuel. There may be some fine-tuning needed for different fuels but basic principles and structures can be used for a variety of such fuels.

Another example is mode of operation. While the exemplary embodiment has an electrical control circuit, there could be a much more manually operated system. For example, there could be manually operated augers. A thermometer or pop-up temperature sensor could visually indicate to the operator a fuel collapse. The operator could manually operate an auger to have a fill sequence and reverse the auger for the organic plug.

The mode of operation can vary. The exemplary embodiment utilizes an adjustment of combustion air to find the "sweet spot". For example if there is poor fuel, an increase in oxygen and/or decrease in exchanger air fan speed might be indicated. For good fuel just the opposite might be indicated.

Utilization of the heated combustion can vary. As indicated, the exemplary embodiment circulates air through the interior of the firebox to collect and extract heat. Any type of heat exchanger could be utilized including fluid types or the like. Additionally a boiler to generate steam could be utilized.

It will be appreciated that the auto fill sequence many times brings new fuel into the firebox. Therefore, the gap caused by the collapsed area fuel, in this case, would be filled with new and usually higher moisture fuel. It would then take longer to dry out and collapse. On the other hand, the fuel could have quite different characteristics than the fuel already in the firebox. Again, the feature of the invention is its ability to handle fuel of different characteristics.

It has been found that as a general rule, in a system 10 of the size with good fuel, it can take several hours for the initial fill of fuel to get to the point it starts collapsing. It has been found that normally there will only be one area that collapses. The auto fill sequence is completed and has been found that usually it will be another couple hours before another collapse. Therefore, normally system 10 operates for extended periods of time with the complete fuel insulation around the fireball.

It is to be also understood that there is a natural air flow through the firebox 12 even when combustion air is fully turned off. Therefore, as described earlier, on the event of cycling off combustion air, normally combustion continues in the firebox for somewhat extended period of time. This allows it to be regenerated into a full fireball by reinstigation of combustion air. On the other hand, it allows conservation of fuel until such time as the thermostat calls for heat or the system is in a state enabling reinstigation of the full fireball. For example, complete shutdown of combustion air can normally continue a low level fire in the firebox for a couple of days. Therefore even if heat is not called for that period of time, there does not have to be a re-ignition. This again, is dependent on a number of factors including the type and condition and characteristics of the fuel.

What is claimed is:

1. An apparatus for combusting fuel which can bridge, comprising:

a. a firebox comprising an enclosing wall having a top, bottom, opposite ends, opposite sides, and an interior and exterior;

b. a fuel feed transporter operatively positioned to provide fuel which can bridge to the interior of the firebox, wherein the fuel from the fuel feed transporter insulates the firebox at least a substantial portion of the enclosing wall;

c. a temperature sensor operatively positioned to measure temperature at the exterior of the firebox;

d. a circuit operatively connected to the temperature sensor and the fuel feed transporter and configured to operate the fuel feed transporter based on measured temperature of the temperature sensor exceeding a threshold indicative of loss of insulation at the enclosing wall of the firebox by the fuel during combustion.

2. The apparatus of claim 1 wherein the fuel comprises biomass.

3. The apparatus of claim 1 wherein the enclosing wall comprises metal plate or sheet.

4. The apparatus of claim 3 wherein there is no refractory associated with the firebox.

5. The apparatus of claim 1 wherein the fuel feed transporter is an auger.

6. The apparatus of claim 1 further comprising a feed opening through which fuel passes into the interior of the firebox.

7. The apparatus of claim 6 wherein the fuel feed transporter can be operated in a first state which moves fuel along the top interior of the firebox in a direction towards a side of the firebox opposite the feed opening, and a second state which moves fuel in the firebox towards the feed opening, so that fuel can be moved through the feed opening into the firebox to fill the firebox, and some fuel moved towards the feed opening to substantially block or seal the feed opening.

8. The apparatus of claim 1 wherein the temperature sensor measures temperature of the exterior wall of the firebox at or near the position of the temperature sensor.

9. The apparatus of claim 8 wherein the temperature sensor comprises a thermocouple assembly.

10. The apparatus of claim 9 wherein the thermocouple assembly comprises a washer-type, surface mount thermocouple device.

11. The apparatus of claim 1 further comprising a plurality of temperature sensors connected to the circuit and at spaced apart locations on the exterior of the firebox.

12. The apparatus of claim 11 wherein the plurality of sensors are positioned nearer the top of the firebox than the bottom.

13. The apparatus of claim 1 wherein the circuit comprises a controller operatively connected to the temperature sensor and the fuel feed transporter, the controller generating a first signal to operate the fuel feed transporter in a first state if the temperature sensor exceeds its threshold.

14. The apparatus of claim 13 wherein the controller generates a second signal to operate to fuel feed transporter in a second state.

15. The apparatus of claim 14 wherein the first state moves fuel along the top interior of the firebox in a direction towards a side of the firebox opposite the feed opening, and a second state which moves fuel in the firebox in an opposite direction towards the feed opening, so that fuel can be moved through the feed opening into the firebox to fill the firebox, but some fuel that has been moved into the firebox can be moved back towards the feed opening to block or seal the feed opening.

16. The apparatus of claim 13 further comprising a thermostat operatively connected to the controller, the thermostat having a set point such that when ambient temperature sensed by the thermostat exceeds the set point, the thermostat generates a signal.

17. The apparatus of claim 1 further comprising a clean out opening in the firebox and a clean out transporter operatively positioned at or near the bottom interior of the firebox between the clean out opening and an opposite side of the firebox.

18. The apparatus of claim 17 wherein the clean out transporter has a first state which moves ash and non-combustibles along the bottom interior of the firebox in a direction towards the clean out opening, and a second state which operates in an opposite direction.

19. The apparatus of claim 1 further comprising a combustion air manifold operatively positioned in the interior of the firebox and operatively connected to source of pressurized combustion air.

20. The apparatus of claim 1 further comprising a heat exchanger operatively positioned in the interior of the firebox, the heat exchanger having an exterior and an interior.

21. The apparatus of claim 20 wherein the heat exchanger comprises a heat exchange manifold for circulating a gas or fluid between an inlet and outlet.

22. The apparatus of claim 21 further comprising a pump or fan to circulate the gas or fluid through the heat exchange manifold.

23. The apparatus of claim 20 wherein the heat exchanger comprises a boiler having an outlet.

24. The apparatus of claim 1 further comprising a feed hopper having a conduit in communication with the firebox.

25. The apparatus of claim 24 wherein the feed hopper has a mechanism to transport fuel through the conduit and into the firebox.

26. The apparatus of claim 25 wherein the mechanism to transport fuel comprises the fuel feed transporter.

27. The apparatus of claim 24 further comprising a second hopper having a conduit in communication with the feed hopper and a mechanism to transport fuel to the feed hopper.

28. The apparatus of claim 27 further comprising a vibrator mechanism operatively connected to the second hopper.

29. The apparatus of claim 27 further comprising a weight sensor operatively connected to the second hopper.

30. The apparatus of claim 29 wherein the weight sensor comprises a load cell position between the second hopper and a support for the second hopper.

31. The apparatus of claim 1 further comprising a vibrator mechanism operatively connected to the firebox.

32. The apparatus of claim 1 further comprising an exhaust manifold operatively positioned within the firebox and having a longitudinal axis with an outlet in fluid communication with an exhaust chamber at one end of the longitudinal axis.

33. The apparatus of claim 32 wherein the exhaust manifold comprises a plurality of intake openings.

34. The apparatus of claim 33 wherein the intake openings are spaced apart along the longitudinal axis and have an area which stays the same or decreases is size from intake opening to intake opening as they get closer to the outlet.

35. The apparatus of claim 32 further comprising an exhaust stack in fluid communication with the exhaust chamber.

36. The apparatus of claim 32 further comprising a temperature sensor in the exhaust chamber and connected to the circuit.

37. The apparatus of claim 35 further comprising a first temperature sensor in the exhaust stack and connected to the circuit.

38. The apparatus of claim 37 further comprising a second temperature sensor in the exhaust stack and connected to the circuit, the first temperature sensor positioned lower in the stack, the second higher.

39. The apparatus of claim 32 further comprising a particle scrubber in the exhaust chamber, and wherein the particle scrubber is in communication with the bottom of the firebox.

40. The apparatus of claim 6 further comprising a temperature sensor in or near the feed opening to the firebox and connected to the circuit.

41. The apparatus of claim 20 further comprising a temperature sensor in the interior of the heat exchanger and connected to the circuit.

42. The apparatus of claim 20 further comprising one or more temperature sensors at or near the exterior of the heat exchanger and connected to the circuit.

* * * * *